US007290418B2

(12) United States Patent
Herdman

(10) Patent No.: US 7,290,418 B2
(45) Date of Patent: Nov. 6, 2007

(54) PROGRAMMABLE LOCK WITH A CONTROLLED PROGRAMMING POSITION

(75) Inventor: Rodrick A. Herdman, West Chester, OH (US)

(73) Assignee: EZ Change Lock Company, LLC, West Chester, OH (US)

( * ) Notice: Subject to any disclaimer, the term of this patent is extended or adjusted under 35 U.S.C. 154(b) by 0 days.

(21) Appl. No.: 11/192,755

(22) Filed: Jul. 29, 2005

(65) Prior Publication Data

US 2006/0021406 A1 Feb. 2, 2006

Related U.S. Application Data

(60) Provisional application No. 60/592,456, filed on Jul. 30, 2004.

(51) Int. Cl.
*E05B 27/04* (2006.01)

(52) U.S. Cl. ..... 70/383; 70/341; 70/343; 70/384; 70/493

(58) Field of Classification Search ..... 70/382–386, 70/368, 340, 395, 398, 400, 377, 378, 493–495, 70/337–343, 358, 419, DIG. 75, DIG. 71, 70/DIG. 44, DIG. 37, DIG. 21, 376, 392
See application file for complete search history.

(56) References Cited

U.S. PATENT DOCUMENTS 1,650,568 A 5/1927 Hurd
2,113,007 A 4/1938 Swanson
2,326,358 A * 8/1943 Hull ..... 70/385
2,427,837 A 9/1947 Connell
2,818,723 A 1/1958 Levin
3,059,462 A * 10/1962 Check ..... 70/384
3,070,987 A 1/1963 Baker et al.
3,149,486 A * 9/1964 Russell et al. ..... 70/384
3,183,692 A 5/1965 Check
3,234,768 A * 2/1966 Russell et al. ..... 70/383
3,286,494 A 11/1966 Sussina (Continued)

FOREIGN PATENT DOCUMENTS

CA 695186 9/1964

(Continued)

OTHER PUBLICATIONS

MasterLock brochure, Apr. 2003, "Key Control Security", MO-15M.

(Continued)

*Primary Examiner*—Lloyd A. Gall
(74) *Attorney, Agent, or Firm*—Daniel F. Nesbitt; Hasse & Nesbitt LLC

(57) ABSTRACT

A key-operated lock that can be programmed for use with one of a plurality of user keys without disassembling the lock or replacing the tumblers. The lock operates with a user key so that the lock plug turns only in one direction to unlatch or unbolt, and can not operate or rotate in the opposite direction. The lock also cannot be programmed or reconfigured with an operable user key. The lock is typically manually latched or bolted into a locked configuration. The lock is configured to permit rotation in the opposite direction only when using a programming key, which can reconfigure or program the lock for use with another user key.

20 Claims, 31 Drawing Sheets

U.S. PATENT DOCUMENTS

| | | | | |
|---|---|---|---|---|
| 3,395,558 | A | 8/1968 | Russell et al. | |
| 3,431,757 | A | 3/1969 | Hori | |
| 3,512,382 | A | 5/1970 | Check et al. | |
| 3,516,271 | A | 6/1970 | Nelson et al. | |
| 3,605,462 | A | 9/1971 | Hermann | |
| 4,116,026 | A | 9/1978 | Flint | |
| 4,142,391 | A | 3/1979 | Paig | |
| 4,151,731 | A | 5/1979 | Tucker | |
| RE30,198 | E | 1/1980 | Oliver et al. | |
| 4,282,731 | A | 8/1981 | Taksony | |
| 4,403,486 | A | 9/1983 | Miyake | |
| 4,412,437 | A | 11/1983 | Smith | |
| 4,631,941 | A | 12/1986 | Sjunnesson | |
| 4,712,401 | A | 12/1987 | Monahan | |
| 4,712,402 | A | 12/1987 | Monahan | |
| 4,732,023 | A | 3/1988 | Shen | |
| 4,741,188 | A | 5/1988 | Smith | |
| 4,747,281 | A * | 5/1988 | Monahan | 70/383 |
| 4,776,187 | A | 10/1988 | Evans et al. | |
| 4,836,002 | A * | 6/1989 | Monahan | 70/382 |
| 5,000,019 | A | 3/1991 | Foster | |
| 5,138,856 | A | 8/1992 | Chun | |
| 5,450,662 | A | 9/1995 | Watts | |
| 5,718,136 | A | 2/1998 | Aldieri et al. | |
| 5,799,519 | A | 9/1998 | Hsiao | |
| 5,819,569 | A | 10/1998 | Herdman | |
| 5,964,111 | A | 10/1999 | Lambert | |
| 6,425,274 | B1 | 7/2002 | Laitala et al. | |
| 6,532,782 | B2 | 3/2003 | Chiu | |
| 6,722,171 | B1 | 4/2004 | Ruan | |
| 6,776,017 | B2 * | 8/2004 | Herdman | 70/338 |
| 6,860,131 | B2 * | 3/2005 | Armstrong et al. | 70/492 |
| 6,935,146 | B1 | 8/2005 | Lin | |
| 2003/0084692 | A1 * | 5/2003 | Herdman | 70/338 |
| 2003/0159483 | A1 | 8/2003 | Kondratuk et al. | |
| 2003/0217576 | A1 | 11/2003 | Koluch | |
| 2004/0060333 | A1 | 4/2004 | Armstrong et al. | |

FOREIGN PATENT DOCUMENTS

| | | |
|---|---|---|
| EP | 0918124 A1 | 5/1999 |
| JP | 2005-002641 | 1/2005 |
| JP | 2005-076286 | 3/2005 |

OTHER PUBLICATIONS

Rodrick A. Herdman, U.S. Appl. No. 10/708,658, filed Mar. 17, 2004.

Rodrick A. Herdman, U.S. Appl. No. 11/178,627, filed Jul. 11, 2005.

Rodrick A. Herdman, U.S. Appl. No. 11/374,299, filed Feb. 23, 2006.

* cited by examiner

PROGRAMMABLE LOCK WITH A CONTROLLED PROGRAMMING POSITION

CROSS REFERENCE TO RELATED APPLICATIONS

The present application claims the benefit of co-pending U.S. provisional patent application 60/592,456, filed Jul. 30, 2004.

BACKGROUND OF THE INVENTION

This invention relates generally to cylinder locks, and more particularly to a programmable cylinder lock that allows for adapting the lock to operate upon insertion of a key having a different configuration than a key to which the lock was originally configured for operation.

In many organizations, such as businesses, apartment buildings, hotels, schools, etc., it is generally desirable to customize the locks to the particular organization. There are two general methods by which keys and locks may be customized. The first involves reconfiguring the drivers and tumblers in the lock so that a key with a particular top edge contour may operate the locks of the organization. The second involves configuring the keyways in the locks to accept keys having a unique pattern of longitudinal contours formed in their sides. The purpose of the exclusivity generated by these methods is to prevent unauthorized entry into the organization. When keys and locks formed by the second method are involved, it is not sufficient for opening the lock that one have a key having a top edge contour appropriate to the lock; the key must also include an appropriate longitudinal contour of grooves and/or ridges.

In general, standard, conventional locks include a housing that has a cylindrical bore therein. An elongated generally cylindrical plug is rotatably mounted within the bore. A plurality of cylindrical apertures or holes extend through the housing and can be aligned with corresponding cylindrical holes in the plug. Paired sets of drivers and tumblers are positioned within these holes (i.e., the drivers within the holes in the housing, the tumblers within the holes in the plug) and are capable of moving within the plug and housing in such a manner as to allow for rotational movement of the plug in response to a main key inserted in the lock. The arrangement and construction of the lock also causes one or more of these sets of drivers or tumblers to be positioned in the interface between the plug and housing to prevent relative rotation between the plug and the housing when the wrong main key or no main key is inserted in the lock. However, the relative positioning of the sets of drivers and tumblers, plug, and housing is such that, when the proper key is inserted, the drivers are substantially wholly within the holes in the housing and the tumblers are substantially wholly within the holes in the plug, such that the plug can be rotated without interference to an unlocking position.

Many locks or sets of locks also include two types of keys: tenant or user keys and master keys. In general, each tenant key will only open one lock of a particular subset of locks, whereas a master key may open all the locks of the subset. Over the course of time, the security of an organization may become compromised by the loss of control of one or more of the tenant keys. For example, in apartment buildings, hotels, or motels, a guest or renter may leave and inadvertently or intentionally retain a key. When this occurs, subsequent occupants or tenants cannot be secure in their persons and property. Thus it would be desirable to easily and quickly reprogram the locks to accept a new key or set of keys.

Locks that can be easily changed are also desired by businesses where several employees are in possession of keys to fit the locks. In such situations, an employee may be discharged or quit, but retain possession of a key. Further, an employee may lose a key, thus placing the security of the locked area in doubt. Locks that can be easily changed are also desired in matters of personal security. One example of such a situation is a school where teachers and/or administrators may wish to quickly change the configuration of locks on classroom doors to secure students inside the classroom and safely set apart from the hallways in the event that an undesirable or dangerous individual breaches the security of the school.

Locks that can be easily changed are also desired by homeowners when a member of the family has misplaced or lost the operative user key, or when the family desires to allow limited access to the house through a temporary reconfiguration of a lock to the house. When keys are lost or are possessed adversely, the general response is to change the locks fitting the lost key to require a key with a new top edge contour to correspond to different length tumblers. Generally, the shape of the longitudinal inner walls of the keyway that confront the longitudinal contour on the side of the key is not changed due to the generally exorbitant cost of such a change.

In many conventional locks, rotation of the user or master key with the lock is only permitted in one direction. Generally, such unidirectional locks are manually latched to the closed position, without manipulation of the user key, and are opened or the latch unlocked by insertion and rotation of the operable user key within the lock. Examples of such locks and latches combinations include padlocks, certain deadbolt locks, and knob locks having a push-button locking or latching button on the inside knob. These locks are all characterized as permitting only unidirectional rotation of the lock cylinder or plug within the housing of the lock with an inserted user key.

There are several generally known methods in the prior art for changing the configuration of drivers and tumblers in standard cylinder locks. Some of these methods involve removing the drivers and tumblers from a lock and replacing them with a different set of drivers and tumblers. However, there are many disadvantages to these prior methods of changing locks. First, these methods are tedious and time consuming. Second, they generally require the presence of a locksmith. And finally, they require disassembly and reassembly of the actual lock structure along with removal and replacement of the lock in a door.

Thus, it would be desirable to provide and construct a lock, and particularly a lock permitting only unidirectional rotation with a user key, that permits rapid programming of the lock to a different design or configuration to operate with a different user key. It would further be desirable to provide a lock that allows the operative key to be changed without removal of the plug from the lock, and/or other disassembly of the lock structure. It would be further desirable to provide a lock wherein the user key can not be used to program or change the configuration of the lock.

SUMMARY OF THE INVENTION

The present invention provides a cylinder lock for operating a bolt or a latch, that can be programmed for use with one of a plurality of user keys without disassembling the lock or replacing the tumblers. The lock operates with a user key so that the plug rotates only in one direction to unlatch or unbolt, but can not operate the lock or rotate the plug in the opposite direction. The lock is typically manually latched or bolted into a locked configuration.

In one aspect of the invention, the plug of the lock is configured to permit rotation in an opposite direction to a programming position when using a programming key, which permits reconfiguration or programming of the lock for use with another user key. The lock cannot be rotated to the programming position with an operable user key.

In another aspect of the invention, the configuration of the lock can be changed to operate with a second user key of the set of keys solely in response to insertion of the second user key and rotation of the plug to the operating position. The reconfigured lock then cannot be operated by the first user key.

The present invention therefore relates to a key-operated, programmable lock that can operate the lock with any one of a plurality of user keys, and is programmable with a programming key to reconfigure the lock to operate with another one of the plurality of user keys, without disassembling the lock.

The present invention further relates to a programmable lock assembly that can be reconfigured to operate with a user keys selected from a set of keys, without disassembling the lock. The lock comprises: a) a housing having a cylindrical bore with an inner surface and a plurality of driver chambers intersecting the bore surface; b) a plurality of drivers, each driver being movable within one driver chamber and being urged toward the inner surface; and c) a plug having a cylindrical periphery and rotatably mounted within the bore so as to form a shear surface at the interface of the inner surface, the plug being rotatable from a key insertion position in a first direction to an operating position, and in a second direction to a programming position. The plug has 1) a keyway configured to receive a key selected from a set of keys comprising a first user key having a first contour edge and a second user key having a second contour edge, wherein the first contour edge and the second contour edge each have at least a first contour position and a second contour position that are differently configured, and a programming key configured to rotate the plug in the second direction to the programming position; 2) a plurality of tumbler chambers intersecting the plug periphery and the keyway, each tumbler chamber being aligned with a driver chamber when the plug is at the key insertion position so as to form a pin chamber, and wherein at least one of the tumbler chambers is a programming tumbler chamber; 3) a plurality of retainer cavities formed into the periphery, each retainer cavity being spaced apart from a corresponding tumbler chamber and aligned with a corresponding driver chamber when the plug is at the programming position; 4) a means for enabling rotation of the plug with a user key in the first direction to the operating position; and 5) a means of preventing rotation of the plug with an inserted user key in the second direction to the programming position. The lock also comprises d) a plurality of tumblers, each tumbler being movable within a tumbler chamber; e) a plurality of lock configuration change members, each change member movable within the lock between a first position within a pin chamber and a second position within a retainer cavity, and f) a means for moving the plurality of change members from the second position within the corresponding retainer cavity to the first position within the pin chamber when the lock is in the programming position. The configuration of the lock comprises the positioning of the plurality of change members in either the pin chambers or retainer cavities.

The means for enabling rotation of the plug with a user key to the operating position typically comprises an operating shear line formed in the plug along the length of and on one side of the programming tumbler chamber. The means of preventing rotation of the plug with an inserted user key to the programming position typically comprises a programming shear line that intersects the tumbler on the opposite side of the programming tumbler chamber upon insertion of a user key. The programming shear line is typically formed along the shear surface. The operating shear line typically comprises the edge of a tapered groove that originates at a descending point in the periphery of the plug that is circumferentially displaced from the programming tumbler chamber, and extends radially inwardly and circumferentially toward the programming tumbler chamber, to intersect the programming tumbler chamber and form the edge. The user keys are configured to raise the tumbler in the programming tumbler chamber whereby an interface selected from either the top of the programming tumbler or the bottom of the programming driver registers with the operating shear line. The means for moving the plurality of change members from the second position to the first position typically comprises a change slot that intersects a portion of the retainer cavities, and a change tool that engages and moves the change members out of the retainer cavity upon manipulation of the change tool in the change slot. Typically the first user key operates the lock in a first lock configuration but does not operate the lock in a second lock configuration, and the second user key operates the lock in the second lock configuration but does not operate the lock in the first lock configuration.

The invention also relates to a programmable lock assembly that can be reconfigured to operate with a plurality of different user keys of a set of keys, without disassembling the lock. The lock comprises: a) a housing having a cylindrical bore and a plurality of driver chambers intersecting the bore surface; b) a plurality of drivers, each driver being movable within one driver chamber and being urged toward the bore surface; and c) a plug rotatably mounted within the bore so as to form a shear line at the interface of the bore and the plug periphery, the plug being rotatable in a first direction between a key insertion position and an operating position where the lock operates to unlatch. The plug further has: 1) a keyway configured to receive a key selected from the set of keys; 2) a plurality of tumbler chambers intersecting the plug periphery and the keyway, each tumbler chamber being aligned with a driver chamber when the plug is at the key insertion position and wherein at least one of the tumbler chambers is a programming tumbler chamber; 3) at least one retainer cavity formed into the periphery, and aligned with a corresponding driver chamber when the plug is rotated between the key insertion position and the operating position; 4) a means for enabling rotation of the plug with a user key in the first direction to the operating position; and 5) a means of preventing rotation of the plug with an inserted user key in the second direction to the programming position. The lock further comprises: d) a plurality of tumblers, each tumbler being movable within a tumbler chamber; and e) at least one lock configuration change member associated with a pin chamber, movable within the lock from a first position within the pin chamber to a second position within the retainer cavity solely in response to insertion of a user key and rotation of the plug to the programming position. The configuration of the lock is based upon the positioning of the change member in either the pin chamber or the retainer cavity, wherein a first user key operates the lock in a first lock configuration but does not operate the lock in a second lock configuration, wherein a second user key operates the lock in the first and the second lock configurations.

The plug of the lock can optionally comprise a change slot that intersects a portion of at least one retainer cavity, whereby the change member can be moved from the second position within the retainer cavity upon engaging a change tool in the change slot.

The inventor also relates to a programmable lock assembly that can further be configured for operation with a temporary access key, associated with a main user key, for temporarily operating the lock. The main user key can be configured alternatively to cancel operation with the associated temporary user key, or to continue allowing operation with the associated temporary user key, when the main user key is again inserted into and operates the lock. The lock uses a means for positioning a temporary lock configuration change member within the plug of the lock for establishing the temporary lock configuration.

The present invention also relates to a lock kit, comprising: a) a set of keys as described herein; b) a programmable lock assembly, as described herein; c) instructions for use; d) optionally a change tool; and e) a means for securing together the keys, lock assembly, the optional change tool, and the instructions.

The present invention also relates to a method for programming a lock from operation by a first user key to operation by a second user key, without disassembling the lock, the method comprising: a) providing a set of keys comprising at least a first user key and a second user key, and a programming key, each of the keys having a contour edge, the second user key having a different contour edge than the first user key; b) providing a programmable lock assembly comprising a housing and a rotatable plug with a keyway, wherein the plug can be rotated from a key insertion position alternatively either in a first direction with a user key to an operating position or in the opposite direction with the programming key to a programming position; c) inserting the programming key into the keyway and rotating the plug to the programming position; and d) manipulating a change tool in a change slot in the plug, to engage at least one retainer cavity in the plug configured to retain a lock configuration change ball, to displace the change member from the retainer cavity and to configure the lock into a reset configuration; e) rotating the plug to the key insertion position; f) removing the programming key and disengaging the change tool; g) inserting the second user key while the lock is in the reset configuration; h) rotating the plug back to the programming position, to configure the lock for the second user key; and i) rotating the plug back to the first position wherein the lock is configured for operation by the second user key.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE INVENTION

Figure 1:
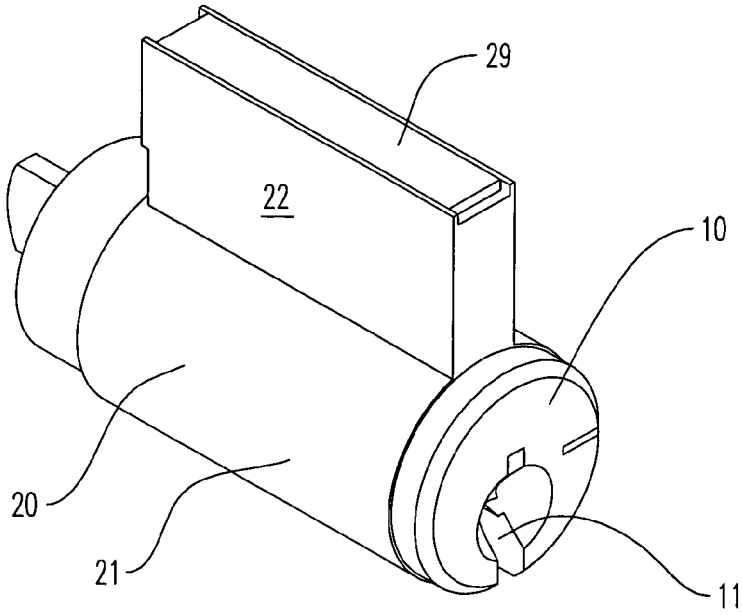
FIG. 1 shows a perspective view of an embodiment of a programmable lock of the present invention.

The changeable lock typically includes a housing with a bore and a plug (or lock core) rotatably mounted within the housing. The housing has a cylinder portion having a cylindrical bore with a longitudinal axis, and a stack portion extending outwardly from the barrel portion. The stack portion of the housing has a plurality of holes or driver chambers extending from the centerline of the housing bore, which intersect the bore. The housing is typically inserted into a suitably configured opening in a door, a body of a padlock, or another object, where operation of the lock can open, and optionally close, a latch or other means for securing the door, padlock or object.

The plug has a longitudinal axis and a keyway that is configured to receive a key. Rotation of the plug within the bore of the housing establishes a shear surface or arc at the intersection of the lower end of the driver chamber and the bore. The plug has a plurality of radially extending holes or tumbler chambers that penetrate the periphery and intersect with the keyway.

The tumbler chambers and the driver chambers receive, respectively, the drivers and tumblers of the lock. When the plug is in a first position within the housing bore, also termed the key insertion position, the radially-extending tumbler chambers align with the extending driver chambers to form a plurality of pin chambers. Each pin chamber is provided with a tumbler that is positioned for axial movement within the tumbler chamber, and a driver that is positioned for axial movement within the driver chamber. When the lock is in the key insertion position, either the driver or tumbler can extend from the respective driver chamber or tumbler chamber to span across the shear line.

The lock also comprises a plurality of a main change member. In its first position, the main change member resides within the pin chamber between the tumbler and the driver. In its second position within the lock, the change member can reside within a separate retainer recess or cavity located in or otherwise associated with the plug. Typically, the lock comprises a plurality of the retainer cavities formed in the periphery of the plug, aligned in a first row parallel to the axis of the plug. The change member can have a cross-sectional size smaller than that of the driver and tumbler. By moving one or more change members between one or more of the pin chambers and the retainer cavities, the lock configuration can be programmed to operate with one of a set of user keys.

Each user key of the set of user keys has a blade portion that is inserted into the keyway. The blade has a top contour that defines a plurality of contour positions, each position associated with a pin chamber. When inserted into the keyway, the contour positions raise the respective tumbler, driver, and change member (if present) within the pin chambers. Generally, and except as otherwise provided, if any of the driver or tumbler bodies span across a shear line, then the plug will not rotate within the housing.

The lock of a first embodiment is configured for operation wherein a user key inserted into the keyway can only rotate the plug within the housing from the first or key insertion position, in only one direction, to a second position or operating position, typically an unlock position. The lock is provided with a means for enabling rotation of the plug with a user key in the first direction, and with a means of preventing rotation of the plug with the user key in the second direction to a programming position. The means for enabling rotation and the means for preventing rotation can be accomplished by the same means, or different means, although typically the two means cooperate.

In one embodiment of the means for enabling rotation and the means for preventing rotation, a groove is formed adjacent to one of the tumbler chambers, termed a programming tumbler chamber. The groove has a width of at least the width of the tumbler chamber. The groove forms a ramp that extends from the periphery of the plug to an intermediate point along the length of the programming tumbler chamber. The tapered ramp provides the programming pin chamber with an operating shear line at the edge of the ramp that intersects the programming tumbler chamber. The operating shear line provides rotation of the plug only in the first direction, toward the first rotated position of the plug, when the upper end of the programming tumbler is aligned therewith, even when a driver or other element is spanning the programming shear line.

When any operable user key is inserted into the keyway, the programming contour position of the blade of the key raises the tumbler and driver within the programming pin chamber to a height wherein typically the lower end of the driver, or upper end of the tumbler, is adjacent to and registers with the edge of the ramp at the intermediate point of the tumbler chamber. Although the driver in the programming pin chamber, upon insertion of a user key, is spanning the programming shear line, rotation of the user key and plug in the one direction allows the ramp edge to shear the pin stack at the bottom of the driver. As the plug rotates, the driver moves along and up the ramp, and fully into the driver chamber, thus permitting full rotation of the plug to the operating position.

On the other hand, rotation of the plug in the opposite direction is not possible with a user key, since the driver in the programming pin chamber remains spanned across the programming shear line. However, the programming contour position of the blade of the programming key can raise the tumbler and driver within the programming pin chamber to a slightly greater height from the centerline of the plug, where the lower end of the driver registers with the programming shear line, thereby disposing the driver completely within the driver chamber, and allowing free rotation of the plug within the housing bore to the programming position.

Insertion of the programming key into the keyway also causes any change member positioned within the other pin chambers to be raised into the respective driver chambers. As the plug is rotated in the opposite direction toward the programming position, the change members are trapped within the driver chambers below the respective drivers. At the programming position, the aforementioned retainer cavities in the plug become aligned with the driver chambers of the housing, and a biasing member or spring over the driver forces any change member present out of the driver chamber and down into the corresponding retainer cavity in the plug.

In order to program the lock for use with a new user key, the plurality of change members need to be moved back into their respective first positions with the pin chamber. With the lock in the programming position, the change members are moved or forced from their respective second positions in the retainer cavities, typically with a change tool. The change tool can be a separate change tool (that is, separate from the lock and keys) that is used and manipulated in combination with the programming key. The change tool can be an elongated member that can be manipulated within a similarly configured change slot that intersects the retainer cavities. The change tool can be configured for insertion into the length of the change slot, whereby the leading edge of the change tool can engage successively each retainer cavity to raise each change member out of its retainer cavity and into its corresponding driver chamber.

In an alternative embodiment, the change tool can be an integral component of the lock. The integral change tool, also referred to herein as the change tooling of the plug, can comprise an elongated member having at least one biasing portion, and a depressable end extending from an end of the plug. The change tooling is moveable within a change slot formed in the plug between a first position where the biasing portion is positioned outside of a retainer cavity, and a second position where the biasing portion engages, or has engaged or intersected, the retainer cavity to raise any change member out of the retainer cavity. Typically, the integral change tooling has a plurality of biasing portions, corresponding with the plurality of retainer cavities and the plurality of pin chambers.

After the plug is rotated back to the first position, the change tool can be allowed or caused to disengage or move out of intersection with the retainer cavity (for example, by removing the separate change tool, or by having the integral change tooling return to its first disengaged position). The programming key can be removed from the keyway, rendering the lock in a reset configuration where each of the change members is disposed in the pin chamber between the driver and tumbler. In the reset configuration, the lock can be programmed for use with any user key, by inserting the new user key into the keyway and rotating the plug in the opposite direction toward the programming position. This allows any change ball that has been raised above the shear line by the inserted new user key to be deposited into its second position in the corresponding retainer cavity, thereby configuring the lock for operation by the new user key.

When the new user key is inserted, the programming contour position and one or more of the other contour positions, raise one or more change members above the programming shear line. In the case where the change member is a spherical change ball, at least the centerpoint of the sphere must be raised above the shear line and into the driver chamber of the housing. Since, in the programming pin chamber, the change member is above the shear line and the tumbler does not span the shear line, the plug can be rotated back in the opposite direction to the programming position, where any change member in the driver chambers, including the programming change member, descends into the corresponding retainer cavities in the plug. This "reconfigures" the lock to operate with the new user key. The new user key can then rotate the plug to the first or key insertion position, or on to the second or operating position. Once returned to the key insertion position, with the programming change member in its retainer cavity, the lock again will only rotate with the operable user key in the one direction to the operating position.

The user keys of the set of keys can be selected whereby the lock is operable with only one user key for a given lock configuration, and where another user key can only be made operable by programming the lock configuration with the programming key. Typically, each user key differs from any other user key in the set of user keys in having a raised contour in a first contour position, a lowered contour in a second contour position, wherein the other user key has a lowered contour in the first contour position and a raised contour in the second contour position. It should be understood that these "first contour position" and "second contour position" do not refer to the first and second pin chambers, but refer to any two of the contour positions of the key.

The lock can also be configured for operation with a master key. The master key has a blade having a contour that raises the top ends of all tumblers, except in the programming pin chamber, to the shear line. In the programming pin chamber, the lower end of the driver is disposed adjacent to the ramp, as herein before described for a user key. The master key allows the lock to operate to the unlock position regardless of the user key configuration of the lock, but, like the user keys, it cannot be used to rotate the plug to the programming position. In the preferred embodiment, the lock can operate with a master key but does not contain or require any separate master pins.

The lock of the present invention is useful in a padlock, which typically operates or allows rotation of the plug in only one direction, to unlock or unlatch the shackle. The lock is also useful in certain deadbolt locks and knob locks having a push-button locking or latching button on the inside knob, where it is intended that the user can not close the latch with the key, but instead requires the user to manually close the latch.

A first embodiment of a programmable lock assembly of the present invention is shown in FIGS. 1 through 7. This embodiment shows a programmable lock assembly that can be programmed to operate with one of a plurality of user keys. This embodiment can also be operated with a master key, which can operate the lock regardless of the lock's configuration for a particular user key. The lock operates with a user key or a master key to rotate in only one direction from the initial key insertion position. The embodiment lock can be programmed only with the use of a programming key, which is configured to rotate the plug in the opposite direction, from the key insertion position to the programming position. The lock also requires a change tool to reconfigure or program the lock for a different user key.

Figure 2:
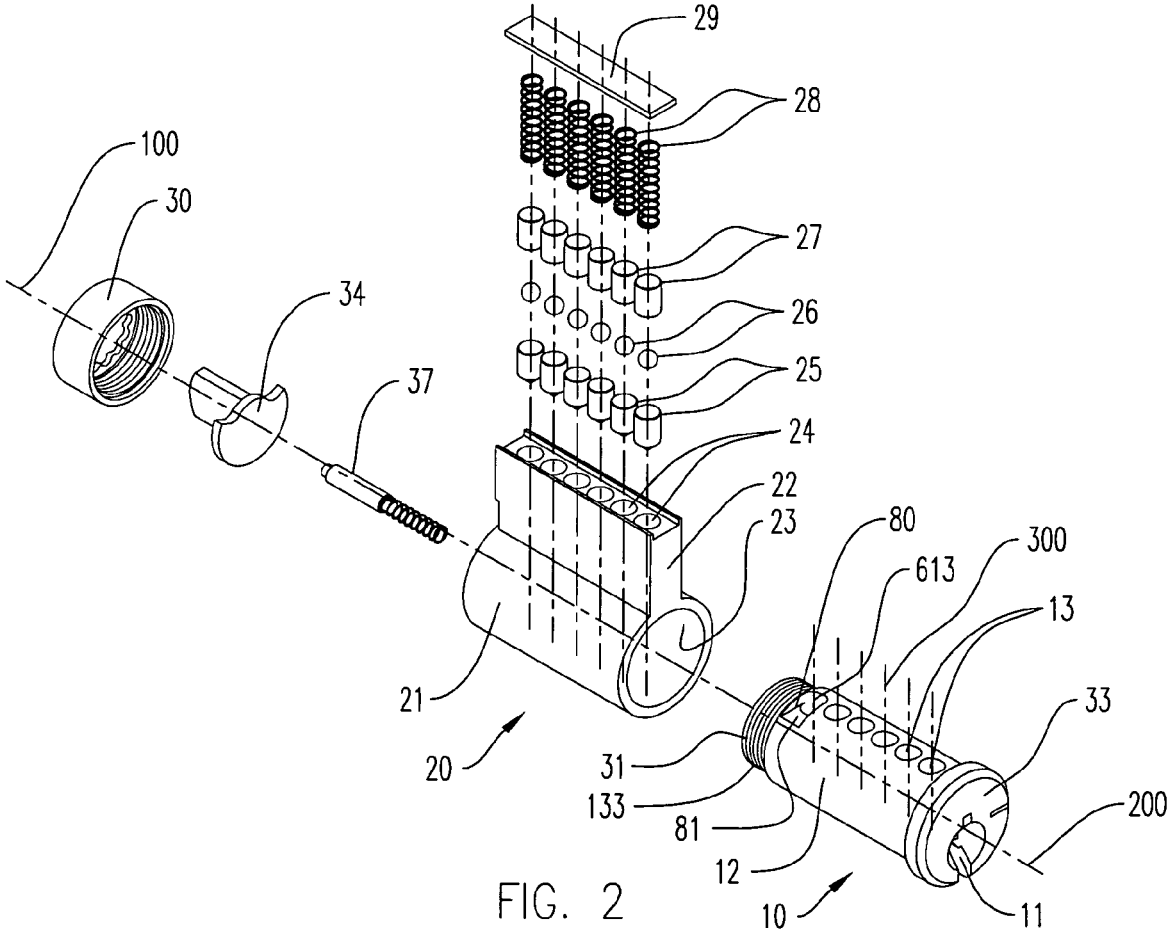
FIG. 2 shows an exploded perspective view of the components of the programmable lock of FIG. 1, including a housing and a plug.
Figure 3:
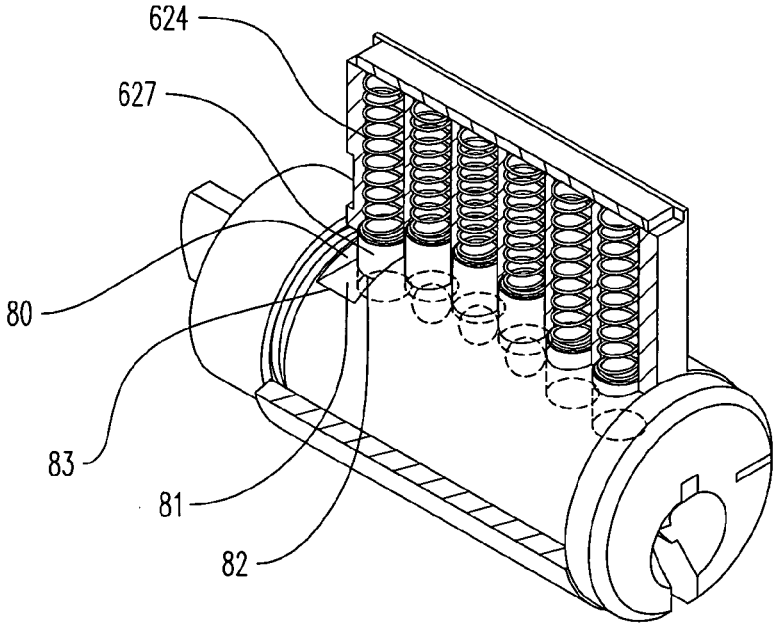
FIG. 3 shows a perspective view of the programmable lock with partial cut-away of the housing.

FIGS. 1 and 2 show the lock assembly that includes a housing 20 having a cylindrical barrel portion 21 and a stack portion 22. The barrel portion 21 has a cylindrical bore that runs through the length of the barrel portion 21 to form an inner surface 23. A plurality of driver chambers 24 are formed along the length of the stack portion 22, and intersect the inner surface 23. In the illustrated embodiment, each of the driver chambers 24 has substantially the same diameter, and are aligned transverse to the centerline 100 that passes through the longitudinal center of the barrel portion 21. In the illustrated embodiments, the plurality of driver chambers 24 corresponding to pin chambers 1 through 6 may be denoted herein after as driver chambers 124, 224, 324, 424, 524 and 624, respectively.

The plug 10 of the lock has a cylindrical periphery 12 that is formed or machined to allow the plug 10 to be mounted rotatably within the inner surface 23 of the housing, such that the centerline 200 of the plug is aligned along the centerline 100 for the housing barrel 21. A cylindrical shear surface is formed at the interface between the periphery 12 of the plug 10 and the inner surface 23 of the housing 20. A shear line or arc 19 forms a portion of the shear surface, at the intersection of the driver chambers 24 with the bore 23 (see FIGS. 6 and 9).

The lock 1 generally operates under the well-known principle that, provided none of the lock hardware (the lock drivers and tumblers, discussed hereinafter) span across the shear line or shear arc 19, then the plug 10 is free to rotate within the bore in either direction, and the lock operates to open a latch, a bolt or other means of securing a door or other device being secured closed by the lock. On the other hand, if a driver or a tumbler spans across the shear line 19, then the plug 10 is prevented from rotating within the bore in one or both directions, as shown herein after.

Figure 7:
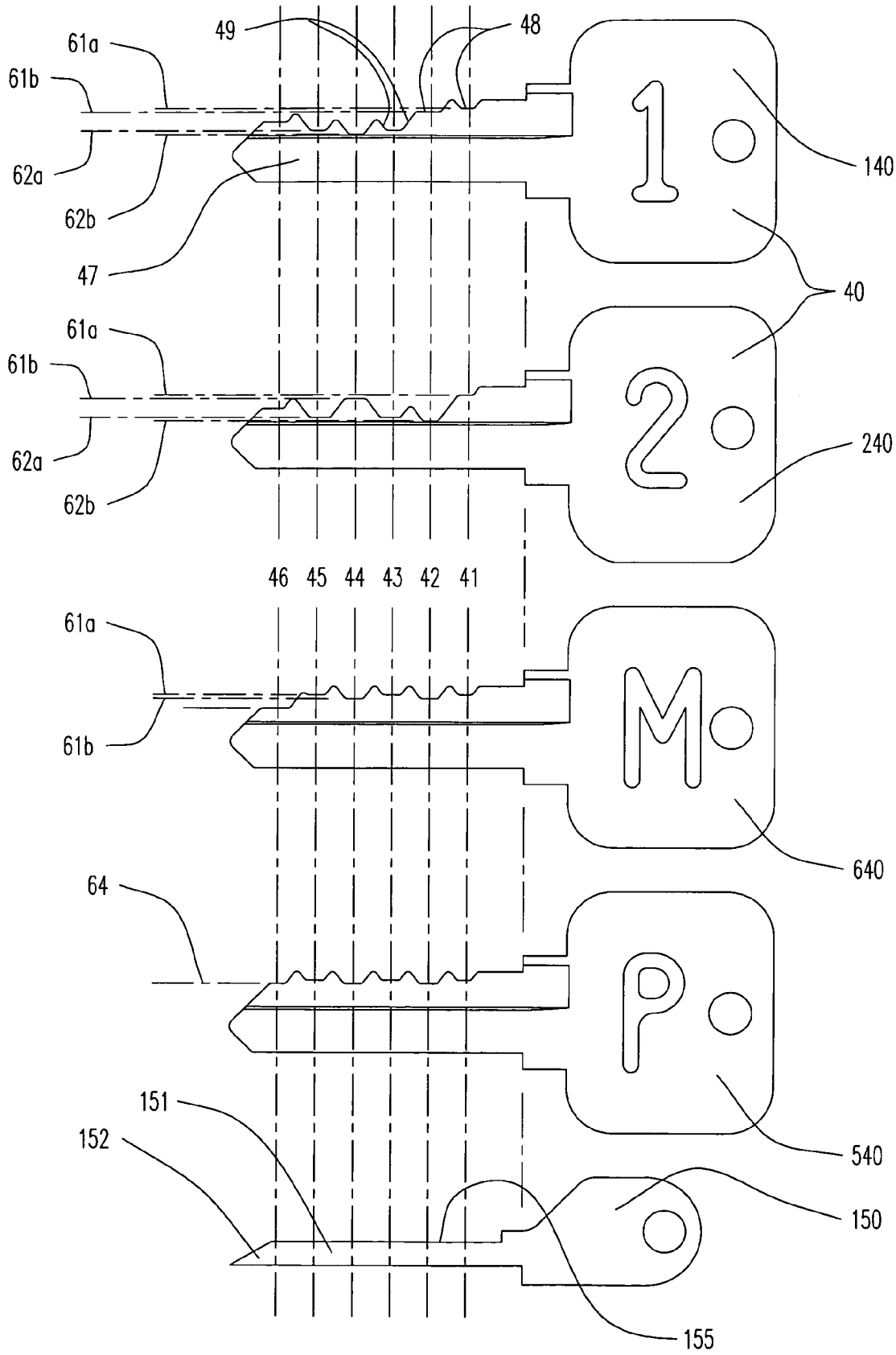
FIG. 7 shows a set of keys, including a pair of user keys, a master key, and a programming key, and a separate change tool, used with the programmable lock.

The plug 10 has a keyway 11 which has been bored or machined out of the plug 10 to provide a passageway for an associated key 40, such as one of the keys shown in FIG. 7. Typically, the keyway 11 extends longitudinally from the front face 33 of the plug toward the rear. The cross sectional shape of the keyway 11 typically remains constant along the longitudinal axis 100 of the plug 12, and is configured to receive a corresponding shaft portion 47 of a key 40 that has a complementary cross sectional shape along its longitudinal length, as is well-known and practiced conventionally in the lock industry.

The plug 10 comprises a plurality of tumbler chambers 13 that penetrate from the plug periphery 12 through the body of the plug 10 to intersect the keyway 11. The tumbler chambers 13 lie generally in a plane that extends through the keyway 11. As shown in the illustrated embodiment, the tumbler chambers 13 are generally of the same diameter, and are equally spaced and aligned along the longitudinal length of the plug 10. Each tumbler chamber 13 is formed or machined along a centerline 300 that intersects and is perpendicular to the centerline 200 of the plug. When the tumbler chambers 13 of the plug 10 are axially aligned with the driver chambers 24 of the stack portion 22, the plug 10 is in a first rotated position with respect to the housing 20. The plurality of tumbler chambers 13 corresponding to pin chambers 1 through 6 may be denoted herein after as driver chambers 113, 213, 313, 413, 513 and 613, respectively.

The latch or rear end 133 of the plug can be provided with a means of securement, such as machined threads 31, which can extend from the end of the housing 20, and can receive a correspondingly-threaded cap 30 to secure the plug 10 within the housing 20. A latch 34, configured as a lazy cam latch, can be retained by the cap 30 for engaging a recess or bolt (not shown) to unlock the object, such as a door, padlock, etc., in which the lock is installed. A spring-loaded stop pin 37 limits the rotation of the lazy cam latch 34.

The lock 1 also comprises a plurality of lock hardware elements, comprising a plurality of tumblers 25, drivers 27, driver springs 28, and change members 26. Typically, each pin chamber, formed from an aligned tumbler chamber 13 and driver chamber 24 when the plug 10 is in its first or key insertion position, comprises, in sequence, one tumbler 25, one change member 26, one driver 27 and one driver spring 28. The tumblers 25 are generally pencil-shaped, consisting of a cylindrical body with a tapered or conical end. Each tumbler 25 is moveable axially along and within the tumbler chamber 13, and positioned with the tapered end extending into the keyway 11 when no key is inserted. The plurality of tumblers 25 corresponding to pin chambers 1 through 6 may be denoted herein after as tumblers 125, 225, 325, 425, 525, and 625, respectively.

Each driver 27 is positioned within driver chamber 24 of the stack portion 22 of the housing, and is moveable axially along and within the driver chamber 24. The driver 27 typically has a cylindrical body. A driver spring 28 biases the driver 27 toward the inner surface 23 of the housing 20. The plurality of drivers 27 corresponding to pin chambers 1 through 6 may be noted herein after as drivers 127, 227, 327, 427, 527, and 627, respectively. The driver spring 28 is typically made of a tempered stainless steel to prevent material deformation upon multiple cycles of compression and extension. Preferably, the spring material is a non-metallic stainless steel wire of about size 008, and is available as part number C108x008x520 from W.B. Jones Spring Co., Inc., of Wilder, Ky. A planar lid 29 can be secured in position to the top of the stack portion 22 to retain the hardware elements after these have been loaded into the pin chambers.

The change member 26 is illustrated as a spherical ball. The spherical shape of the change member 26 allows rolling movement within the driver chambers 24, tumbler chambers 13, and other passageways in the lock, and projects the same cross-sectional shape (circular) regardless of its orientation. The spherical shape of the change member 26 eliminates corners or edges that can obstruct its free movement. A barrel- or cylindrical-shaped change member can be used in a lock of the present invention, although it may have a tendency to tilt or tumble within a chamber, which can increase the potential of becoming lodged within the chamber and jamming the lock. For the purpose of describing succeeding embodiments of the present invention, the change member will hereinafter be referred to as the change ball 26.

Figure 6:
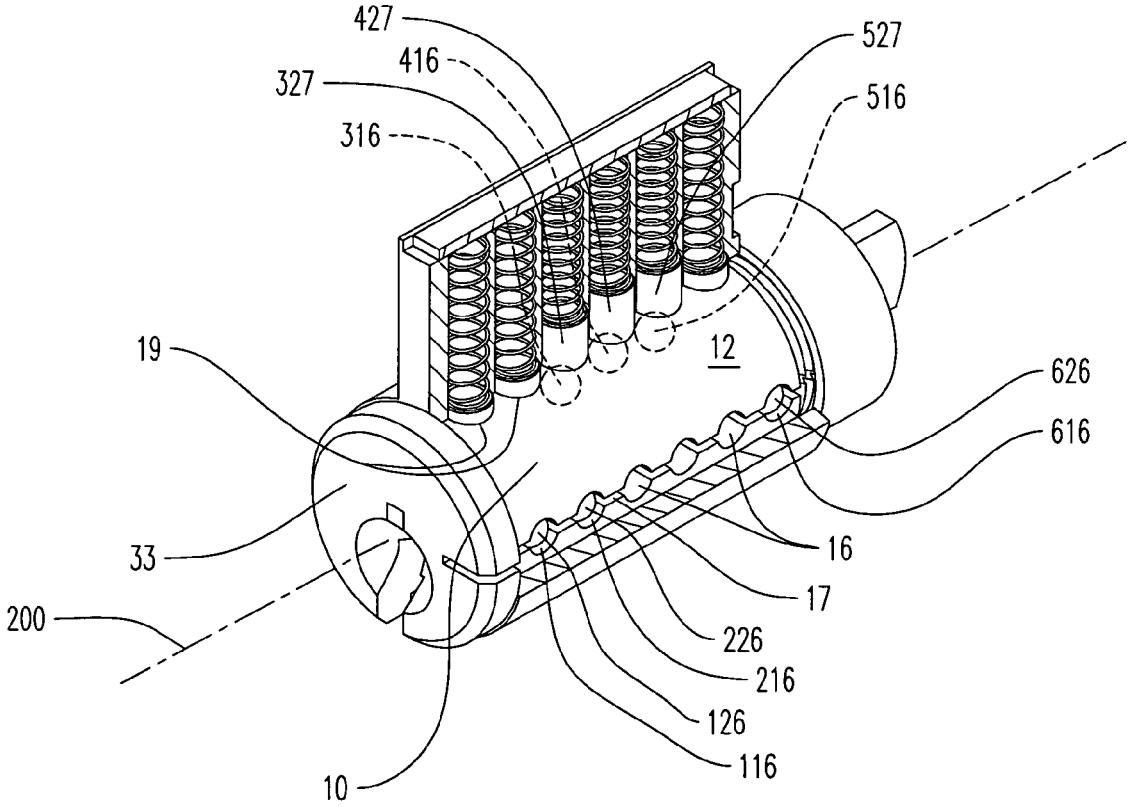
FIG. 6 shows an opposite perspective view of the programmable lock with partial cut-away of the housing.

As shown in FIG. 6, the plug 10 has a plurality of retainer cavities 16 machined into the body of the plug 10 through the plug periphery 12. The retainer cavities 16 are of substantially the same circular cross section, and are shown aligned along and disposed perpendicularly to the longitudinal axis 200 of the plug. The plurality of retainer cavities 16 are equally spaced, whereby each retainer cavity 16 is axially aligned and circumferentially displaced from the tumbler chambers 13, the top edges of which intersect with the shear surface along shear lines 19. Typically the diameter or minimum opening of the retainer cavity is larger than, and typically just slightly larger than, the diameter of the change ball 26. The depth of the bore or cavity of the retainer cavity 16 from the periphery 12, is at least as deep as, and typically deeper than, the diameter of the change ball 26. In a typical embodiment, the retainer cavities comprise a means for preventing entry of the driver therein. In a typical embodiment, the retainer cavities have an opening that is sizes smaller than the drivers, to prevent a driver from dropping into an open retainer cavity when the plug is rotated to the programming position.

Figure 18:
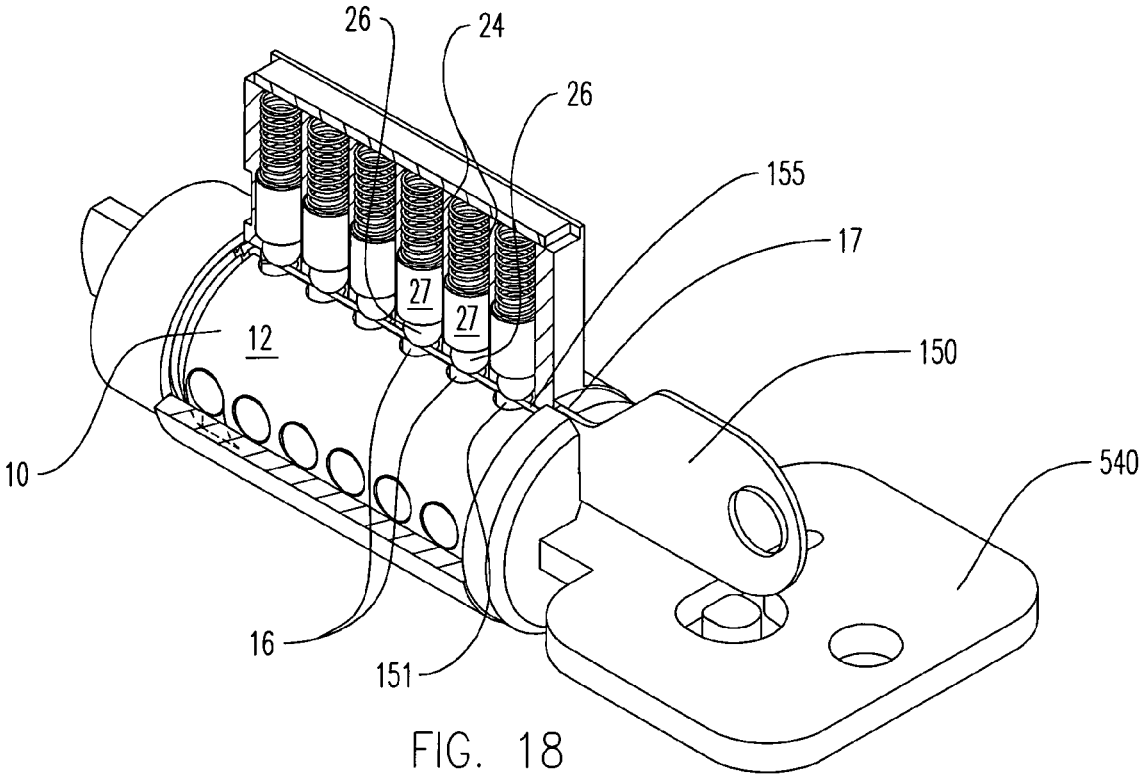
FIG. 18 shows the lock and programming key shown in FIG. 13, with a separate change tool inserted to remove the change members from their respective retainer cavities.

Also shown in FIG. 6 is a change slot 17 that is machined into the periphery 12 of the plug 10, parallel to the axial centerline 200. The change slot 17 extends from the front face 33 and generally proximate to the plurality of retainer cavities 16. In the illustrated embodiment, the change slot 17 is formed through the centers of the aligned retainer cavities 16. Typically, the change slot 17 has a radial depth that is at least the same as the depth of the retainer cavities 16. The change slot 17 is configured to accommodate a blade 151 of a separate change tool 150 shown in FIG. 7. The height of the blade 151 is configured so that the top 155 of the blade aligns with the periphery 12 of the plug when the blade 151 is inserted into the slot 17, as shown in FIG. 18. The configuration of the change slot allows the inserted change tool 151 to raise a change ball contained within the retainer cavity at its center of weight and to its maximum height. The change slot 17 is typically configured with a minimum width that accommodates the width of the blade 151, while maintaining effective lifting of the change balls 26. The width of the change slot 17 is typically about 0.020 inches (about 0.50 mm) or less.

Referring to FIGS. 4, 5, 6 and 18, the change ball 26 is typically positioned within the lock 1 in either a first position, disposed within a pin chamber between a driver 27 and a tumbler 25 as shown for pin chambers 3, 4, and 5, or in a second position within a retainer cavity 16 as shown for pin chambers 1, 2 and 6. During operation of the lock and in response to the programming of the lock, the change ball 26 can be moved from its first position in the pin chamber to its second position in a corresponding retainer cavity 16. In the illustrated embodiment, each pin chamber (that is pin chambers 1, 2, 3, 4, 5, and 6) has one change ball 26 associated therewith. In alternative embodiments of the invention, one or more of the pin chambers can be configured without a change ball 26. When positioned within the pin chamber 18, the change ball 26 can reside in either the tumbler chamber 13 or in the driver chamber 24. Transfer of the change ball from its first position in the pin chamber 18 to its second position in the retainer cavity 16 typically involves movement of the change ball 26 from the tumbler chamber 13 into the driver chamber 24 when the plug 10 is in the key insertion position, and then from the driver chamber 24 into the retainer cavity 16, when the plug 10 has been rotated to its second or operating position.

Conversely, when the plug 10 is in its second rotated position, a change ball 26 can be moved from its second position within the retainer cavity 16 back into a driver chamber 24 when biased therefrom by manipulation of the separate change tool 150, by insertion thereof into the change slot 17 (as shown in FIG. 18).

The lock 1 is associated with a set of keys 40, a subset portion of which is illustrated in FIG. 7. The subset of keys 40 can include a first user key 140, a second user key 240, a master key 640, and a programming key 540. Each of the keys has a shaft portion 47 having a contour edge that comprises a plurality of contour landings 48 that define a plurality of contour positions. In the illustrated embodiment, the contour edge has one contour position corresponding to each of the pin chambers of the lock 1. Each contour landing 48 is generally flat and parallel with the axis of the key shaft 47. When any of the keys 40 are inserted fully into the keyway 11 of the plug 10, the contour positions 1 through 6, identified as contour positions 41, 42, 43, 44, 45, and 46, respectively, align with the pin chambers 1 through 6, respectively. The shaft 47 of a key 40 can be formed or machined to a specific depth at each contour position. The length of each contour landing 48 should be sufficiently long to prevent a tumbler 25 from beginning to descend or ascend prematurely off the end of the contour landing 48 when inserting or withdrawing the key 40 from the keyway 11. At the same time, the sloped transition portions 49 between adjacent contour landings 48 should be sufficiently shallow in slope to allow the plurality of positioned tumblers 25 to easily run up and down the length of the contour of a key 40 as the key is being inserted into or withdrawn from the keyway 11.

In the illustrated embodiment, the six contour positions 41, 42, 43, 44, 45, and 46 may be denoted herein after as 141, 142, 143, 144, 145, and 146, respectively, for the first user key 140; as 241, 242, 243, 244, 245, and 246, respectively, for the second user key 240; and likewise for the master key 640 and programming key 540.

Figure 8:
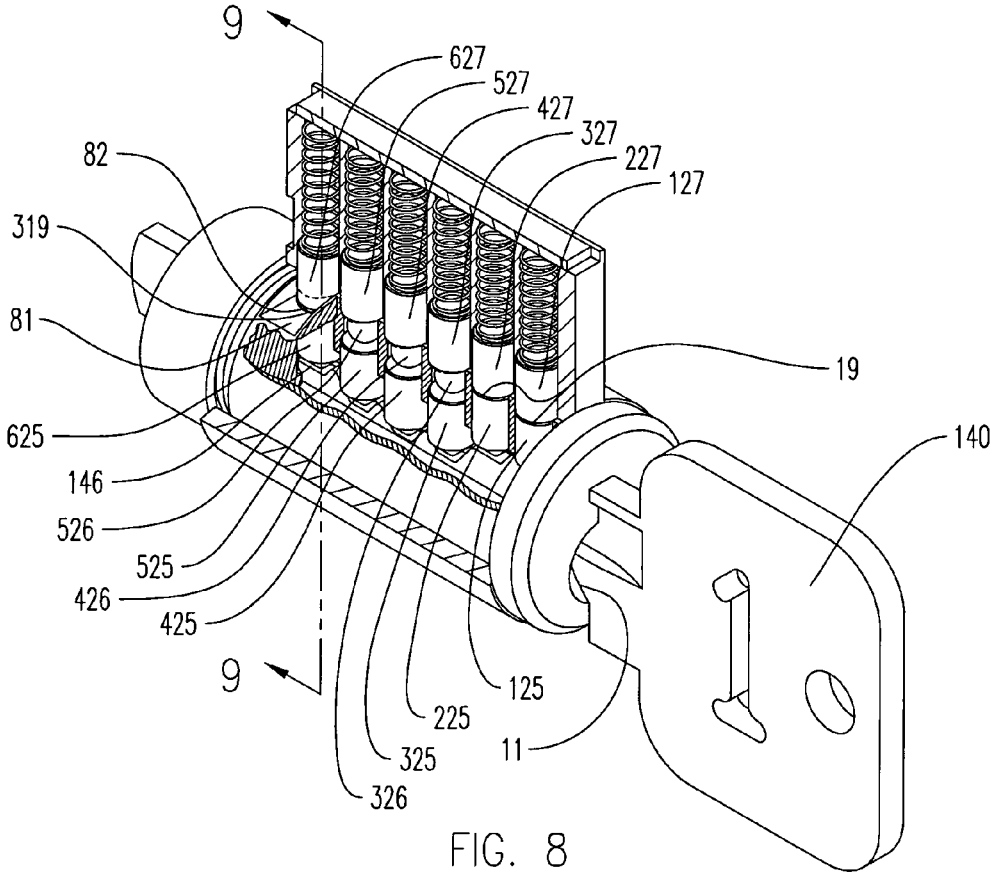
FIG. 8 shows a partially cut-away, perspective view of the programmable lock with the first user key inserted.
Figure 12:
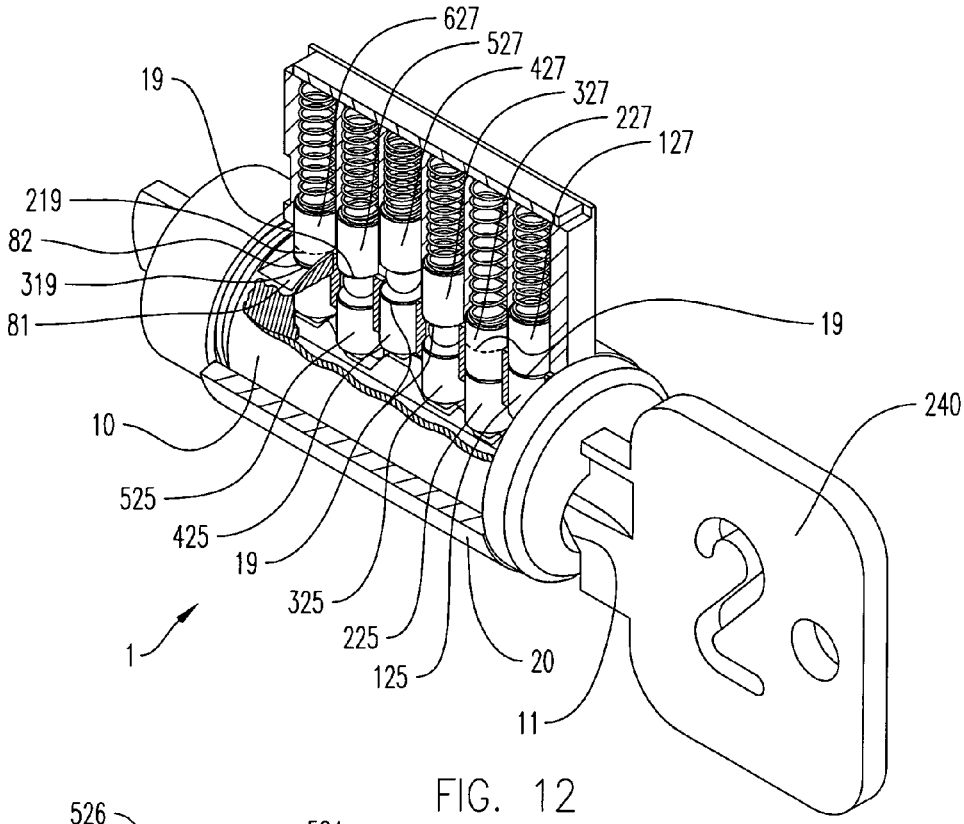
FIG. 12 shows a partially cut-away, perspective view of the programmable lock of FIG. 4, with a second user key inserted.
Figure 22:
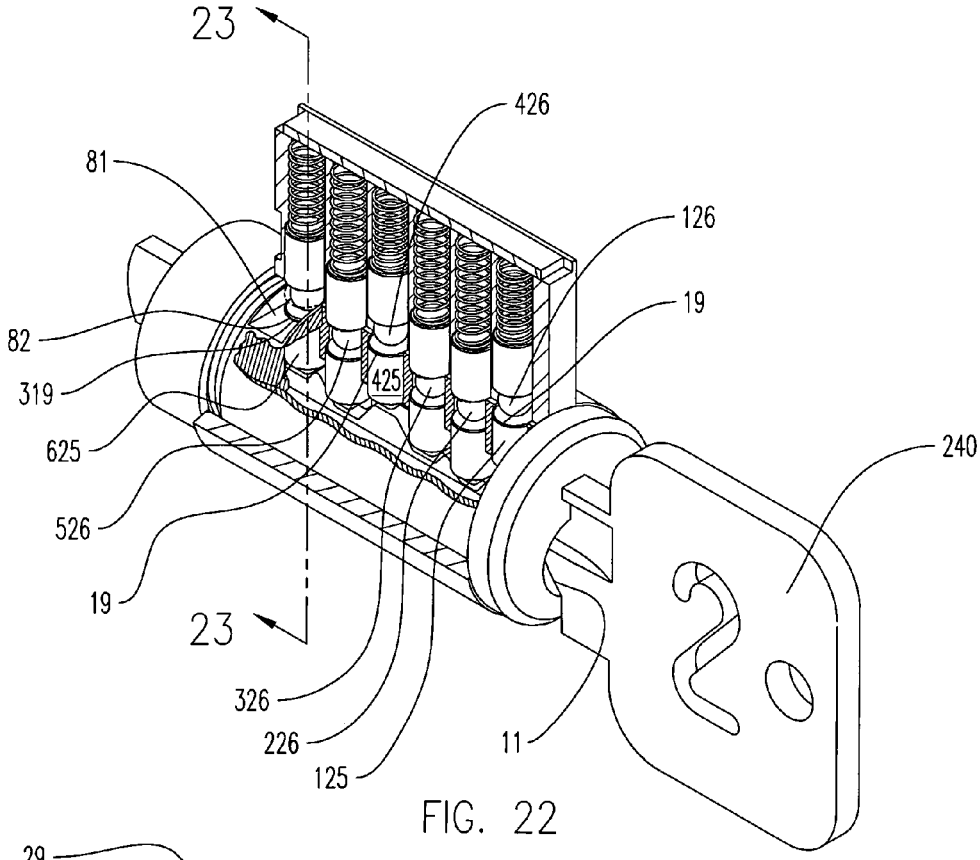
FIG. 22 shows the lock in reset configuration, with a second user key inserted.

As is well known in the lock industry, the depth of a contour cut is typically made in relation with the height of the tumbler in the corresponding pin chamber. In the present invention, as illustrated in FIGS. 8, 12, and 22, the depth of the cut (or said differently, the height) of the contour is also made in relation to the diameter or height of the change ball 26 associated therewith. That is, if a particular key is intended to raise a change ball 26 above the shear line 19 of the lock, then that key's corresponding contour position should be cut to a shallow depth (a raised contour) accordingly, which can raise the change ball 26 above the shear line 19. In the illustrated embodiment, each user key 140 and 240 has a contour edge that can comprise one or more raised contours 61*a* and 61*b*, one or more lowered contours 62*a* and 62*b*, or a combination of raised and lowered contours. In the present invention, the height of a particular contour position for a user key, for example user key #1 (140) or user key #2 (240), will indicate the key's ability to raise a change ball 26 above the shear line 19 within that particular pin chamber. For example, the second contour position 142 of first user key 140 has a generally shallow cut (a raised contour position 61*b*), and the second contour position 242 of the second user key 240 has a generally deep cut (a lower contour position 62*b*). The shallow cut (raised contour 61*b*) of the second contour position 142 of user key 140 will allow key 140 to raise any change ball 226 in the second pin chamber 213 above the shear line 19 and into second driver chamber 224. Conversely, the generally deep cut (lower contour 62*b*) of the second contour position 42 on the second user key 240 will be insufficient to raise the change ball 226 out of the second tumbler chamber 213. Also, the generally deep cut in the fourth contour position 44 (lowered contour 62*b*) of the first user key 140 does not allow that key to raise a change ball 426 out of the fourth tumbler chamber 413, whereas the generally shallow cut in the fourth contour position 44 (raised contour 61*b*) of second user key 240 is sufficient to raise the change ball 426 above the shear line 19 and into fourth driver chamber 424. These principles will be further illustrated in a description of the operation of the key herein after.

In the description above, it should be understood that a key configuration that raises the change ball 26 above the shear line 19 is also raising the top end of the tumbler 25 to proximate the shear line. This ensures that the change ball is displaced into the driver chamber 24, and that no hardware member in the pin chamber spans the shear line at the key insertion position of the plug, so that the plug can rotate within the housing to the operating position.

Figure 5:
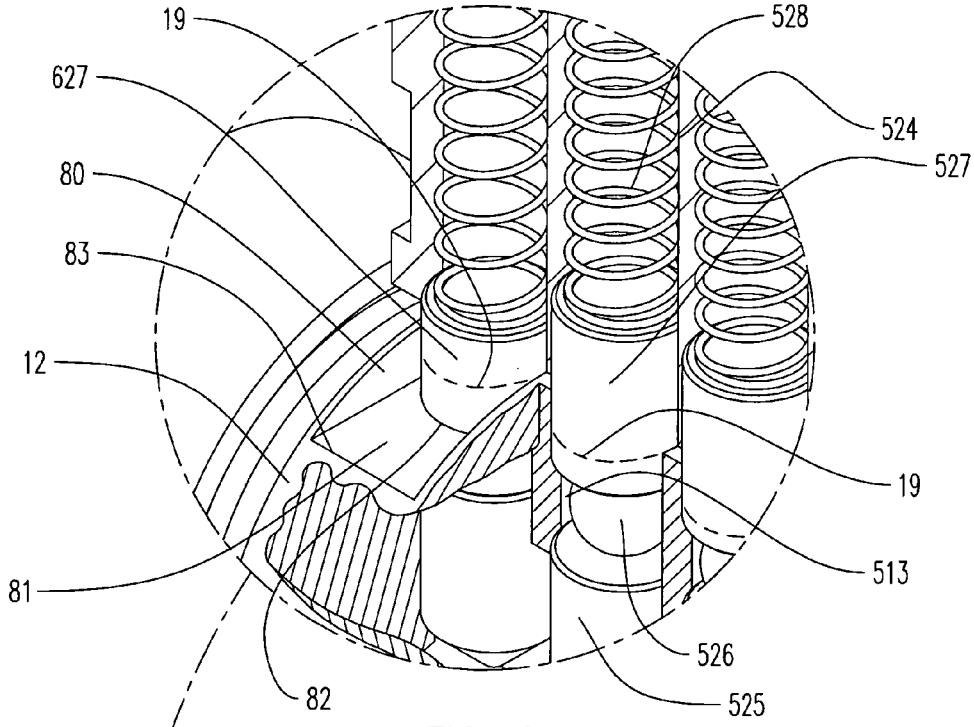
FIG. 5 shows an enlarged view of a portion of the cut-away of the housing and the plug of FIG. 4.
Figure 4:
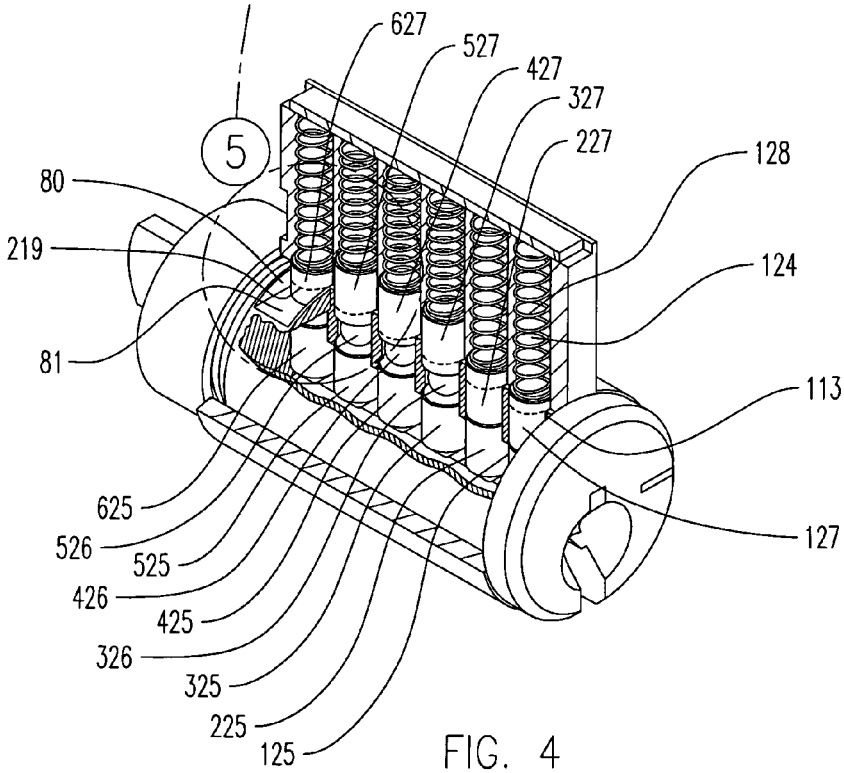
FIG. 4 shows a perspective view of the programmable lock with partial cut-away of the housing and the plug, when the lock is configured for operation with a first user key.
Figure 10:
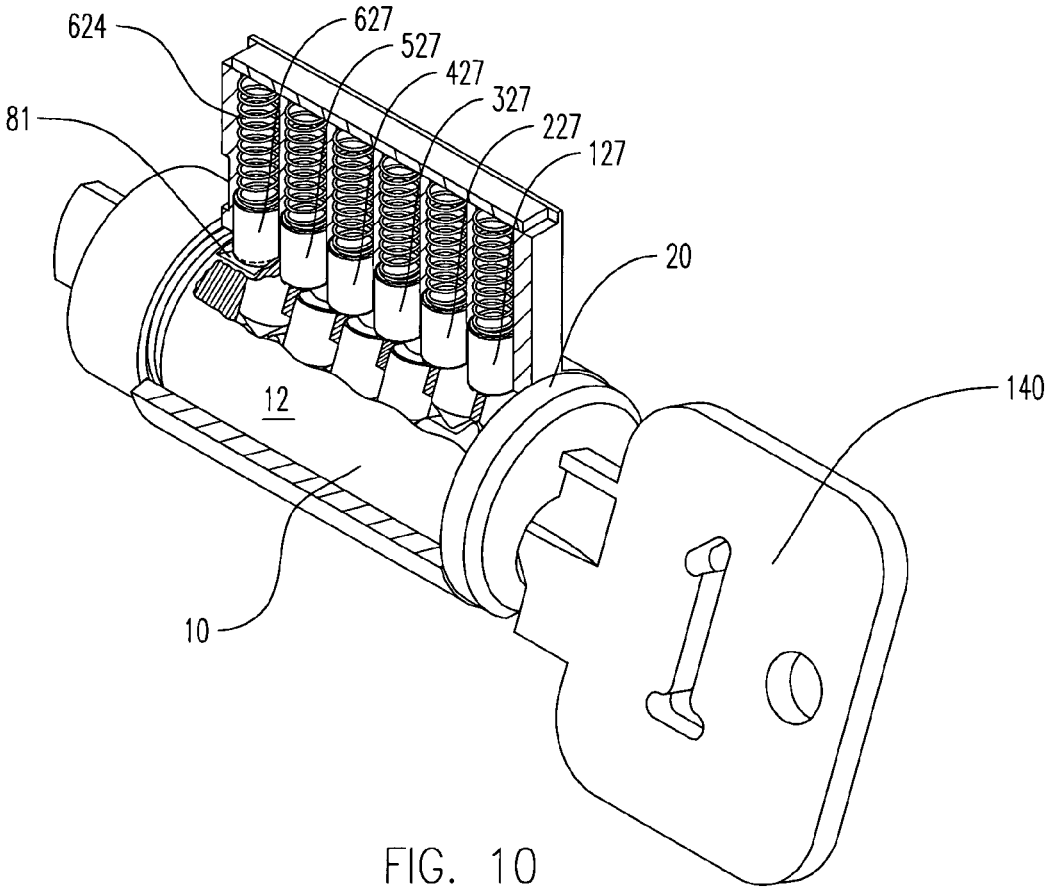
FIG. 10 shows the lock and key shown in FIG. 8, partially rotated to an unlock or operating position.
Figure 11:
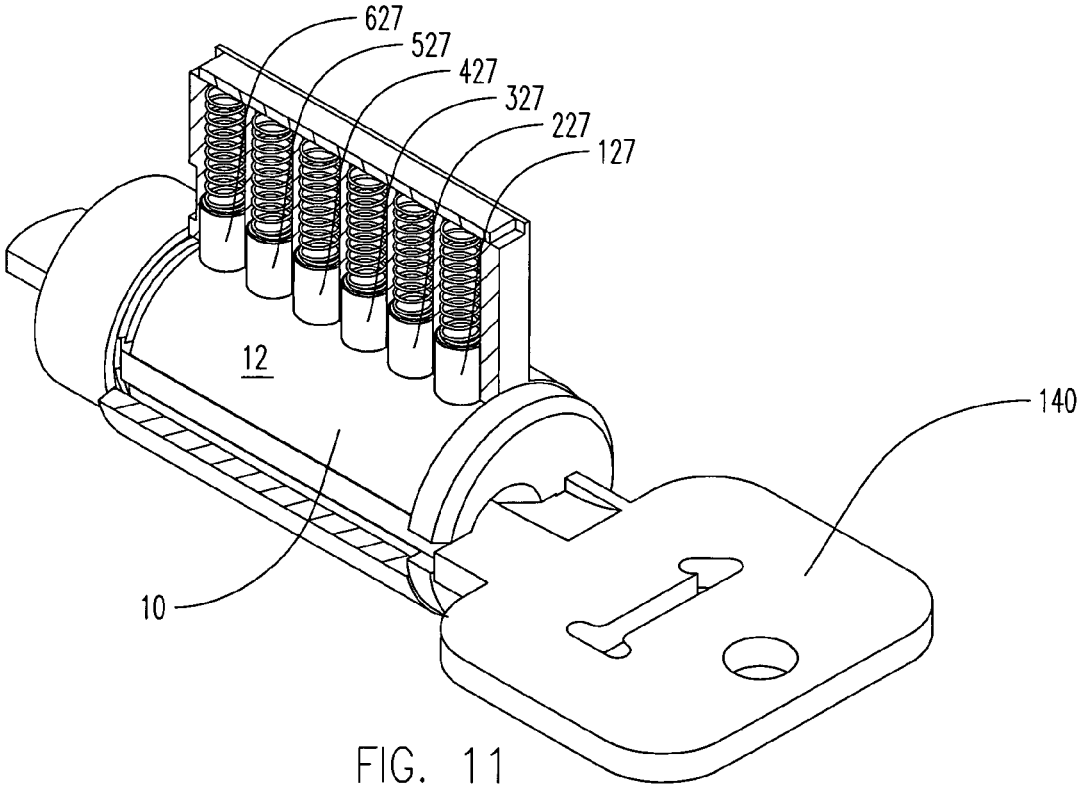
FIG. 11 shows the lock and key shown in FIG. 8, rotated to the unlock position.

The plug 10 of the present invention also has a groove 80 formed in the periphery 12 of the plug adjacent to one of the tumbler chambers 13. As shown in FIGS. 4 and 5, the groove 80 is formed adjacent to the tumbler chamber 613 in the sixth pin chamber, wherein the sixth tumbler chamber 613 serves as a programming tumbler chamber. The groove can be formed alternately adjacent to any one of the other pin chambers, which would then serve as the programming tumbler chamber. The groove 80 has a width slightly wider than the diameter or width of the driver 627, and is machined to have a tapered ramp 81 that extends from a descending point 83 on the periphery 12 distant from the tumbler chamber 613, to an edge 82 that intersects tumbler chamber 613. The edge 82 serves as an operating shear line 319. The operating shear line substitutes for the main shear line 19 of the plug to control rotation of the plug to the operating position. When the bottom edge of the driver 627 is disposed adjacent the operating shear line 319, the driver 627 can ride along the ramp 81 and rise up into the driver chamber 624 when the plug rotates to the second or operating position. Both user keys (140 and 240) have a low contour (a deep cut) at the sixth contour position 46. Generally, the depth of the edge 82 of the tapered ramp 81 is configured whereby when a user key 140 or 240 is positioned fully within the keyway 11, both the tumbler 625 and driver 627 are raised to a height where the lower edge of the driver 627 is proximate to the edge 82 of the groove ramp 81, but below the shear line 19, which is shown as a dashed line 219 around the circumference of the driver 627. With the user key 140 or 240 fully inserted into the keyway 11 (as shown in FIGS. 8 and 12, respectively), the plug 10 can be rotated in the clockwise direction, from the key insertion position to the operating position. As illustrated in FIGS. 10 and 11, the rotation of the plug clockwise in the first direction passes the edge 82 of the ramp 81 under the lower end of the driver 627, and causes the driver 627 to ride up the ramp 81 and beyond the descending point 83, and to rise upward into the driver chamber 624, as the plug 10 continues its rotation.

Figure 9:
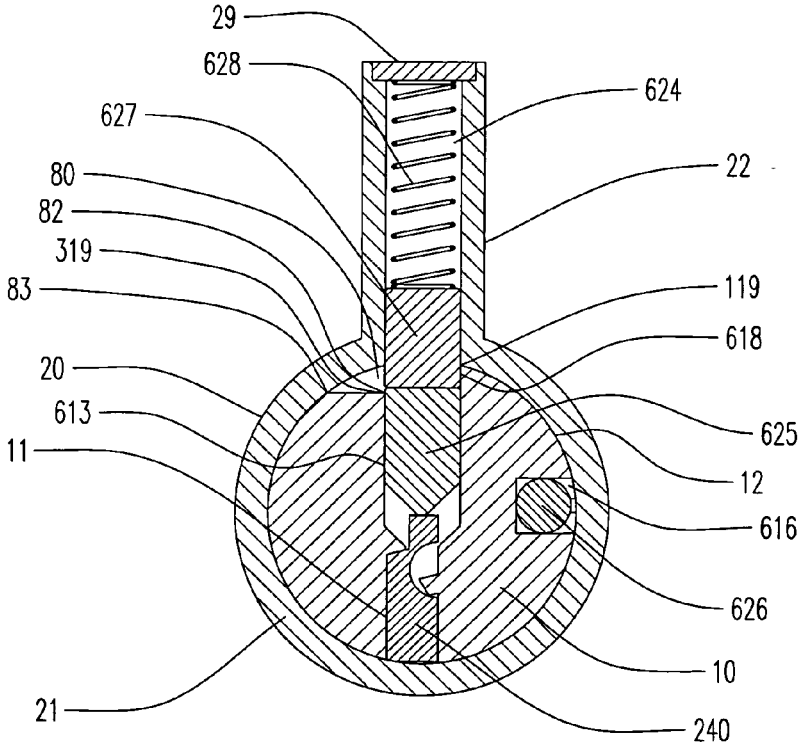
FIG. 9 is a sectional view of the lock with the first user key inserted into the keyway in the key insertion position, taken through line 9-9 of FIG. 8.

In can be understood from FIG. 9 that the body of driver 627 spans shear surface 19 and confronts a programming shear line 119 formed at the intersection of the tumbler chamber 613 and the plug periphery 12 on the side opposite the groove 80. The position of the programming shear line 119 along the height of the tumbler 627 in FIG. 5 is shown by phantom line 219. As can be seen in FIGS. 5 and 9, the plug 10 cannot be rotated in the opposite or counterclockwise direction, to a programming position because the programming shear line 119 is spanned by the programming driver 627 on the side opposite the groove 80. The programming shear line 119 serves as a means for preventing rotation of the plug to the programming position, while the groove 80 and its ramp 81 serves as a means for enabling rotation of the plug to the operating position.

As shown in FIG. 7, a programming key 540 has a high contour (a shallow cut), called a programming contour or cut 64, at its sixth contour position 46. With the programming key 540 fully inserted into the keyway (shown in FIG. 15), the lower edge of the driver 627 is raised to the programming shear line 119 (which is illustrated by the phantom line 219 on the groove side of the driver 627), wherein the plug 10 can be rotated in the opposite direction toward the programming position, shown in FIG. 16. In the programming position, the plurality of change balls 26 can be moved between the retainer cavities 16 and the driver chambers 24, as later described.

The operation of the lock of the present embodiment will now be illustrated. FIGS. 4 and 6 show the lock 1 of the present invention in a configuration wherein the lock is operable with a first user key 140. In this configuration, change balls 326, 426 and 526, corresponding to the third, fourth, and fifth pin chambers, are positioned within their respective pin chambers between corresponding tumblers 325, 425 and 525, and drivers 327, 427 and 527. As shown in FIG. 6, the change balls 126, 226 and 626, corresponding to the first, second and sixth pin chambers are positioned within their respective second positions in the retainer cavities 116, 216 and 616.

As shown in FIG. 8 when a first user key 140 is inserted into the keyway 11, the contour positions 1 through 6 of the key raise corresponding tumblers 25 within the pin chambers. In both pin chambers 1 and 2, the corresponding tumblers 125 and 225 lift the bottom end of the corresponding drivers 127 and 227 directly to the shear line 19. In pin chambers 3, 4, and 5, the corresponding tumblers 325, 425 and 525 raise both the corresponding change balls 326, 426 and 526 and the corresponding drivers 327, 427 and 527, whereby the lower or bottom edge of each of the drivers 327, 427 and 527 is aligned with the shear line 19. It can be seen that the bottom edge of the driver and the top edge of the tumbler can be made slightly beveled to assist aligning and registering the driver or tumbler with the shear line. In programming pin chamber 6, the contour position 146 of the user key 140 raises the corresponding tumbler 625, which lifts the corresponding driver 627 to a height where the lower end of the driver 627 is adjacent to the edge 82 of the ramp 81. Thus, the lower end of each of the drivers 27 in pin chambers 1 through 5 has been raised to the shear line 19, and the lower end of driver 627 in programming pin chamber 6 has been raised to the edge 82 of the ramp 81. As the user key 140 is rotated clockwise (when facing the lock from the key side), the plug 10 can rotate within the bore of the housing 20 from its key insertion shown in FIG. 8, through the position shown in FIG. 10, and toward an operating position shown in FIG. 11. The operating position is typically the unlock position. As shown in FIG. 10, each of the drivers 127, 227, 327, 427 and 527 in pin chambers 1 through 5 will ride along the outer periphery 12 of the plug 10 as the plug is rotated toward the operating position. As rotation of the plug continues, the driver 627 in the sixth position has moved completely up ramp 81 and completely into the sixth driver chamber 624, and then continues to move along the periphery 12 of the plug 10 along with the other drivers 127, 227, 327, 427, and 527 in chambers 1 through 5. Rotation of the plug 10 to the operating position shown in FIG. 11 rotates the latch 34 associated with the lock 1 to the open or unlatched position.

The first user key 140 can then be turned counterclockwise to rotate the plug 10 back to its first position, and can then be withdrawn from the keyway 11. As shown in FIG. 12, when a second user key 240 is inserted into a keyway 11, while the lock is configured for operation with the first user key, the lock 1 will not open, since at least one of the drivers or tumblers within the plurality of pin chambers, namely driver 227, spans the shear line 19 with the second user key 240 inserted. On the other hand, in each of the pin chambers 3, 4 and 5, either the lower end of the drivers 327, 427 and 527 and/or the upper end of tumblers 325, 425 or 525 is positioned at the shear line 19, and therefore none of the bodies of these drivers or tumblers span the shear line 19. Likewise, the driver 627 in the sixth pin chamber has been raised such that its lower end is at the edge 82 of the ramp 81. The raised contour 61*a* of the first contour position 241 of the second user key 240 has raised the interface between the tumbler 125 and driver 127 to the shear line 19. However, since the second contour position 242 of the second user key 240 is a lowered contour 62*b* (see FIG. 7), and the corresponding change ball 226 is deposited in the second retainer cavity 216 (see FIG. 6), driver 227 will span the shear line 19. Consequently, at least one of the drivers or tumblers, specifically driver 227, spans the shear line 19. The second user key 240 when inserted cannot raise the lower end of the second driver 227 to the shear line 19 when the lock is configured for operation with the first user key 140, and thus can not cause the plug 10 to rotate within the housing 20 when the lock is configured for operation with the first user key 140, and cannot operate the lock.

Figure 13:
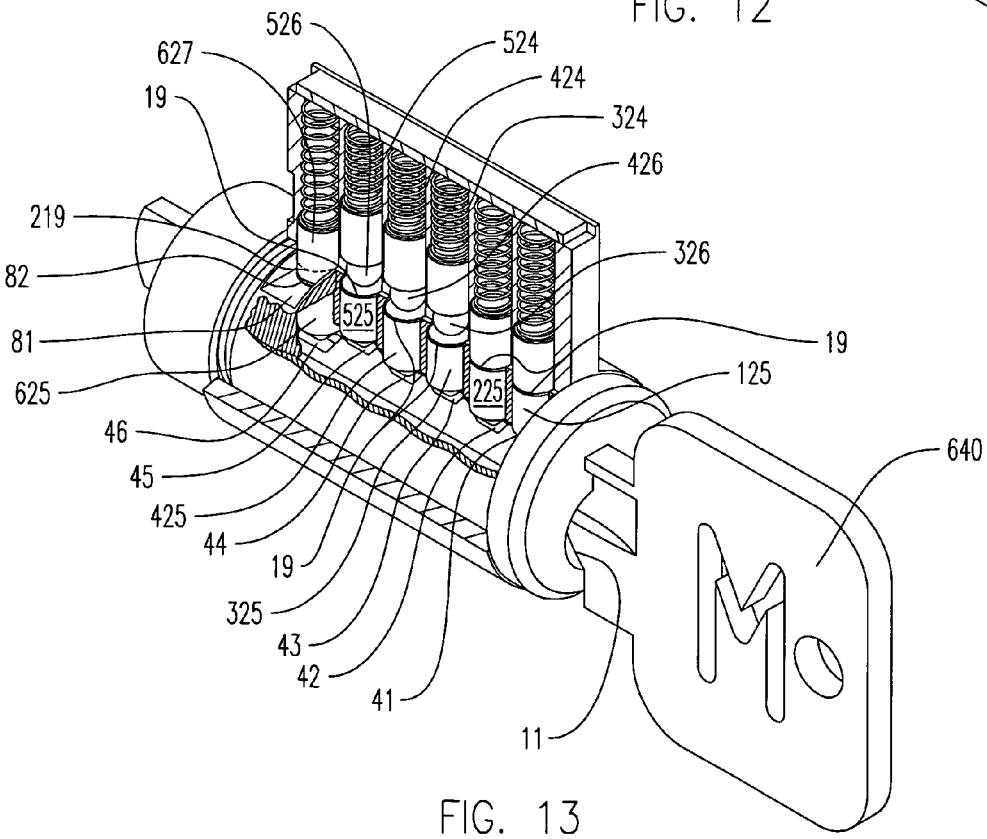
FIG. 13 shows a partially cut-away, perspective view of the programmable lock of FIG. 4, with a master key inserted.

When the lock is configured for operation with either one of the user keys 140 or 240, a master key 640 can be used to operate the lock. However, in the illustrated embodiment, the master key 640 cannot be used to program the lock configuration. In FIG. 7, the master key 640 is configured with contour positions 41 through 45 each having either of the raised contours 61*a* or 61*b*. When the master key 640 is fully inserted into the keyway 11 of the lock that is programmed for any user key, including the first user key 140 or the second user key 240, the contour positions of the master key 640 will raise the corresponding drivers 27 and tumblers 25 whereby none of the drivers and tumblers in the first through fifth pin chambers span the shear line 19. This allows the user of the master key 640 to operate the lock regardless of the lock's programming status to any particular user key. As shown in FIG. 13, the contour positions 41 through 45 of the master key 640 raise the top of each of the tumblers 125, 225, 325, 425 and 525 in pin positions 1 through 5 to the shear line 19. The contour position 46 raises the top of the sixth tumbler 627 in the sixth pin chamber to the operating shear line 319 at the edge 82 of the ramp 81.

Figure 14:
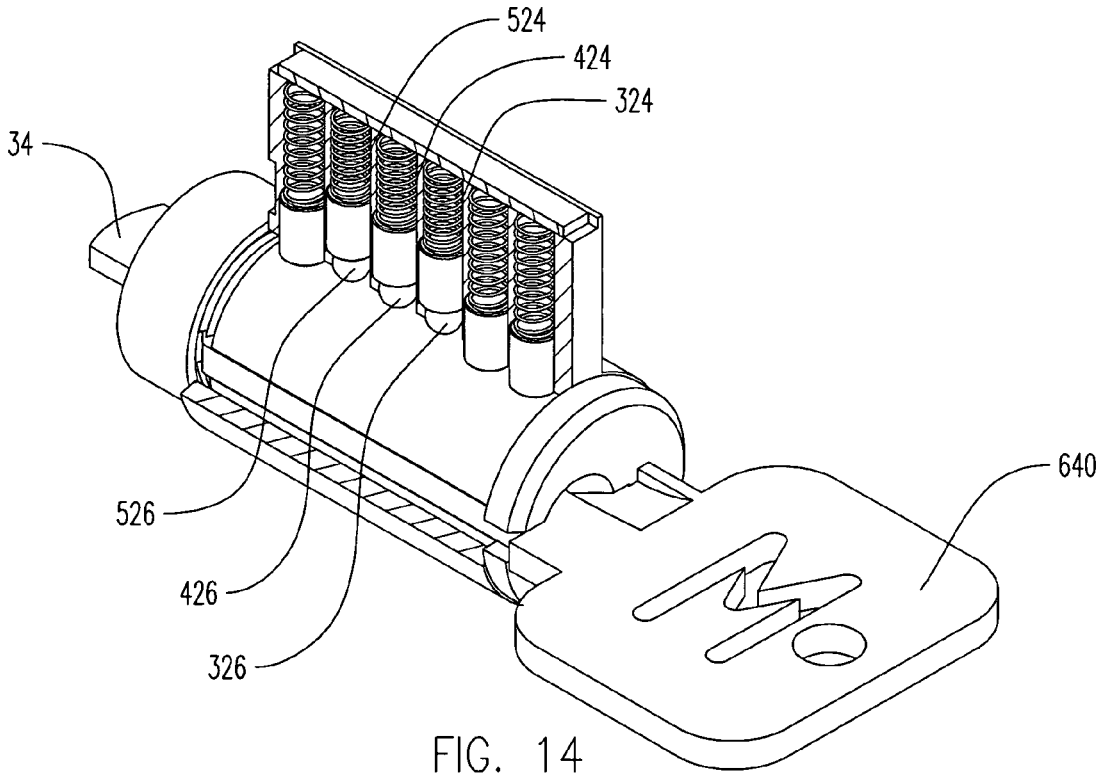
FIG. 14 shows the lock and key shown in FIG. 13, rotated to the unlock position.

As described herein before, the positioning of the driver 627 with its lower end positioned at the operating shear line 319 along the edge 82 of the ramp 81, but with its body spanning the programming shear line 119 on the side opposite the groove 80, allows rotation of the plug to the operating position, but prevents rotation to the programming position. With the master key 640 inserted, all change balls 26 are disposed either in its upper driver chamber 24 (change balls 326, 426 and 526) or in the retainer cavity 16 (change balls 126, 226 and 626, not shown). None of the drivers 27, tumblers 25, or change balls 26 in the driver chambers 1 through 5 span across the shear line 19, and the master key 640 operates the latch 34, as shown in FIG. 14. Operation of the lock with the master key 640 does not change the position of any of the change balls 26 in the lock. The change balls 326, 426 and 526 in their first position in pin chambers 3, 4 and 5, have remained in their respective driver chambers 324, 424 and 524. The change balls 126, 226 and 626 in their second position in their corresponding retainer cavities 116, 216 and 616 (shown in FIG. 11) have remained in their retainer cavities 116, 216 and 616. This allows the user of the master key 640 to open and close the lock regardless of its user key configuration, but does not allow programming of the lock to a different user key configuration.

Figure 15:
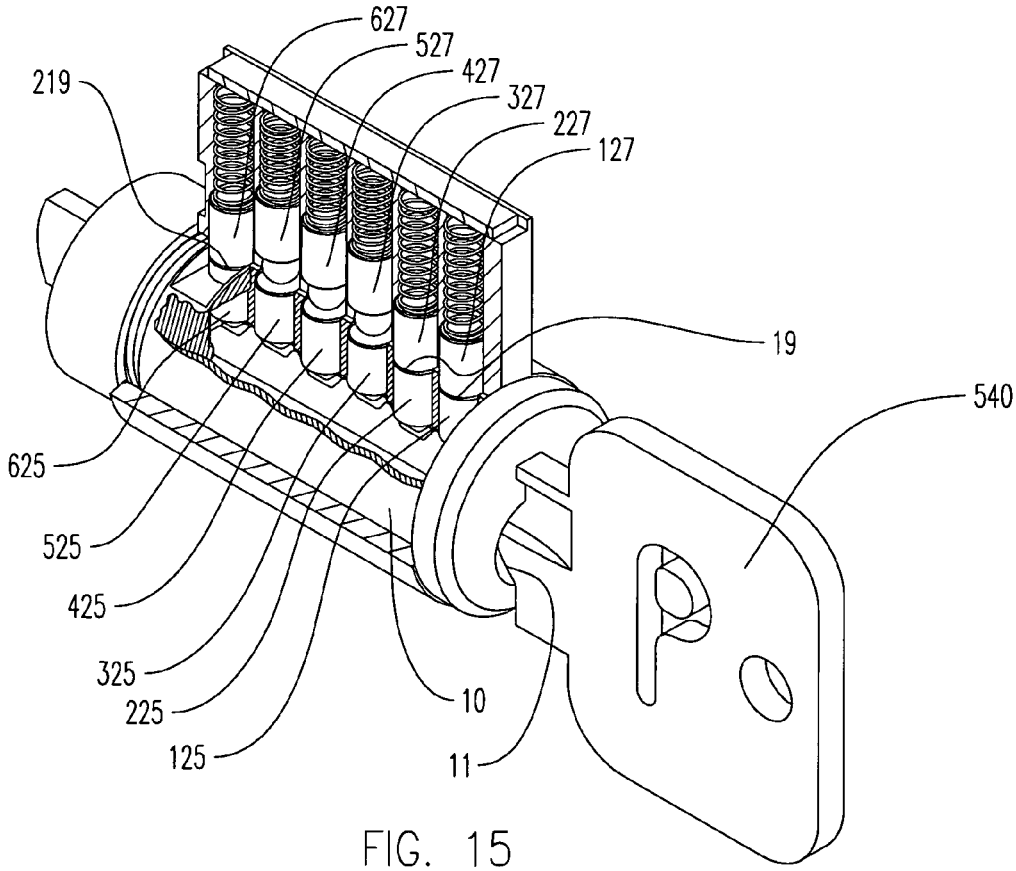
FIG. 15 shows a partially cut-away, perspective view of the programmable lock of FIG. 4, with a programming key inserted.
Figure 16:
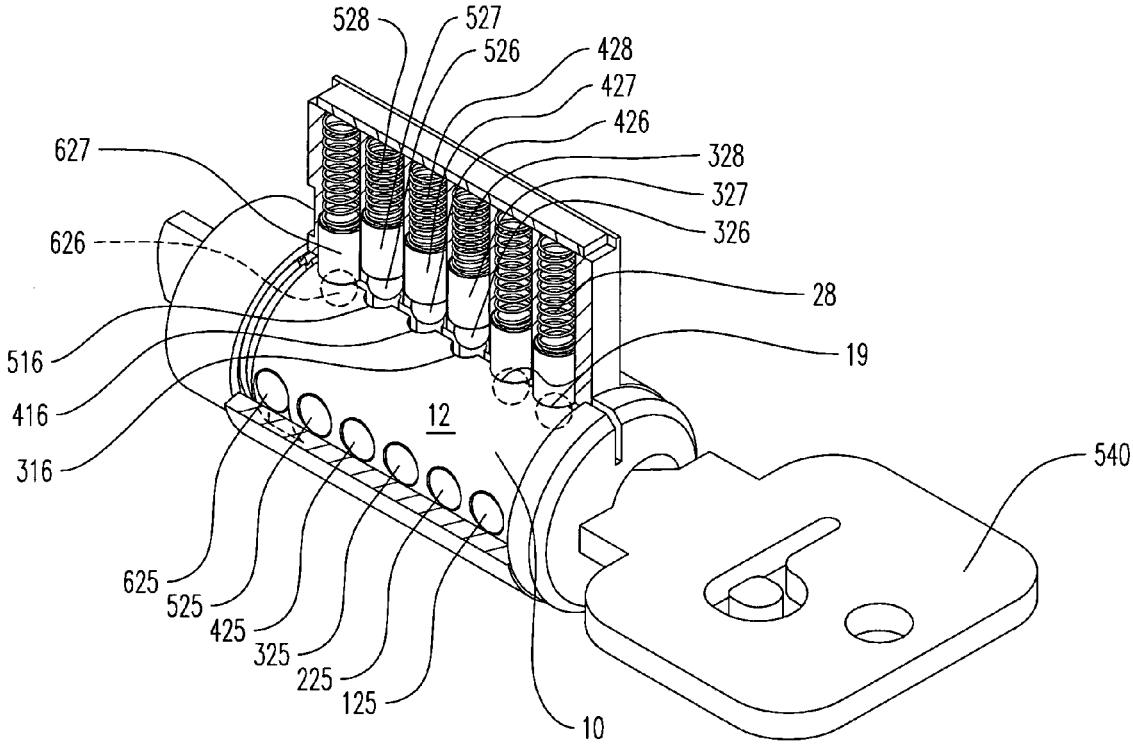
FIG. 16 shows the lock and programming key shown in FIG. 15, rotated to a programming position, with change members poised above their respective retainer cavities.

The lock is also configured to operate with a programming key 540, shown in FIG. 7. The use of the programming key 540 in the lock is illustrated in FIG. 15 to show programming of the lock configuration from operation with the first user key 140 to operation with the second user key 240. In the illustrated embodiment, the first five contour positions 41 through 45 of the programming key 540 are the same as those of the master key 640. The sixth contour position 46 of the programming key 540 has a high contour (or "program contour" or "program cut") 64. As shown in FIG. 15, when the programming key 540 is fully inserted into the keyway 11, the contour positions 1 through 5 of the programming key 540 raise the top of each of the tumblers 125, 225, 325, 425, and 525 to the shear line 19, just as the master key 640 had done. But in addition, the contour position 6 of the programming key 540 raises the top of the programming tumbler 625 to the main shear line 19 as well. Likewise, the programming key 540 moves each driver and any change ball in each of the pin chambers up into the driver chambers. While in this position, the programming key 540 can be used to operate or open the lock by rotation of the plug 10 in the clockwise direction to the operating position. Importantly, the configuration of a programming key 540 allows the plug to be rotated in the opposite or counterclockwise direction to a programming position as shown in FIG. 16. The program cut 64 in the sixth contour position of the programming key 540 has raised the top of the sixth tumbler 625 to the programming shear line 119, so that the plug can be rotated in the counter-clockwise direction to the programming position.

Figure 17:
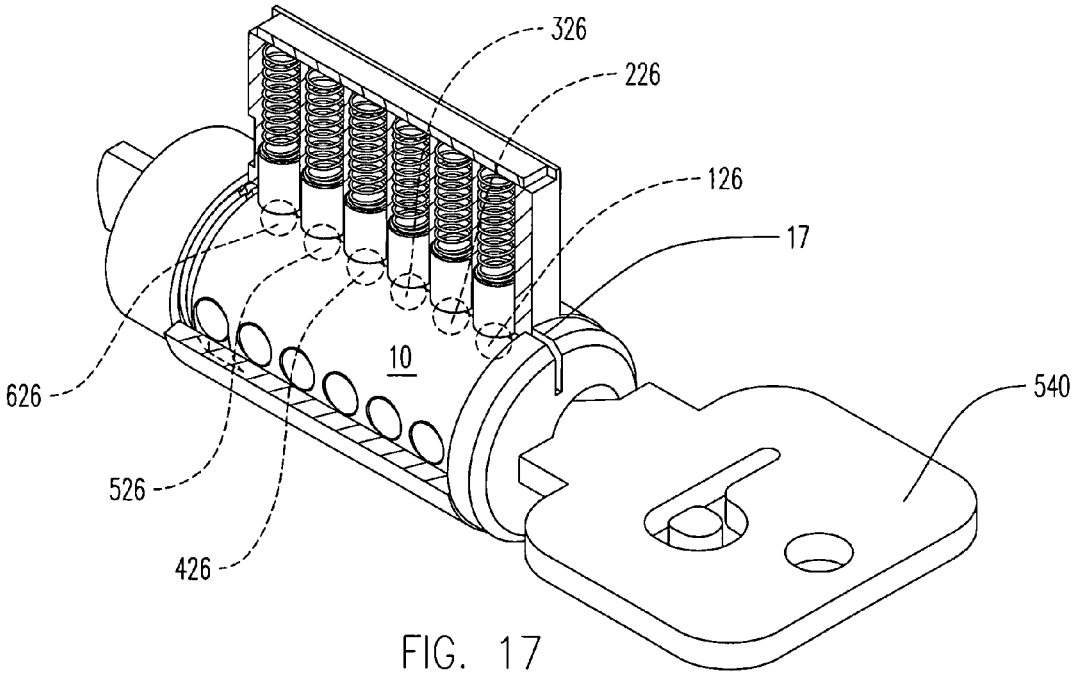
FIG. 17 shows the lock and programming key shown in FIG. 16, in the programming position, with change members deposited in their respective retainer cavities.
Figure 19:
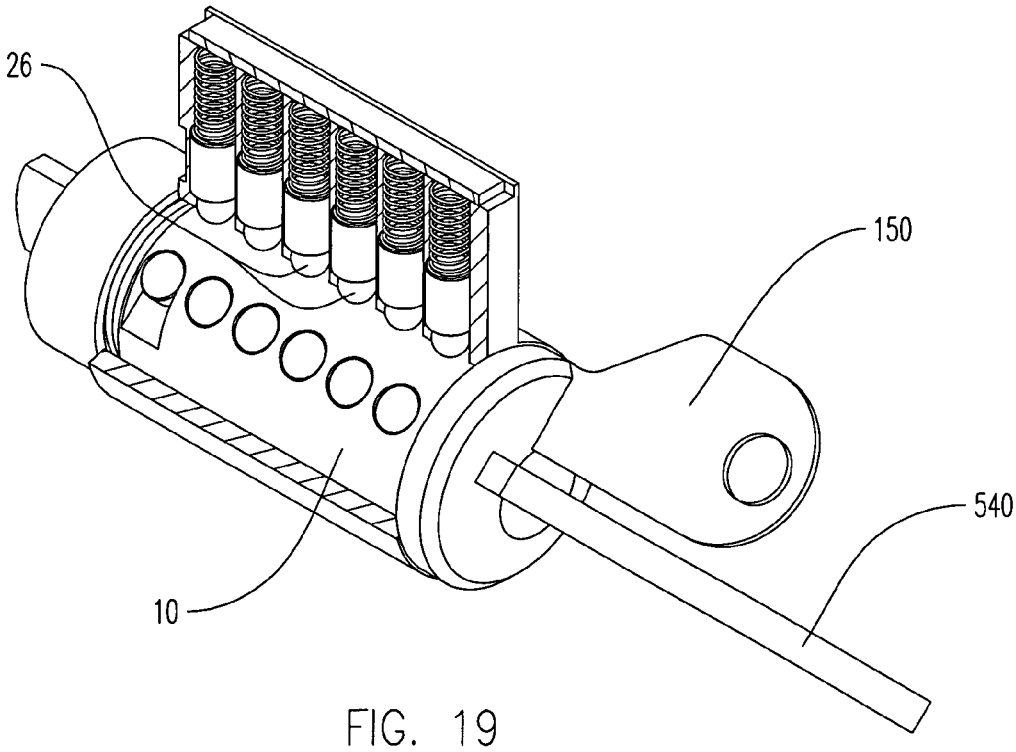
FIG. 19 shows the lock, programming key and separate change tool of FIG. 18, partially rotated back to the key insertion position.
Figure 20:
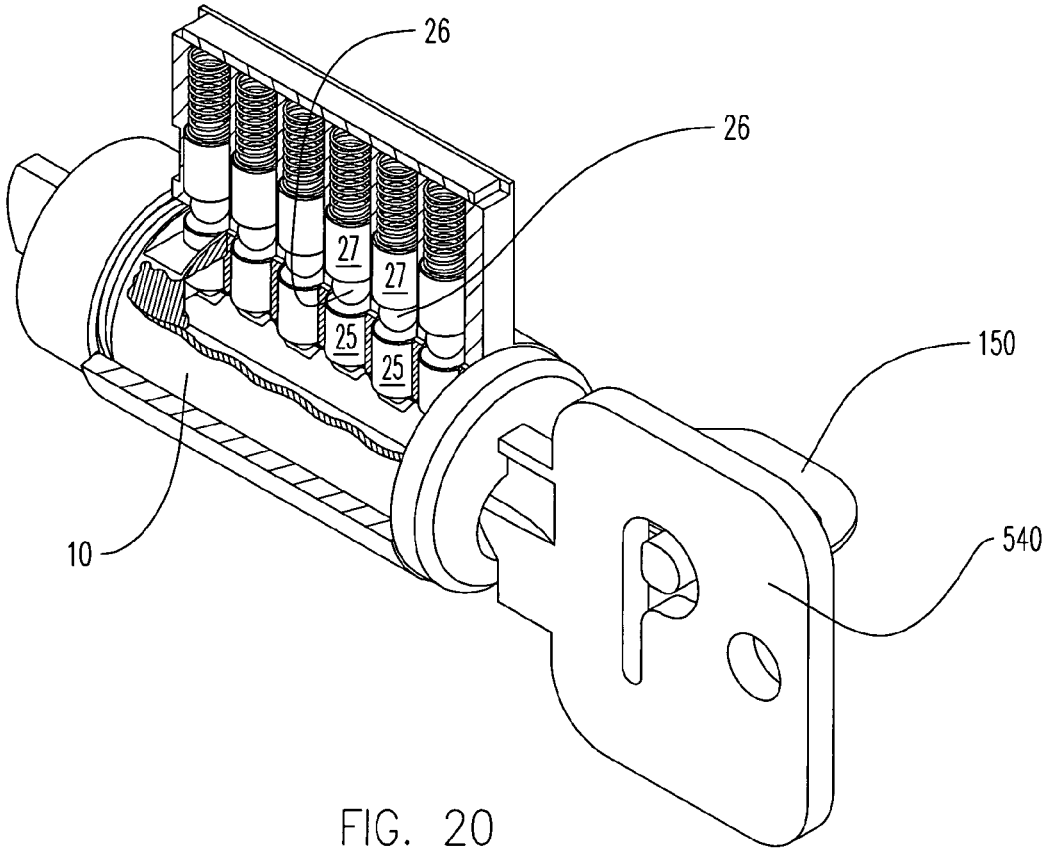
FIG. 20 shows the lock, key and separate change tool of FIG. 18, in the initial position and in a reset configuration.
Figure 21:
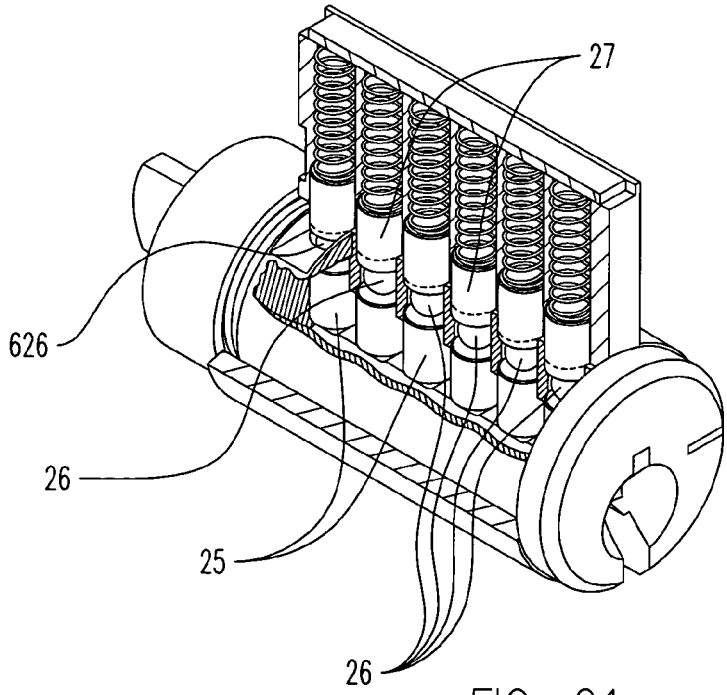
FIG. 21 shows the lock of FIG. 20, in reset configuration, with the programming key and separate change tool removed.

FIG. 14 shows the programming key 540 turned in the counter-clockwise position with the plug 10 in the third or programming position. For illustration, each of the change balls 326, 426 and 526 in the third, fourth, and fifth driver chambers is shown positioned above each of their respective retainer cavities 316, 416 and 516, frozen at the moment when the plug 10 has been turned fully to the programming position. In real time, as soon as the plug 10 has been rotated approximately to the programming position, the driver springs 328, 428 and 528 above each of the drivers 327, 427 and 527 will thrust the corresponding change balls 326, 426 and 526 down into their corresponding retainer cavities 316, 416 and 516, as shown in FIG. 17. FIG. 17 shows the lock of the present invention in a reset position, with the plug 10 rotated to its programming position, and where each of the change balls 126, 226, 326, 426, 526, and 626 (shown in silhouette) is positioned within the respective retainer cavity 16. From this reset configuration, the lock of the present invention can be programmed for use with another user key. As shown in FIG. 18, a separate reset or change tool 150 is used wherein the blade 151 of the change tool 150 is inserted into the change slot 17 down the entire length of the plug 10. The blade 151, having a tapered leading edge 152 and a linear upper edge 155 as shown in FIG. 7, sequentially raises each of the change balls 26 from their respective retainer cavities 16 as the blade 151 is inserted through the change slot 17. With the change tool 150 fully inserted into the change slot 17, each of the change balls 26 has been biased out of its retainer cavity 16 and into its corresponding driver chamber 24, below its corresponding driver 27. The change tool 150 blocks return of the change balls 26 into the retainer cavities 16 as the plug 10 is rotated clockwise back through the position shown in FIG. 19 and to its first rotated position shown in FIG. 20. In FIG. 20, each of the change balls 26 has been returned to its pin chamber between its respective drivers 27 and tumblers 25. The change tool 150 and the programming key 540 can then be withdrawn from the plug 10, rendering the lock shown in FIG. 21 in a null configuration. The null configuration of the lock has all of the change balls 26, including the programming change ball 626, disposed in the pin chambers between their respective tumblers 25 and driver 27.

Figure 23:
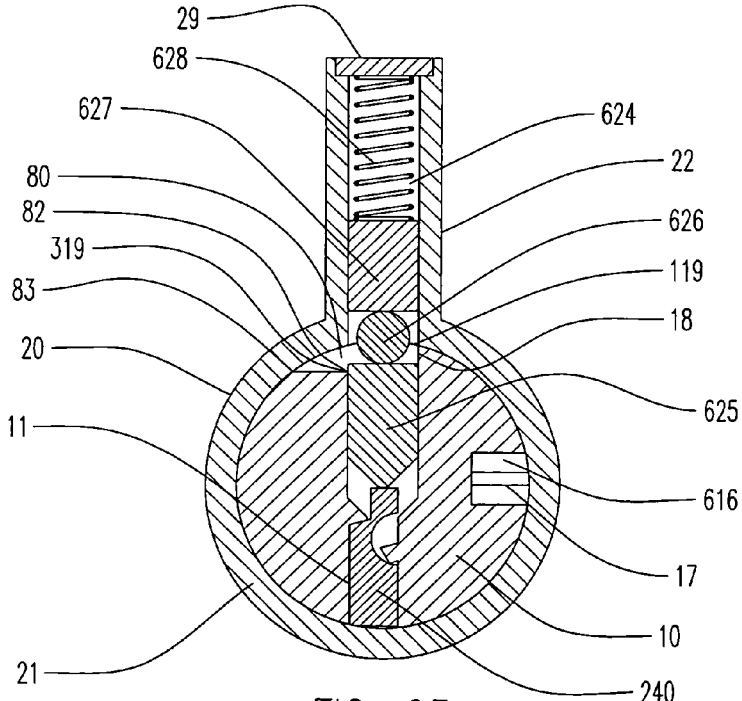
FIG. 23 shows a cross-sectional view of the lock and second user key of FIG. 22, taken through line 23-23.
Figure 24:
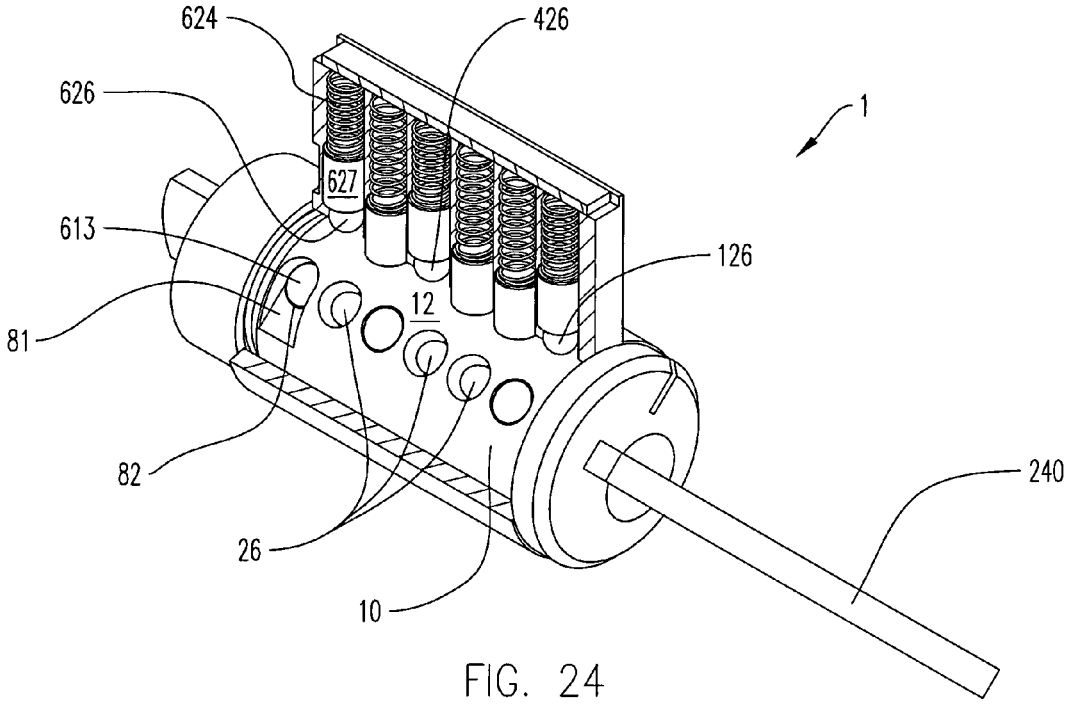
FIG. 24 shows the lock and second user key of FIG. 22, partially rotated back to the programming position.
Figure 25:
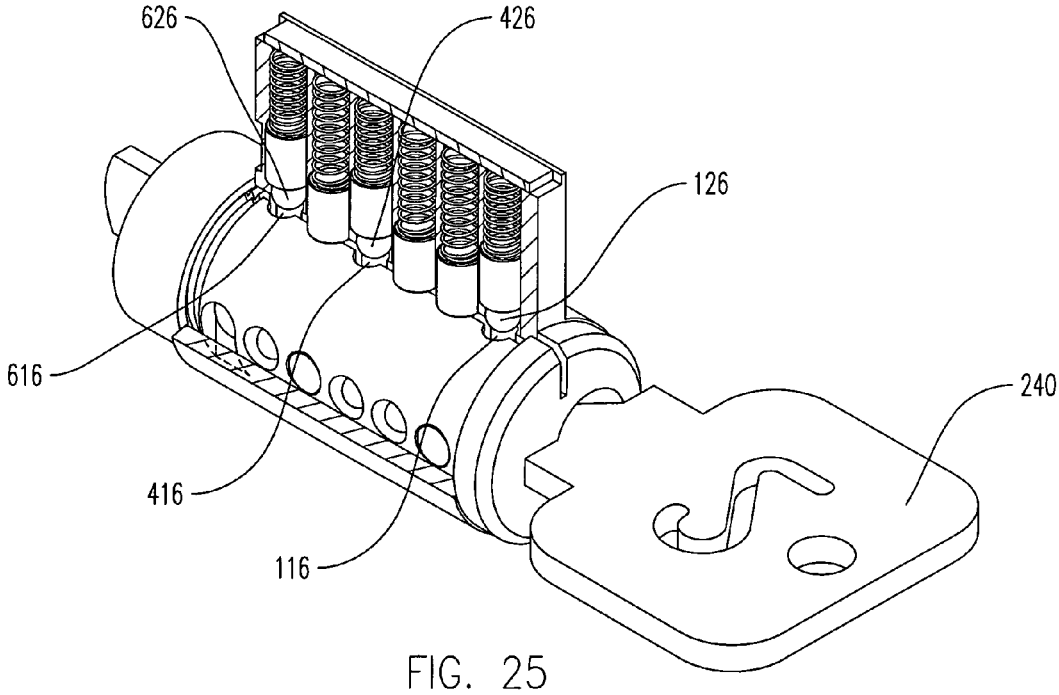
FIG. 25 shows the lock and second user key shown in FIG. 22, rotated to the programming position, with change members poised above their respective retainer cavities.
Figure 26:
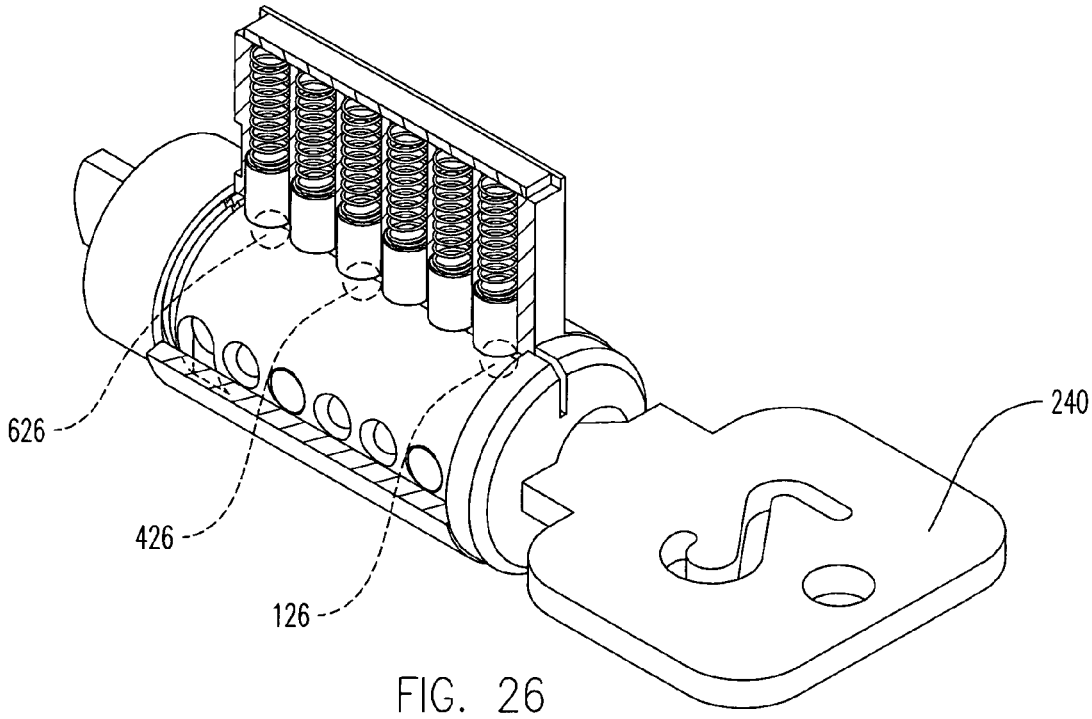
FIG. 26 shows the lock and second user key shown in FIG. 25, in the programming position, with change members deposited in their respective retainer cavities.
Figure 27:
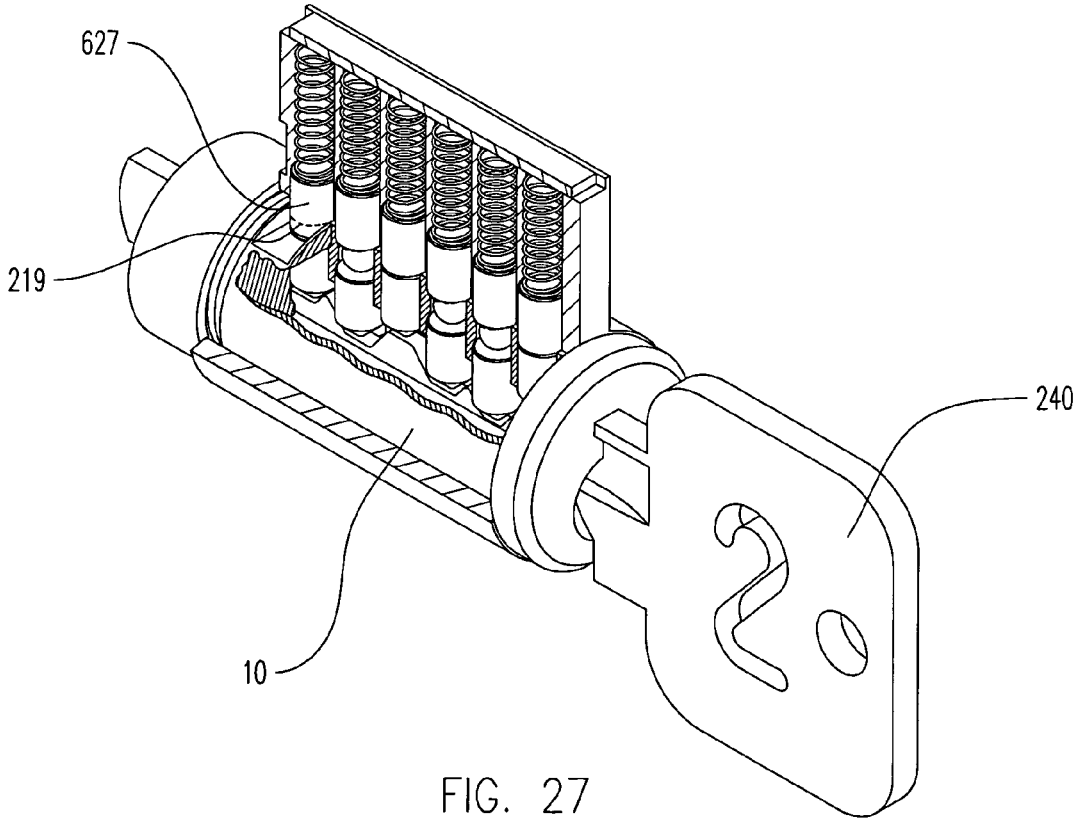
FIG. 27 shows the lock with the plug in the key insertion position and with the second user key inserted, now configured for operation with the second user key.
Figure 28:
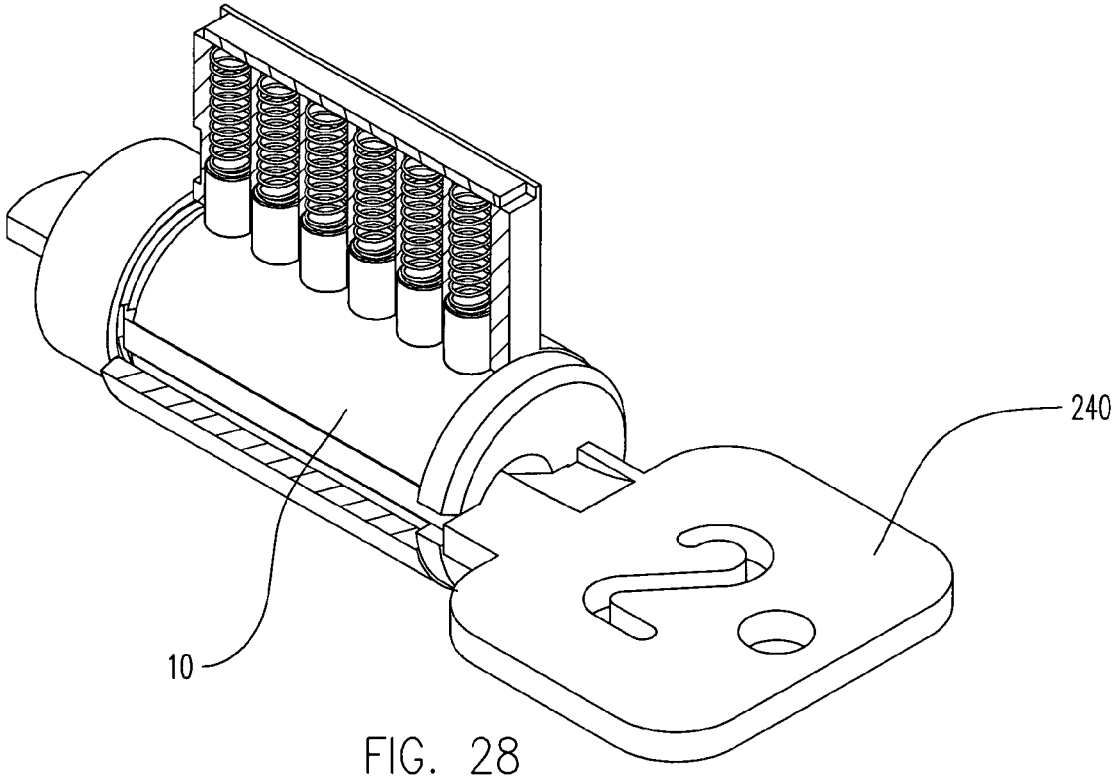
FIG. 28 shows the lock and second user key inserted, rotated to the unlock position.

From the null configuration, any user key 40 can be inserted to reconfigure the lock for use exclusively for that particular user key. As shown in FIG. 22, the second user key 240 is inserted fully into the keyway 11. The high contour positions of the second user key 240 cause the tumblers 125 and 425 in pin chambers 1 and 4 to raise the corresponding change balls 126 and 426 above the shear line 19. The lowered contours at contour positions 42, 43 and 45 of user key 240 (see FIG. 7) can only raise the tops of the corresponding change balls 226, 326 and 526 to proximate the shear line 19. The lowered contour of contour position 46 is sufficient to raise the top of the tumbler 625 to the operating shear line 319 at the edge 82 of the ramp 81. A user key such as first user key 140 and second user key 240 can only be used to rotate the plug 10 in the counter-clockwise direction toward the programming position when the lock 1 is in the null configuration, with the change ball 626 disposed in the sixth pin chamber between driver 627 and tumbler 625. With the second user key 240 inserted, the plug 10 is first rotated counter-clockwise toward the programming position, as shown in FIGS. 24 and 25. As shown in FIG. 23, the programming shear line 119 lies intersecting the lower hemisphere of the change ball 626, between its midpoint and its lower end on the side opposite the groove 80. The bottom of the change ball 626 and the top end of the tumbler 625 lie proximate the operating shear line 319 along the edge 82 of the ramp 81. When the plug 10, with the second user key 240 inserted, is rotated in the counter-clockwise direction towards the programming position, the change ball 626 is met by the programming shear line 119 along the top edge of the sixth tumbler chamber 613, at a point below the center point of the change ball 626, and is thereby forced upward into the sixth driver chamber 624. The sixth change ball 626 can only be forced upward into the sixth driver chamber 624 if the programming shear line 119 along the top edge of the tumbler 613 engages the change ball 626 below its center point. The spherical surface of the change ball 626 allows the top edge of the sixth tumbler 613 to advance across the face of the driver chamber 624 while thrusting the change ball 626 up into the driver chamber 624. As the second user key is rotated toward the programming position, the change balls 126 and 426, and the programming change ball 626 in the respective pin chambers 1, 4 and 6 ride along the periphery 12 of the plug as shown in FIG. 24. FIG. 25 shows the change balls 126, 426 and 626 frozen in position at that moment in time when the plug 10 arrives fully at its programming position. In real time, as soon as the three change balls 126, 426 and 626 are disposed proximate the openings of the corresponding retaining cavities 116, 416 and 616, then the drivers 127, 427 and 627, respectively, biased by the respective driver springs 28, will force the change balls 126, 426 and 626 into the respective retaining cavities 116, 416, and 616 as shown in FIG. 26. When change balls 126, 426 and 626 have been deposited in their second position in the corresponding retainer cavities, the lock is deemed configured for use with the second user key 240. Once configured for operation with the second user key, plug 10 can be rotated back to the key insertion position as shown in FIG. 27. From this position, the second user key 240 can rotate the plug 10 to the operating position, shown in FIG. 28, to operate the lock and undue the latch. It can be understood that once the plug, with the second user key 240 inserted, has been returned to the key insertion position shown in FIG. 27, the plug can not be rotated back to the programming position, since the programming change ball 626 is disposed in the programming retainer cavity 616, and the programming driver 627 spans the programming shear line 119 (phantom shear line 219).

Figure 29:
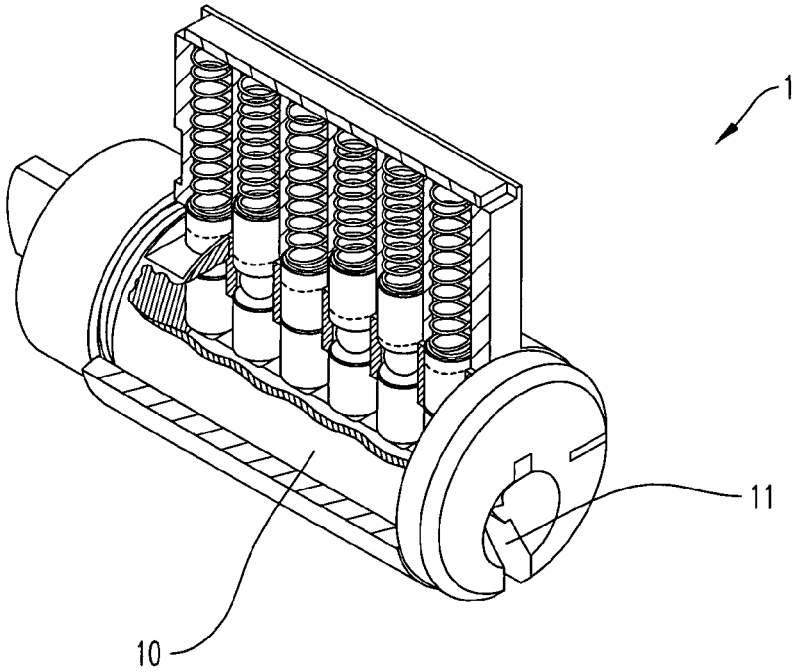
FIG. 29 shows the lock, configured for operation with the second user key, without a key inserted.
Figure 30:
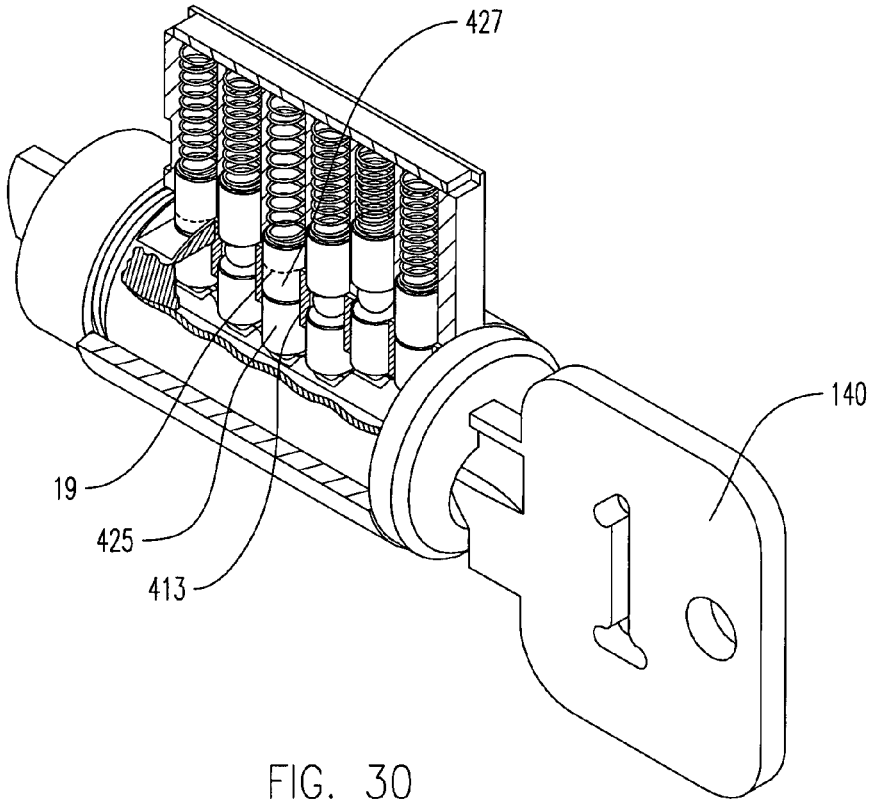
FIG. 30 shows the lock, configured for operation with the second user key, with the first user key inserted.

FIG. 29 then shows the lock 1 of the present invention configured for operation with the second user key 240, after the second user key has been withdrawn from the keyway 11. In this configuration the lock is uniquely configured for operation (for rotation of the plug to the operating position) only with the second user key 240, the master key 640, or the programming key 540. Operation of the lock by the first user key 140 is now precluded. As shown in FIG. 30, when the first user key 140 is inserted into the keyway 11 of the lock that is configured for operation with the second user key 240, the fourth driver pin 427 cannot be raised by the fourth contour position of the key 140 to a height sufficient to align the bottom end of the driver 427 with shear line 19, such that the body of the driver 427 stands across the shear line 19. While the operable second user key 240 has a high cut in the fourth contour position, the first user key 140 has a low cut in the fourth contour position, which in combination with the deposit of the fourth change ball 426 in its corresponding retainer cavity 416, only permits the first user key 140 to raise the lower end of the driver 427 to an intermediate position within the fourth tumbler chamber 413. Consequently, when the lock of the present configuration is configured for operation with the second user key 240, the first user key 140 cannot operate the lock to rotate the plug and undo the latch.

In an alternate embodiment of the present invention, the plug can comprise an integral change tool. The integral change tool can comprise a body having a plurality of engaging portions, and a manipulation portion. The integral change tool can also comprise a biasing means, such as a spring, for biasing the integral change tool toward a first position where the engaging portions of the change tool are disengage from corresponding retainer cavities, from a second position where the engaging portions engage the retainer cavities. The engaging portions provide a lifting portion that, when the tool is manipulated or engaged, can intersect the retainer cavity to displace the change member out of the retainer cavity, and typically into the pin chamber. The engaging portions typically have a beveled surface that can gradually raise the change ball out of the retainer cavity as the engaging portions advance into the retainer cavities. Typically, each engaging portion and the retainer cavity are configured to raise the change ball at least halfway out of the retainer cavity, where a centerline of the change ball is outside the retainer cavity and beyond the periphery of the plug. If the change ball is at least halfway out of the retainer cavity when the change ball encounters a shear line, such as the lower rim of the driver chamber, then the change ball will be forced out of the retainer cavity and into the driver chamber. The manipulation portion of the integral change tool can be configured as a head that protrudes from the front (or rear) face of the plug for manipulation by the finger, hand or other implement. The head of the integral change tool is typically cylindrical and extends through a similarly-shaped and sized opening formed in the face of the plug. The engagement portion can also be disposed within the periphery of the plug or surface of the front or rear face of the plug, and be exposed through an aperture or opening in the face of the plug, for manipulation by an implement, such as a pin or shaft. Manipulation of the manipulation portion by a finger or implement overpowers the biasing means and moves the integral change tool from the first position (disengaged from the retainer cavities) to the second position where the engaging portions engage or intersect the retainer cavities.

Another embodiment of the means for displacing the change members from the retainer cavities is configured to rotate within the change tool slot. The rotating change tooling can comprise an elongated cylindrical member having a plurality of grooves formed along its length, in registry with the retainer cavities. The groove forms a void, within which the change member can be disposed, and will remain in the retainer cavity when the change tool is in the disengaged position. When the change tool cylinder is rotated to the engaged position, the biasing surface of the groove proximate the tool periphery engages the retainer cavity and displaces the change member out of the retainer cavity and into the driver chamber. A rotatable end for the rotating change tool can be manipulated with a finger or hand, or other implement such as a screw driver engaging a slot in the end, to rotate the rotatable change tool within the plug.

Figure 31:
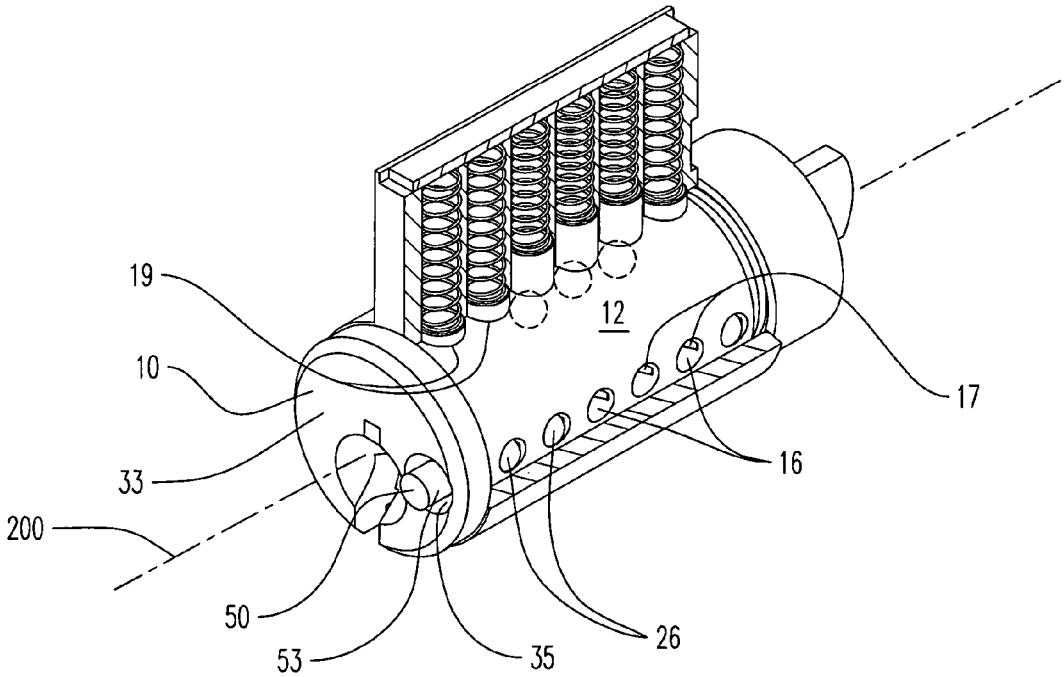
FIG. 31 shows a perspective view of a programmable lock that employs integral change tooling.
Figure 32:
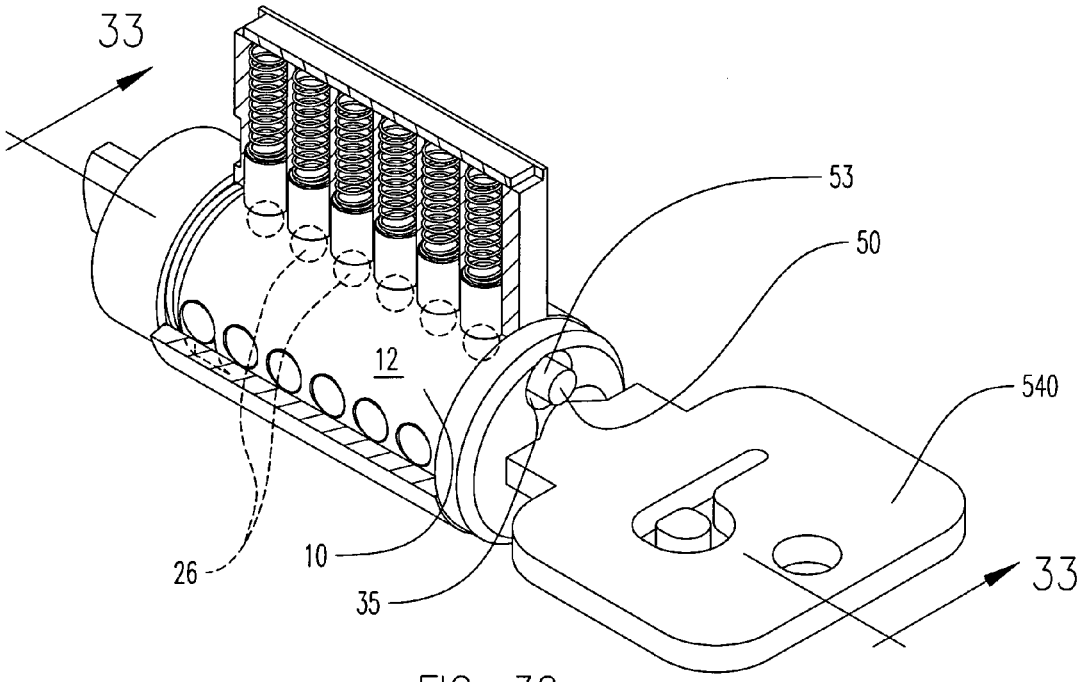
FIG. 32 shows the programming lock shown in FIG. 31 with the inserted programming key and rotated to the programming position, having change members deposited in their respective retainer cavities and disposed above the integral change tooling.
Figure 33:
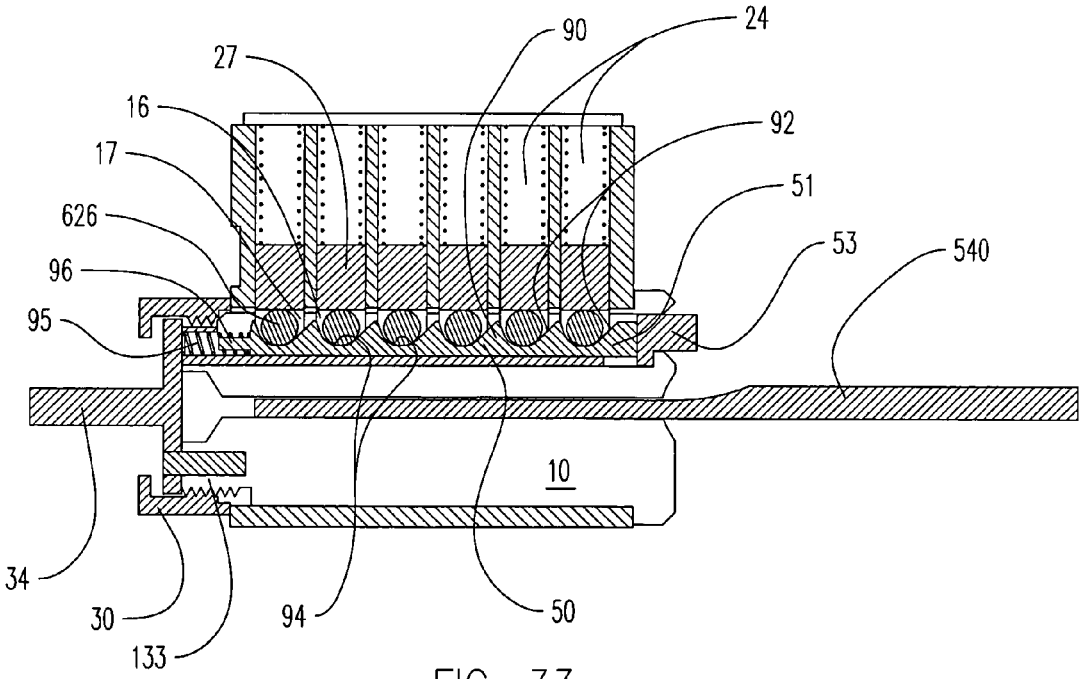
FIG. 33 shows a sectional view of the length of the programming lock of FIG. 32, taken through line 33-33.

One embodiment of the integral change tool, also referred to as change tooling, is shown in FIGS. 31-35. The illustrated embodiment shows a change tooling, having a blade 51 that is disposed substantially within the volume of the plug beneath the peripheral surface 12. FIG. 32 shows the lock with an inserted programming key 540 in a reset position, with the plug 10 rotated to its programming position, and where each of the change balls 26 (shown in silhouette) is positioned within the respective retainer cavities 16. From this reset configuration, the lock of the present invention can be programmed for use with another user key. Change tooling 50 is disposed in a change slot 17 that is formed in the plug 10, parallel to the axial centerline 200. The change slot 17 extends from proximate the front face 33, to proximate the rear end 133 of the plug. The change slot 17 passes generally proximate to the plurality of retainer cavities 16, intersecting at least a portion of each retainer cavity. In the illustrated embodiment, the change slot 17 is formed through the centers of the aligned retainer cavities 16. The radial depth of the change slot 17 substantially overlaps the depth of the retainer cavities 16. The width and height of the change slot 17 are configured to accommodate the blade 51 of the change tool 50. The configuration of the change slot allows the axial manipulation of the change tool to raise a change ball 26 contained within the retainer cavity 16 at its center of weight and to a height within the retainer cavity that is sufficient to cause the change ball 26 to be moved out of the retainer cavity 16. The change slot 17 is typically configured with a minimum width, while maintaining effective lifting of the change balls 26. A typical width of the change slot 17 is about 0.020 inches (about 0.50 mm) or less.

Figure 34:
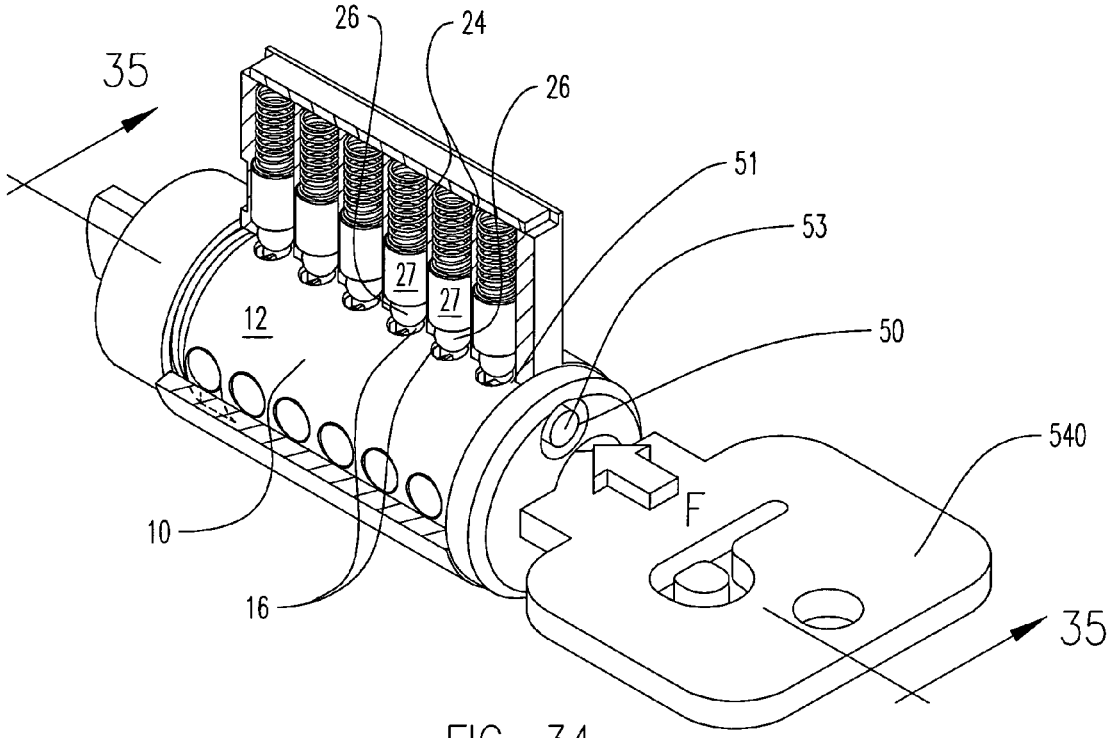
FIG. 34 shows the lock and programming key shown in FIG. 32 with the integral change tooling depressed to remove the change members from their retainer cavities.
Figure 35:
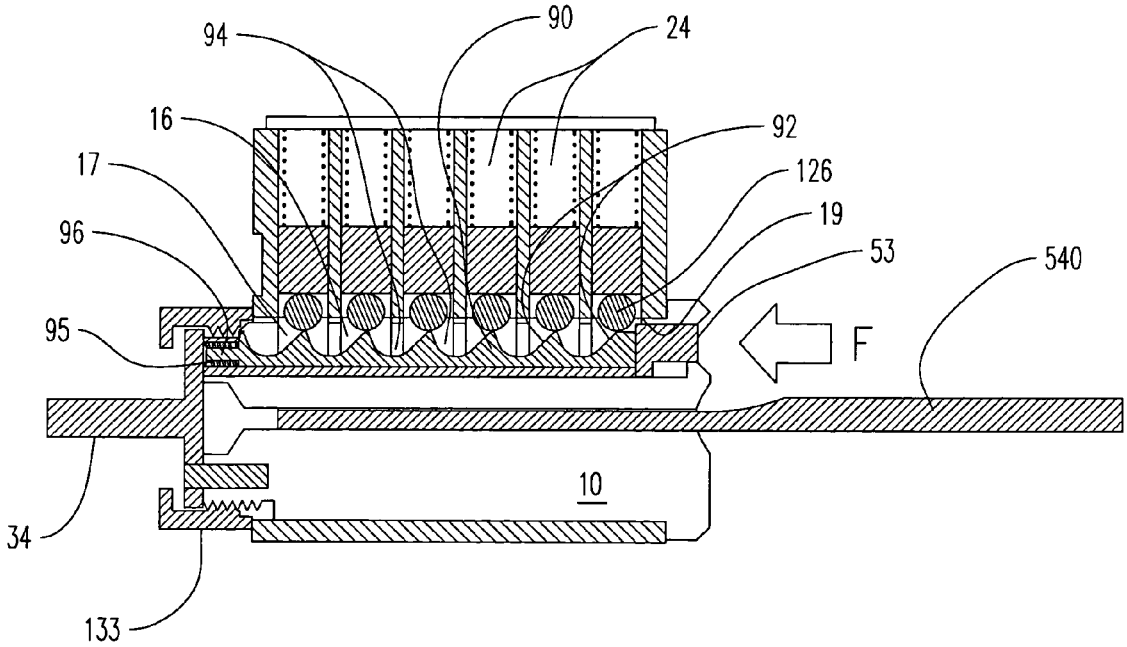
FIG. 35 shows a sectional view of the length of the programming lock of FIG. 34, taken through line 35-35.

In the illustrated embodiment, the blade 51 of the change tooling 50 has a plurality of recesses, shown as valleys or voids 94, intermittent a plurality of peaks or raised positions 90 that serve as engaging portions. The recess voids 94 are configured to register with a corresponding retainer cavity 16 when the change tool is in its first position, shown in FIGS. 32 and 33. The raised portions 90 are configured to register with the corresponding retainer cavities 26 when the change tooling is in its second position, shown in FIGS. 34 and 35. The illustrated change tooling is biased into its first position by a biasing spring 95 disposed between the rear end 96 of the change tooling and the rear cam plate 98 at the rear end 133 of the plug. The change tooling 50 can be manipulated into the second position by depressing front head or button 53 with a finger or other implement. As illustrated, any change ball disposed within the retainer cavity 16 can be moved out of the retainer cavity and into its corresponding driver chamber 24 when the change tool head 53 is depressed to move the change tooling rearward. Depressing head 53 causes the slanted engaging portions 92 of each raised portion 90 of the change tooling to bias and force the change ball 26 outward and against the inner wall of the retainer cavity 16. As the engaging portions 92 of the change tool proceed further into the retainer cavities 16, the change balls 26 are lifted higher within the retainer cavity. When the change tooling is fully depressed, as shown in FIGS. 34 and 35, the change balls have been raised at least mostly, and preferably completely, above the shear line 19 and out of the retainer cavities, and into the respective driver chambers. When the plug 10 is rotated from the programming position (its second rotated position) back toward the key insertion position (its first rotated position), the change balls are captured within the driver chambers.

Figure 36:
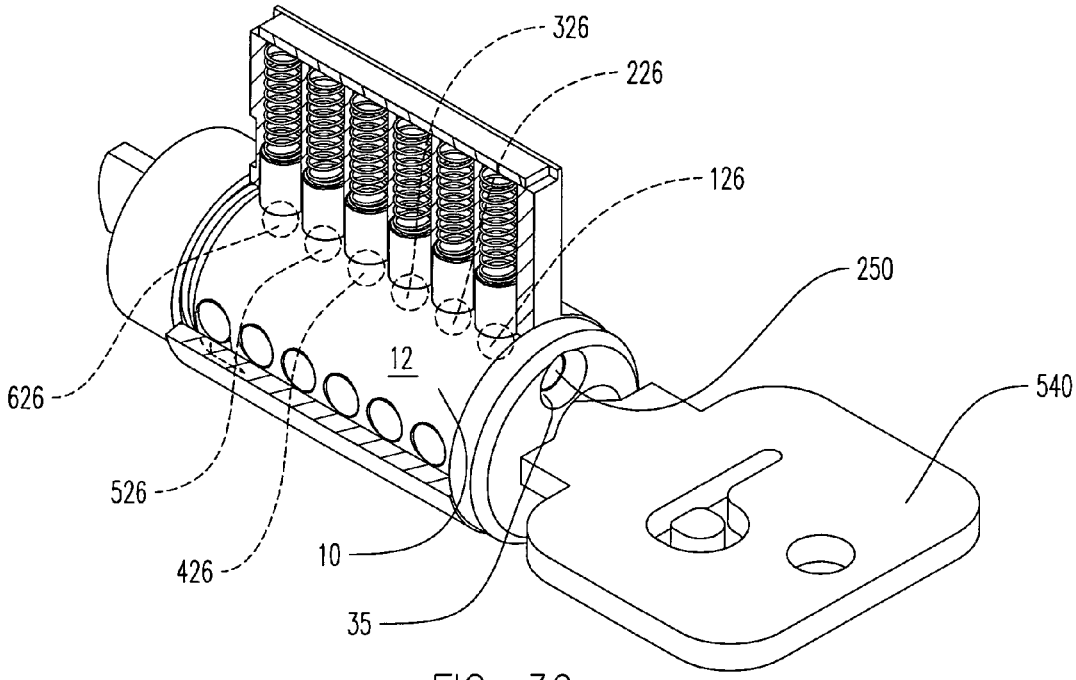
FIG. 36 shows the lock shown in FIG. 32 with an alternative embodiment of the integral change tooling.
Figure 37:
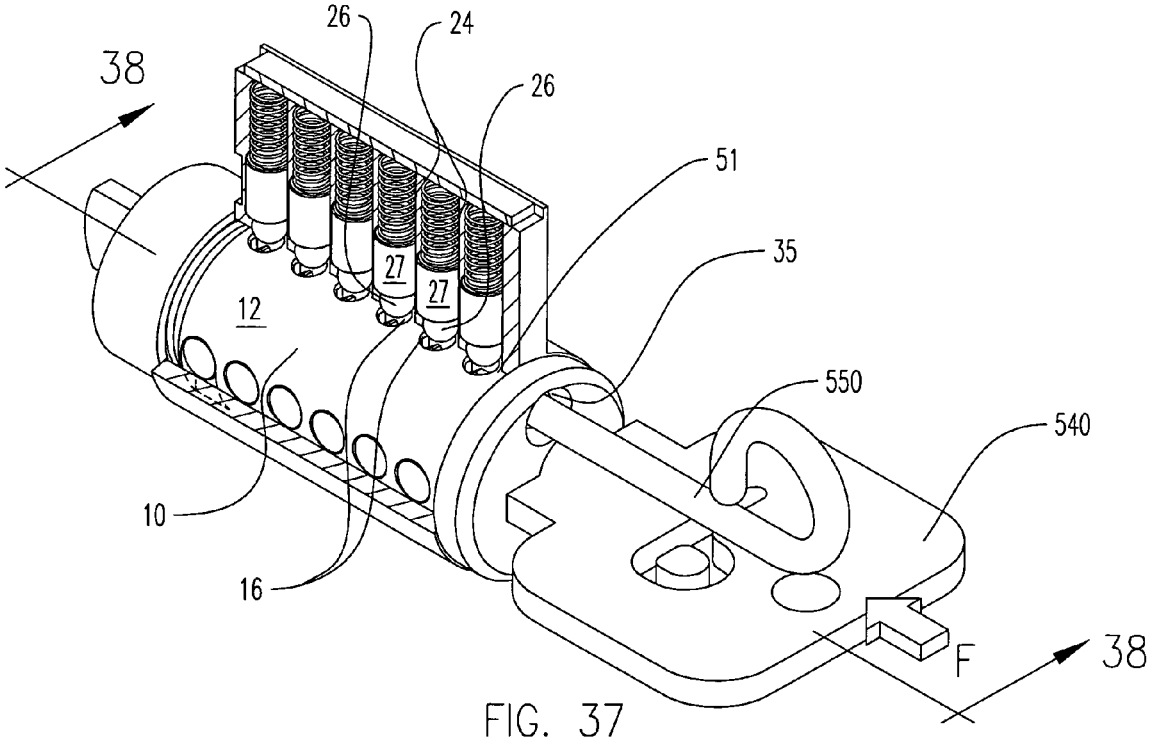
FIG. 37 shows the lock shown in FIG. 36 that employs an implement to manipulate the integral change tooling.
Figure 38:
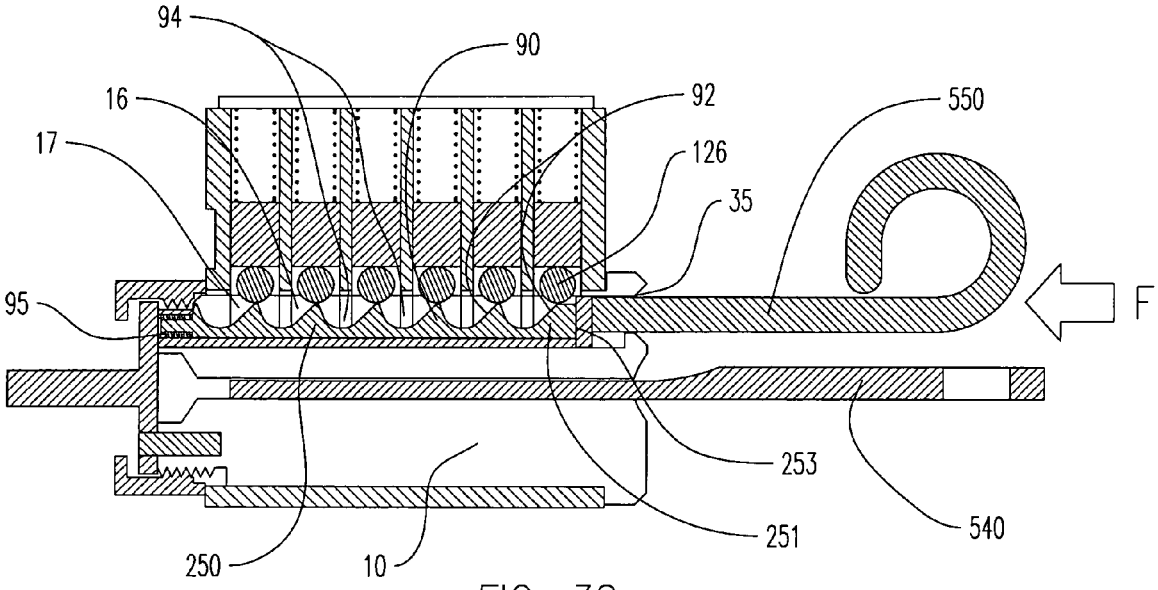
FIG. 38 shows a sectional view of the length of the programmable lock of FIG. 37, taken through line 38-38.

Another alternative embodiment of the integral change tooling is shown in FIGS. 36-38. The change tooling 250 comprises a blade 251 that is similarly configured to the blade 51 of the previous embodiment. The change tooling 250 has an engagement member 253 disposed inboard the front end of the plug, exposed though an opening 35 in the plug face, against which an implement, such as the staff 550 shown in FIGS. 37 and 38, can be depressed for manipulating the change tooling. The embodiment provides a change tooling that is essentially fully contained within the periphery of the plug and the front surface of the face 33 of the plug, so that manipulation can essentially only occur by use of an implement, since fingers are typically too large to pass through the opening 35 in the face of the plug.

Figure 39:
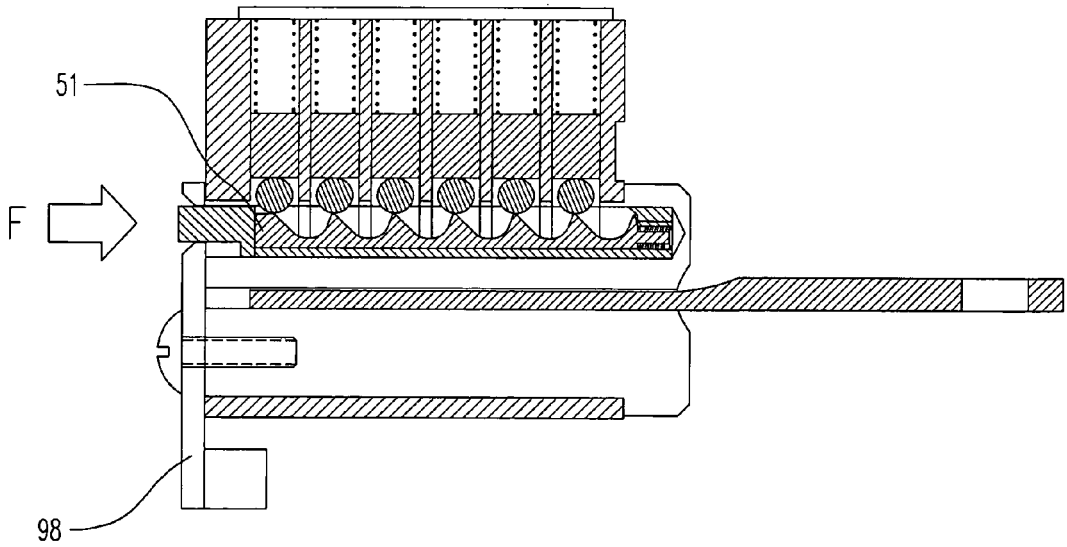
FIG. 39 shows a sectional view of the length of an alternative programmable lock, as viewed in FIG. 38, wherein the integral change tooling is manipulated from the rear face of the plug.

Alternative embodiments of any of the integral change tooling herein disclosed can be configured to manipulate the change tooling, manually or with an implement, at the rear end 133 of the plug. This avoids positioning of any opening or protruding head of the change tooling through the front face. FIG. 39 shows the manually-manipulable integral change tooling 50 illustrated in FIG. 35, configured for rear manipulation. Rotation of the plug operates a rear-mounted cam lever 98 that can engage a latch.

It can be understood that the lock assembly of the present invention can comprise a number of additional user keys which have a different combination of raised and lowered contour at different contour positions, whereby operation of the lock when configured for any one such additional user key would preclude operation by either the first or the second user keys, or any other user keys. Furthermore, the contour positions of these additional user keys would preclude the use of any of these additional user keys to rotate the plug to the programming position, unless the lock has been set to the "null" configuration, described above and shown in FIG. 19.

The illustrated embodiment utilizes user keys 140 and 240, shown in FIG. 6, each having two raised "user" contour positions: contour positions 41 and 42 for user key 140, and contour positions 41 and 44 for user key 240. The remaining "user" contour positions are lowered. It can be understood that the lock assembly of the present invention can comprise a number of additional user keys having a different combination of two raised "user" contour positions from among contour positions 1 through 5, and the remaining as lowered contour positions, whereby operation of the lock when configured for such additional user keys would preclude operation by either the first user key 140 or the second user key 240, or yet other user keys. By staggering two raised contour locations over a total of five contour locations, 10 different key configurations can be achieved. Similarly, staggering three raised contour locations over the total of five user contour locations provides also for 10 different key combinations, while staggering either four raised contour locations, or one raised contour location, over the five total locations, results in only 5 different lock configurations. The subset of keys can also include user keys having a different number of raised contour locations.

In the illustrated embodiment, the sixth contour position of each user key and the sixth pin chamber of the lock are reserved as the programming contour position and programming pin chamber, respectively. It should be understood that any one of the other contour positions 1 through 5 and pin chambers 1 through 5 could be used as the programming contour position and programming pin chamber, respectively.

In the illustrated embodiment, the programming key 540 can also serve as a "lockout" key that prevents the lock from being operated with any user key. As shown in FIG. 15, the programming key 540 can be inserted into the keyway 11 and rotated to the programming position, wherein all the change balls 26 have been deposited into their respective retainer cavities 16. If, instead of inserting the change tool 150 as shown in FIG. 18, the programming key 540 rotates the plug 10 back to the first rotated position and is removed, then all the change balls 26 are disposed in their corresponding retainer cavities 16, and none of the user keys 140 and 240, or any other user key, can operate or rotate the lock. As described herein above, each user key has at least one lowered contour position, and when a user key having one or more lowered contour positions is inserted into the lock that is configured with a change ball disposed in a corresponding retainer cavity, that user key can not raise the corresponding driver high enough to align with the shear line; that is, in the pin chambers corresponding to the lowered contour positions of the user key, the driver body spans the shear line and prevents the plug from rotating. This is illustrated in FIG. 30, where the lower contour position 144 of first user key 140 can not raise driver 427 above the shear line 19 of the lock when configured for the second user key 240, while the corresponding fourth change ball 426 is disposed in its second position in the retainer cavity (not shown).

In the "lockout" configuration, it can be understood that the master key 640 can still operate the lock, since, as shown in FIGS. 13 and 14, it can raise the tops of each tumbler 25 to the shear line 19, whereby none of the tumblers 25, drivers 27 or any change balls 26 present in a pin chamber can span the shear line and block rotation of the plug. The lock in the "lock" configuration can be programmed for operation by a user key be re-inserting the programming key and rotating the plug to the programming and reset positions, as described herein above.

In another embodiment of the present invention, a method is provided for using the lock by providing a means for rapidly changing the internal configuration of the drivers, tumblers and change balls of the lock to program the lock to operate exclusively with one user key of a set of user keys. The method of using the rapidly-changeable lock does not require disassembly, or removal of the plug from the housing. The method involves inserting a programming key into the keyway of the lock that is configured to operate with a first user key. The inserted programming key provides for rotation of the plug in an opposite direction, to a programming position. The programming key also provides that any change ball disposed within the pin chambers is forced up into its respective driver chamber, and is subsequently deposited within its respective retainer cavity. The lock is then configured into a reset position by manipulating a change tool in the change slot, which engages the retainer cavities that are configured in the plug to retain the change balls, and displaces the change balls from their retainer cavities into their respective driver chambers, and then rotating the plug back to its first rotated position (the key insertion position). From the reset configuration, the change tool can be disengaged and the programming key can be removed from the lock, and replaced with the new user key. The contour positions of the new user key raise the corresponding change balls within the pin chambers to either a position within the tumbler of the plug, or a position with its centerline above the shear line or within the driver chamber of the housing. The configuration or pattern of change balls raised above the shear line and into the driver chamber is different from such pattern of the previous user key. Subsequently, rotation of the new user key back to the programming position causes any change balls that became isolated in the driver chamber (including the change ball in the programming pin chamber) to be deposited into their respective retainer cavities. After returning the plug to the initial or first rotated position, the lock has been reconfigured or programmed for use with the new user key, and renders the previous user key inoperable.

In an alternative embodiment, the retainer cavity and the groove can be disposed on the opposed side of the plug, whereby rotation of the plug to its second position is in the counter clockwise direction, to accommodate a lock that opens when rotating the user key in the counter clockwise direction.

In a second embodiment of a programmable lock assembly, the lock can be configured to operate with a user key of a set of the user keys comprising at least a preceding user key and succeeding user key, which have different though complementary configurations. The preceding user key and the succeeding user key are complementary in that the succeeding user key has raised contour positions corresponding to the raised contour positions of the preceding user key, but are different in that the succeeding user key has at least one additional raised contour position. That is, the preceding user key can have no raised contour positions, or at least one raised contour position, and the succeeding key has a configuration similar to the preceding key, but also has at least one additional raised contour position. The programming lock assembly provides a means for enabling rotation of the plug with a user key in only one direction from the key insertion position to the operating position, and a means of preventing rotation of the plug with an inserted user key in the opposite direction. The lock configuration can be changed simply by inserting and operating the lock with the key, which cancels the operation of the lock by the preceding user key.

This embodiment also comprises at least one change member, and at least one retainer cavity, as described in the previous embodiment. However, in the present embodiment, at least one retainer cavity is disposed in the plug wherein the retainer cavity aligns with a corresponding driver chamber when the plug is rotated to the programming position, which is typically disposed between the key insertion position and the operating position. When any inserted key, including any user key, raises the change member above the shear line, the change member can be deposited into the corresponding retainer cavity by rotation of the plug toward the operating position. In this embodiment, no programming key or change tooling is required, and there is no need to rotate the plug in the opposite direction in order to program or change the configuration of the lock for the successing user key.

Figure 40:
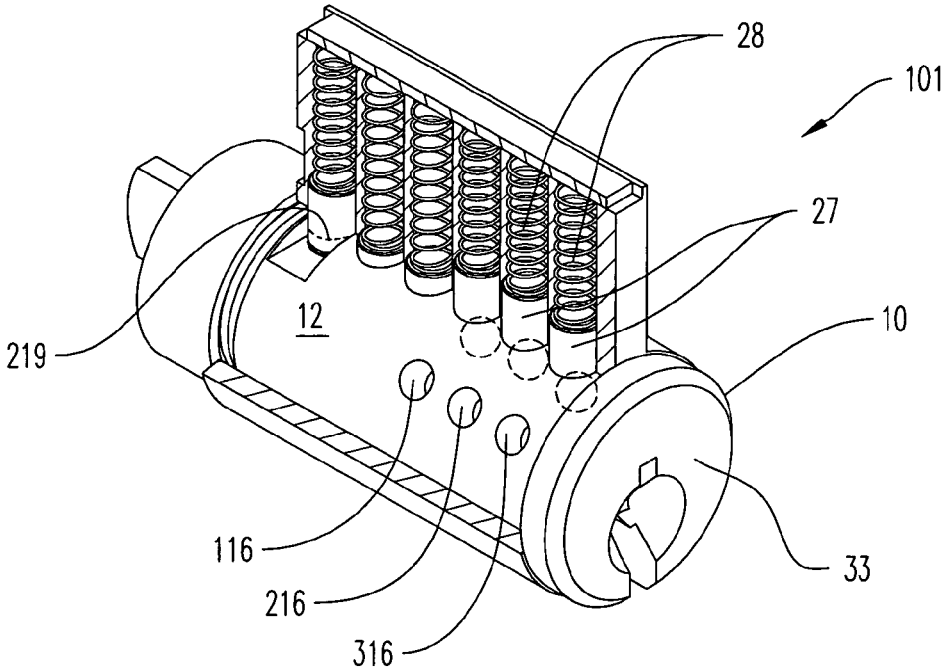
FIG. 40 shows a perspective view of a second embodiment of a programmable lock of the present invention.
Figure 44:
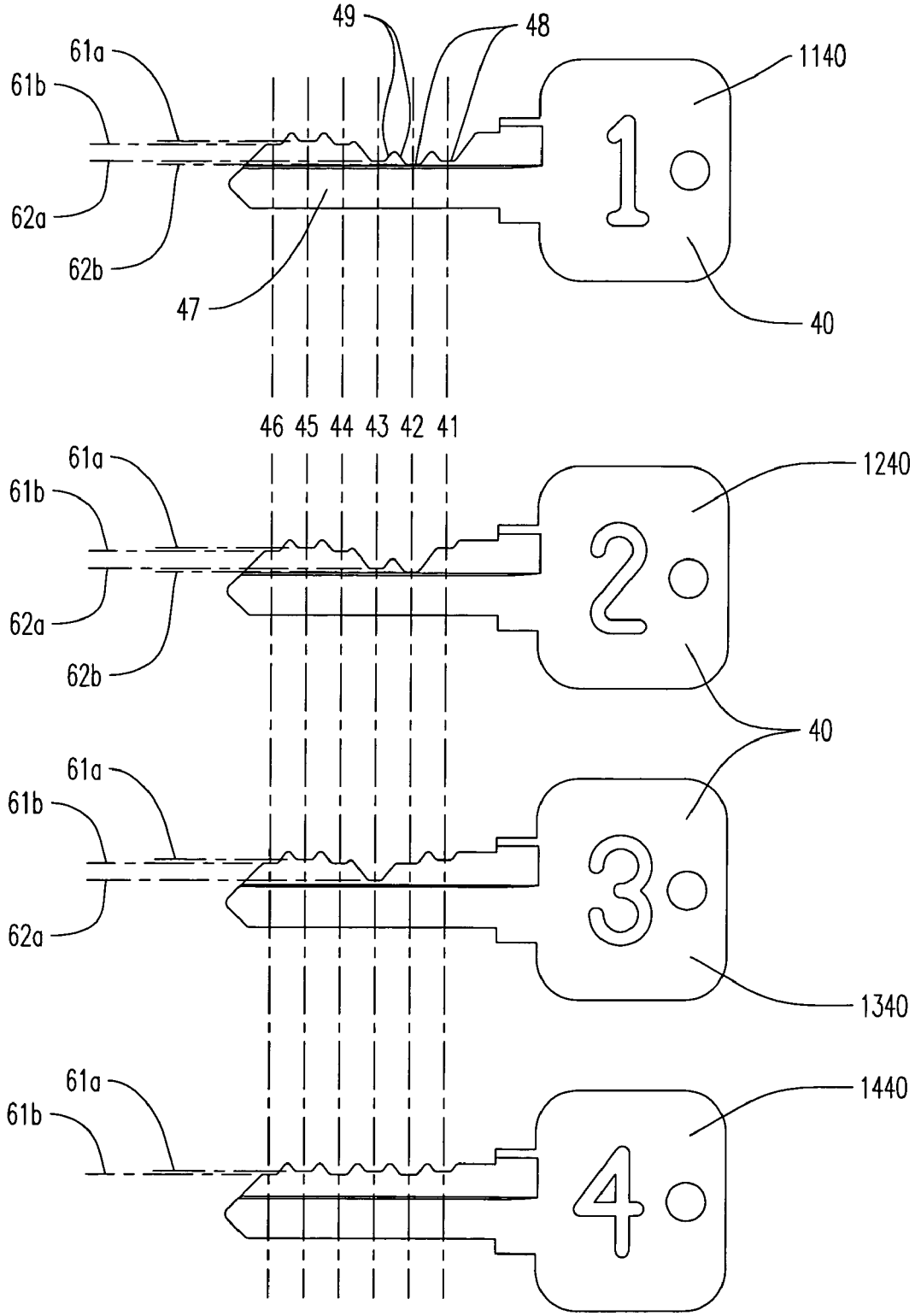
FIG. 44 shows a set of keys associated with the programmable lock of the second embodiment, including a four user keys.

In a second embodiment of a programmable lock assembly, where like elements and components with the first embodiment have the same reference number, the lock 101 can be configured to operate with a set of the user keys shown in FIG. 44, comprising a preceding user key and a succeeding user key, which have a different though complementary configuration, by simply operating the lock with the succeeding user key. An embodiment is shown in FIG. 40, where the plug 10 is configured with a plurality of retainer cavities 16 formed or machined into the periphery 12 of the plug 10. Three retainer cavities 16, 216 and 316 correspond to the first three pin chambers of the lock. A plurality of change members, shown typically as balls 26, are also associated with the first three pin chambers, each having a first position within the corresponding pin chamber and a second position within the corresponding retainer cavity.

Figure 41:
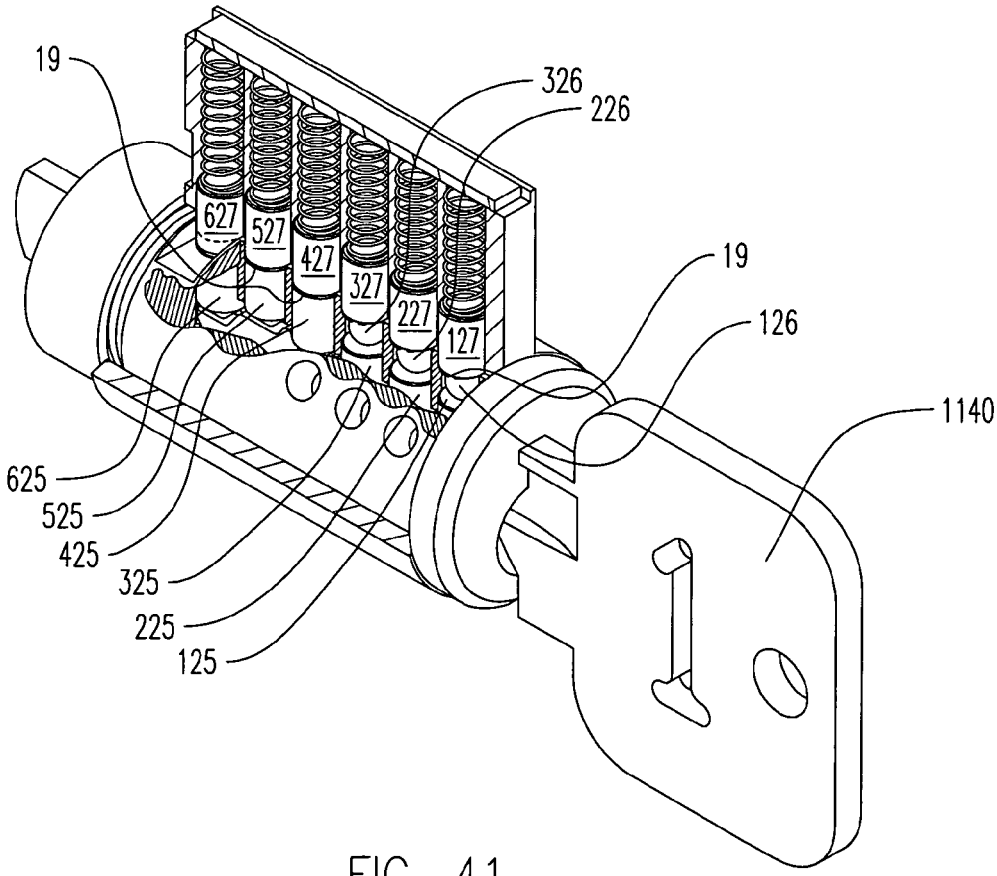
FIG. 41 shows a partially cut-away, perspective view of the programmable lock configured for the first user key, with the first user key inserted.

As described and illustrated herein before, the plug 10 can not be rotated by a user key in the opposite direction because the groove 80 described herein before provides a means for enabling rotation of the plug with a user key toward only one direction, typically to the operator position to unlock the latch or bolt with which the lock is associated. As shown in FIG. 41 when the first user key 1140 is inserted into the keyway, the contour positions 1 through 6 of the key 1140 lift corresponding tumblers 425 and 525 within pin chambers 4 and 5 and raise the bottom end of the corresponding drivers 427 and 527 to the shear line 19. In pin chambers 1, 2, and 3, the corresponding tumblers 125, 225 and 325 lift both the corresponding change balls 126, 226 and 326 and the corresponding drivers 127, 227 and 327, and raise the lower or bottom edge of each of the drivers 127, 227 and 327 to the shear line 19. (It can be seen that the bottom edge of the drivers and the top edge of the tumblers can be slightly beveled to assist aligning the drivers or tumblers with the shear line.) Thus, the lower end of each of the drivers 27 in pin chambers 1 through 6 has been raised to the shear line 19. The main change balls 126, 226 and 326 are retained below the shear line 19 and within the tumbler chambers 113, 213, and 313 of the plug.

In pin chamber 6, the key 1140 lifts tumbler 625 to raise the bottom end of drive 627 to the operating shear line 319. As described herein before, in this position the body of driver 627 spans across the shear surface 19 and confronts the programming shear line 119 formed at the intersection of the tumbler chamber and the plug periphery on the side opposite the groove 80. The positioning of the programming shear line 119 along the length of the driver 627 in FIG. 41 is illustrated by the phantom line 219. As illustrated in the earlier embodiments, the plug 10 cannot be rotated in the opposite or counterclockwise direction, because the programming shear line 119 is spanned by the sixth driver 627 on the side opposite the groove 80.

Figure 42:
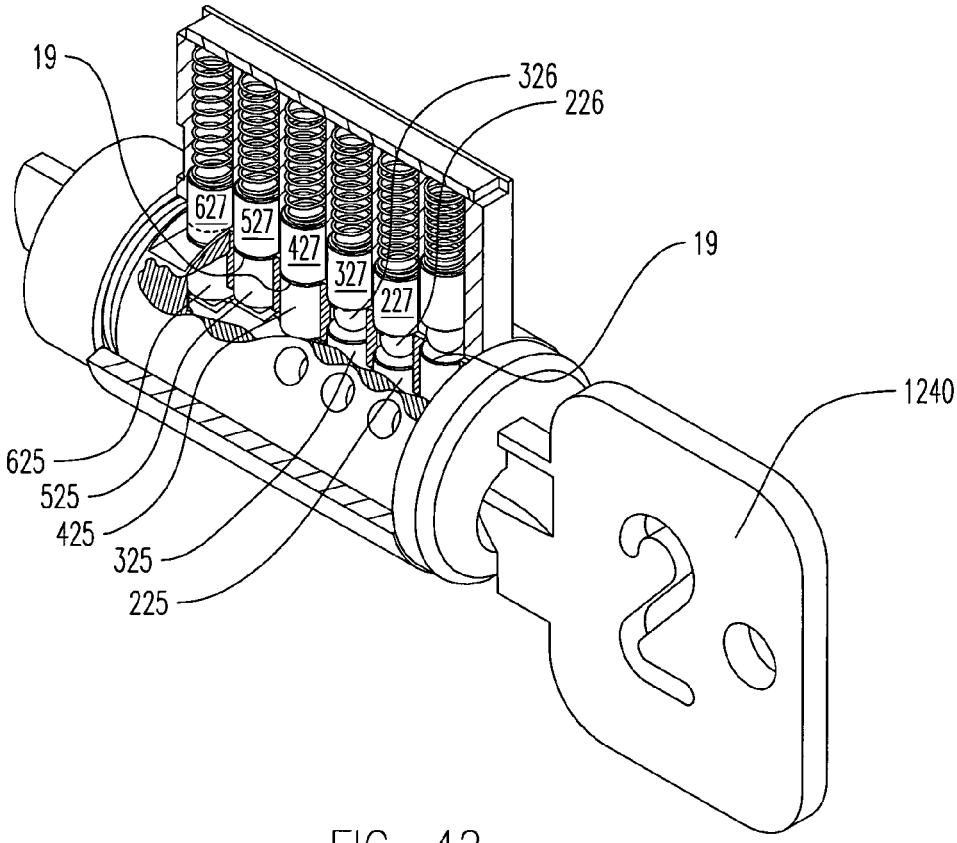
FIG. 42 shows a partially cut-away, perspective view of the programmable lock configured for the first user key, with the second user key inserted.

At some time, the first user key 1140 may be lost, stolen, or misplaced, whereby the security and exclusive use of the lock by the intended user or owner may be compromised. Or, the home or object in which the lock is installed may be sold or transferred to another person. In such case, or at any time desired by the user, the lock can be configured for operation with the succeeding second user key 1240. As shown in FIG. 42, the second user key 1240 is inserted into the keyway of the plug, which is shown configured for operation with the first user key 1140, and has each of the change members 126, 226 and 326 disposed in the respective first, second, and third pin chambers. The raised contour (61*b*) of the first contour position 41 of the second user key 1240 raises the first change ball 126 above the shear line 19 and into the driver chamber 124. As with the preceding user key 1140, the succeeding second user key 1240 raises the lower end of drivers 127, 327, 427, and 527 to the shear line 19, and of driver 627 to the operating shear ling 319. When the second user key 1240 rotates the plug toward the operating position, the first change ball 126 remains captured in the driver chamber 124 until the plug 10 arrives at the programming position, where the plurality of retainer cavities 116, 216 and 316 align with the corresponding driver chambers 24. As the plug 10 approaches and arrives at this programming position, the first change ball 126, biased by the driver spring 128, is driven into the first retainer cavity 116. Though not illustrated, it can be understood that the lock now will not operate with the first user key 1140, since, without the change ball 126 in the first pin chamber, the lowered contour of the first contour position 41 of the first user key 1140 cannot raise the bottom end of the first driver 127 to the shear line 19, whereby the body of the driver 127 would span the shear line and block rotation of the plug within the housing.

Typically, and in the illustrated embodiment, the first change ball 126 can not be removed from the main retainer cavity 116 unless the lock is disassembled, such that its movement to the first retainer cavity is essentially irreversible. In an alternative embodiment, an independent means can be used for displacing the change balls from their retainer cavities and back into the pin chambers, such as a change slot and change tooling as described herein.

Figure 43:
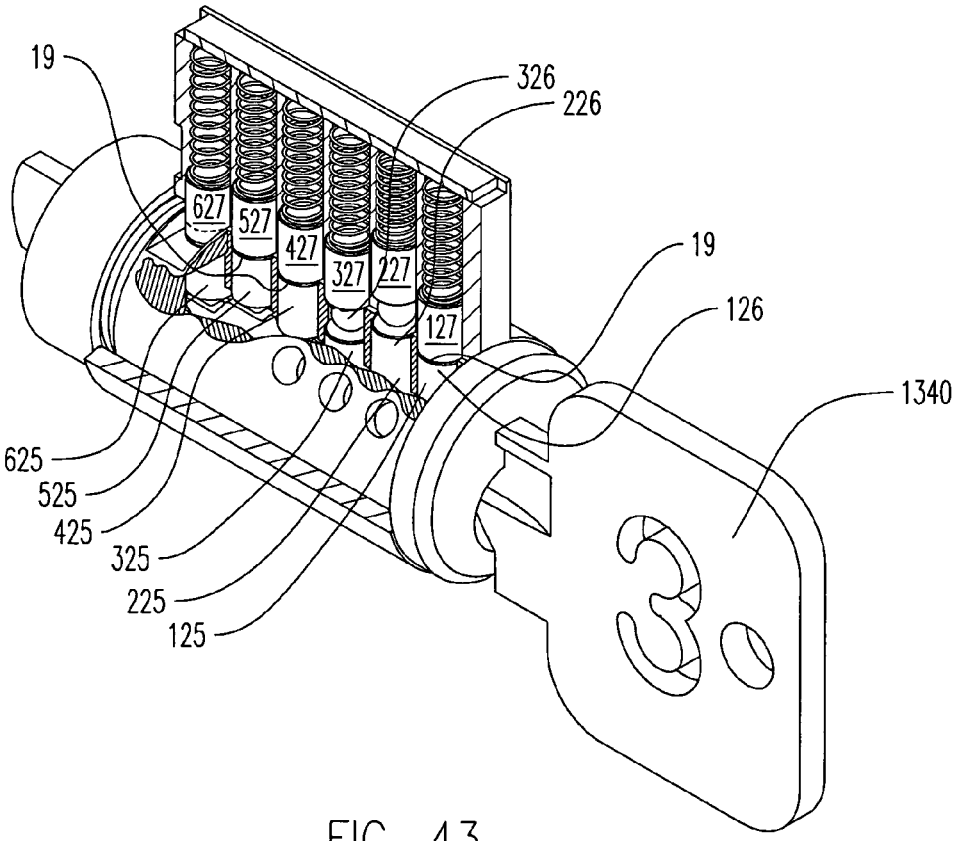
FIG. 43 shows a partially cut-away, perspective view of the programmable lock configured for the second user key, with the third user key inserted.

In a similar way, the lock can be configured for operation with the succeeding third user key 1340. FIG. 43 shows the third user key 1340 inserted into the lock while the lock is configured for operation with the second user key 1240. The third user key 1340 has raised contours 61 in the first 41 and second 42 contour positions. When the succeeding third user key 1340 is inserted into the keyway the raised contours raise the second change ball 226 above the shear line 19 and into its respective driver chamber 224. Upon turning the plug with the third user key 1340, the change ball 226 is then moved from the driver chambers 224 into retainer cavity 216, thereby programming the lock for operation with the third user key 1340 and disabling operation with both the preceding first user key 1140 and the second user key 1240.

In a similar fashion, the lock can be programmed for operation with the fourth user key 1440, which upon inserting and operating the lock, disables operation with all of the first 1140, second 1240, and third 1340 user keys. It can be understood that when the lock is configured for operation with the first user key 1140, the third user key 1340 can be inserted into the plug and the plug rotated to the programming position, thereby moving the change balls 126 and 226 into their respective retainer cavities 116 and 216 and programming the lock configuration for operation with the third user key. The second user key 1240 has been skipped in this case. The first user key 1140 and the second user key 1240 will not operate the lock when configured for the third user key 1340. Thus, the user of any succeeding user key in the series of user keys 40 bypasses operational configurations of the lock for preceding user keys.

A programmable lock assembly of the present invention can also further be configured for operation with a temporary access key, associated with a main user key, for temporarily operating the lock. For the purposes of describing the configuration and operation of the temporary access key, the before-described user keys, retainer cavities, and change members for the first and second embodiments of the programmable locks assembly are referred to as the main user keys, main retainer cavities, and main changing members. The main user key can be configured alternatively to cancel operation of the temporary user key, or to continue allowing operation of the temporary user key, when the main user key is again inserted into and operates the lock. The lock uses a means for positioning a temporary lock configuration change member within the plug of the lock for establishing the temporary lock configuration. Any one, or more, of the remaining pin chambers of a lock assembly can be selected as a temporary pin chamber. In a programmable lock of the present invention, the plug can further comprise at least one temporary retainer cavity formed into the periphery, spaced apart a second distance from the corresponding temporary tumbler chamber associated with the temporary pin chamber, and being aligned with the corresponding temporary driver chamber when the plug is rotated to the temporary programming position, and a temporary change slot intersecting the temporary retainer cavity. The lock also further comprises a temporary change tool configured for manipulation within the change slot, and a temporary lock configuration change member associated with the temporary pin chamber, movable within the lock between a first position within the temporary pin chamber, and a second position within the temporary retainer cavity, and being movable from the second position upon manipulation of the temporary change tool in the temporary change slot. The configuration of this lock embodiment is based upon the positioning of the main change members and of the temporary change member, and wherein the temporary user key can only rotate the plug from the key insertion position toward the operating position when the temporary change member is disposed in the temporary pin chamber. When the temporary change member is positioned in its first position within the temporary pin chamber, the lock is temporarily configured for operation with a temporary user key.

The lock is configured for operation with a main user key when the temporary change member is disposed in the temporary retainer cavity. To configure the lock for operation with the temporary user key, the plug is rotated with a main user key to the temporary programming position, wherein the temporary retainer cavity is aligned with the temporary driver chamber associated with the temporary pin chamber. When a separate or integral temporary change tool is then manipulated within the temporary change slot, a lifting portion on the temporary change tool displaces the temporary change member out of the temporary retainer cavity and into the temporary driver chamber. The temporary change tool or tooling is configured substantially as described herein for a main programmable lock embodiment, though typically only one biasing portion is needed for each temporary retainer cavity. When the plug is rotated back to the key insertion position, and the main user key is removed and change tooling is removed or disengaged, the lock has been programmed for operation with the temporary user key associated with that main user key.

In a typical embodiment, when the main user key for which the lock was configured is then inserted into the keyway and is turned to operate the lock, the temporary change member is moved, automatically and without using any tool, from the temporary pin chamber back to its second position within the temporary retainer cavity, thereby inactivating the temporary user key. Consequently, configuration of the lock for the temporary user key does not change the lock configuration of the main lock configuration change members, and does not affect the operation of the lock by the operable main user key; however, subsequent operation of the lock with the main user key does change the positioning of the temporary change member, by displacing it out of the pin chamber and back into the temporary retainer cavity.

Alternatively, the lock can be configured for operation with a non-canceling main user key that that does not cancel the temporary lock configuration, by preventing the temporary change member from being moved out of the pin chamber and into the temporary retainer cavity. This can be accomplished in one embodiment by providing a mastering shim below the temporary change member in the temporary pin chamber. The tumbler length and/or the contour of the non-canceling main user key at the temporary pin chamber position is configured to raise the mastering shim up with the temporary change member into the driver chamber, whereby the mastering shim blocks passage of the temporary change member into the temporary retainer cavity. In this alternative lock embodiment using a mastering shim, an ordinary or canceling main user key is also provided that cancels the temporary lock configuration, by raising only the temporary change member above the shear line of the plug, with the mastering shim remaining below the hear line within the tumbler chamber.

Figure 45:
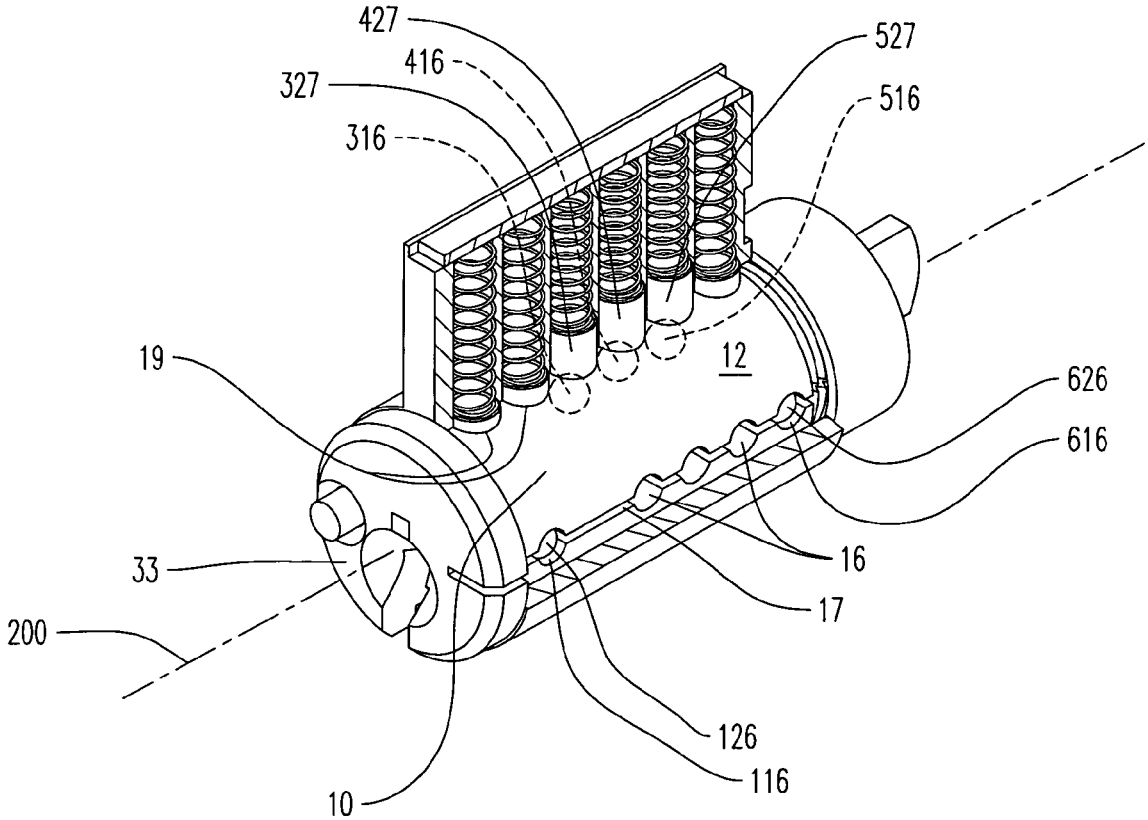
FIG. 45 shows a perspective view of an alternative to the first embodiment of the programmable lock of the present invention, configurable for operation with a temporary access key.
Figure 46:
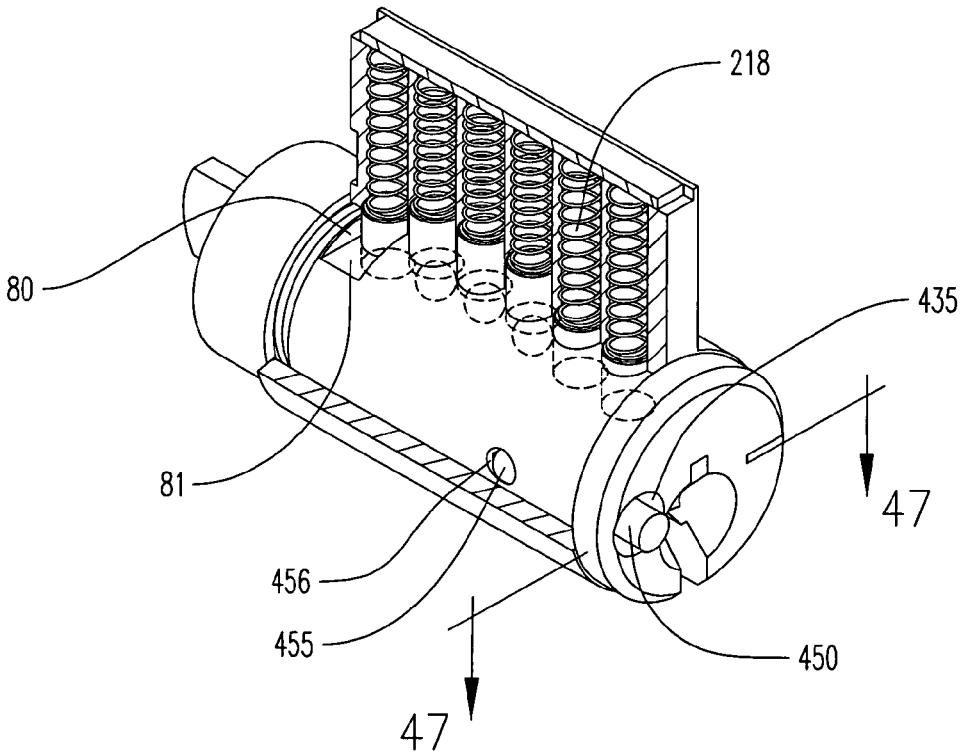
FIG. 46 shows the opposite a perspective view of the lock of FIG. 45.
Figure 47:
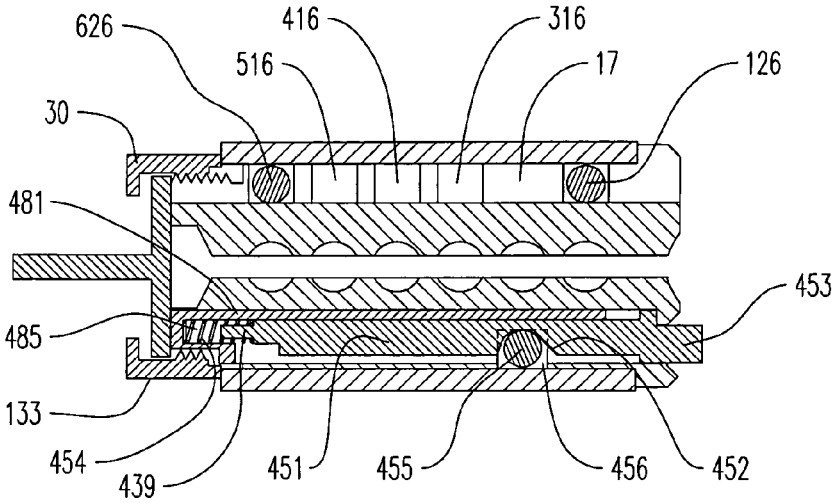
FIG. 47 shows a sectional view of the lock of FIG. 46, taken through line 47-47.
Figure 48:
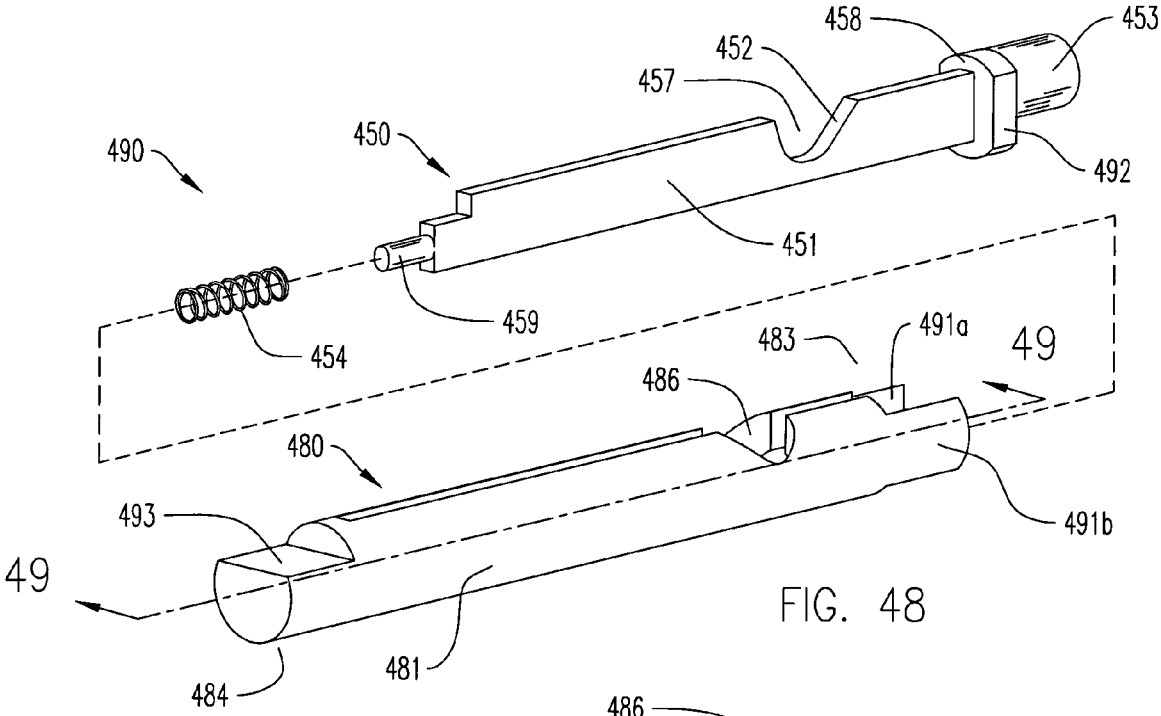
FIG. 48 shows an exploded perspective view of an integral change tool used in the present invention, including a change tool blade, return spring, and slot dowel.
Figure 49:
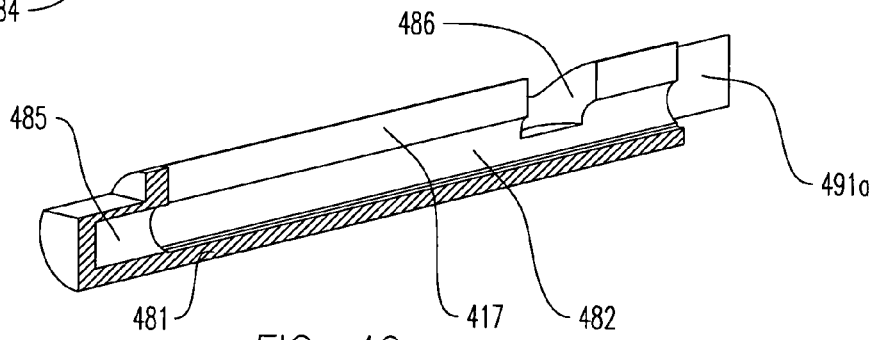
FIG. 49 shows a sectional view of the slot dowel of FIG. 48, taken through line 49-49.

FIG. 45 shows a programmable lock according to the first embodiment, described herein before, which has been modified to provide the second pin chamber as a temporary pin chamber. FIG. 45 shows that the main retainer cavity (that had been shown in FIG. 6 as 216) has been removed. FIG. 46 shows the programmable lock shown in FIG. 45 from the other side, and shows a temporary retainer cavity 456 and a temporary change member 455 associated with the second pin chamber 218, and a change tool 450. As shown in FIGS. 47, 48, and 49, the temporary change tool 450 is an integral change tool having a body 451 that has a cut-out recess 457 that registers with the temporary retainer cavity 456 when the temporary change tool 450 is in a first disengaged position, and a lifting or biasing surface 452 disposed adjacent the recess 457, which can advance into the temporary retainer cavity 456 when the temporary change tool 450 is manipulated into a second engaged position for raising the temporary change ball 455 from the temporary retainer cavity 456. This embodiment of the temporary change tool can have a head 453 that protrudes through an opening in the face 33 of the plug, for manipulating the temporary change tool 450 to its second position. A return spring 454 is disposed on and restrained by rear post 459 of the temporary change tool 450, and biases the change tool blade 451 away from the rearward end 133 of the plug to its first disengaged position. The head 453 of the change tool 450 is typically cylindrical and extends through a similarly-shaped and sized opening 435 formed in the face 33 of the plug 10. The opening 435 can be beveled outward toward the face 33.

The temporary change tool 450 is disposed in a change slot 417 that can be formed or disposed within the plug 10, and is typically parallel to the axial centerline 200. The temporary change slot 417 typically extends from proximate, and the front face 33 and is formed proximate to the temporary retainer cavity 456. In the illustrated embodiment, the temporary change slot 417 is formed beneath the periphery 12, and intersects with the temporary retainer cavity. The width and height of the change slot 417 are configured to accommodate the blade body 451. The radial depth of the change slot 417 is typically the same as the depth of the temporary retainer cavity 456, although it could have a depth slightly less that, or slightly greater. The configuration of the change slot 417 allows the beveled biasing surface 452 of the change tool 450 to move axially, by manipulation within the slot 417, from a first position (shown in FIG. 47) that is disengaged from the temporary change member 455 and out of intersection with the temporary retainer cavity 456, to a second position (shown in FIGS. 51 and 52), (when the plug has been rotated to the temporary programming position) that engages and raises the temporary change member 455 out of the temporary retainer cavity 456 and into the temporary driver chamber 224.

One means for disposing the temporary change tool integrally with the plug is shown in FIGS. 48 and 49 as a change tool assembly 490 consisting of the integral change tool 450, return spring 454, and a slot dowel 480. The slot dowel 480 is shown as a cylindrically formed body having a longitudinal slot 417 formed in the length of the slot body 481 from the front end 483 to proximate the rear end 484. A circular counter bore 482 is also formed in the length of the slot body and overlaps the slot 417 and forms a capture hole 485 for the return spring 454 near the rear end 484. A vertical bore 486 is formed intermediate the length of the slot 417 to register with the recess 457 in the change tool body 451 in its first disengage position and with the retainer cavity 456 formed in the periphery 12 of the plug.

The integral change tool 450 can be assembled separately, and installed into the plug. The return spring 454 is slid over the rear post 459, and the assembled spring 454 and change tool 450 are then slid rear-end first, fully into the slot 417 and counter bore 482, to form the change tool assembly 490. A longitudinal bore of substantially the same diameter as the slot dowel body 481 is machined parallel to the centerline of the plug just below the periphery 12 and intersecting the temporary retainer cavity 456. The change tool assembly 490 is then inserted front-end first into the longitudinal bore until the head 453 penetrates through the opening 435 in the face 33 of the plug. The threaded cap 30 then secures the change tool assembly. The off-set of the head 453 from the center of the shoulder 458 prevents the change tool 450 from rotating, while the mating of the prongs 491*a* and 491*b* of the dowel body 481 with the flats 492 on the shoulder 458 prevents the slot dowel 480 with slot 417 from rotating within the plug.

The above means of making the temporary change tool can be used for making a main change tool 50 as shown in FIG. 31 and described herein before, by forming additional biasing surfaces 452 and vertical bores 486 into the change tool body 451 and slot dowel body 481 respectfully.

In alternative embodiments, the depressable (or conversely pullable) end of the elongated temporary change tool can be configured proximate the rear end or face of the lock, for manipulation of the change tool from the rear of the plug. The temporary change tooling can also be configured wherein the protruding end of the change tool is pulled in order to manipulate it between its first and second positions. In another embodiment, the temporary change tooling can have an engagement member in place of the protruding head, disposed inboard the front end of the plug, and exposed through the opening 435 in the plug face. An implement, such as the pin or staff, can be inserted through the opening to depress the engagement member for manipulating the change tooling. Typically the temporary change tool is manipulated with a finger or hand, or an implement such as a pin, to move the elongated change tool rearwardly (or conversely forwardly).

Figure 50:
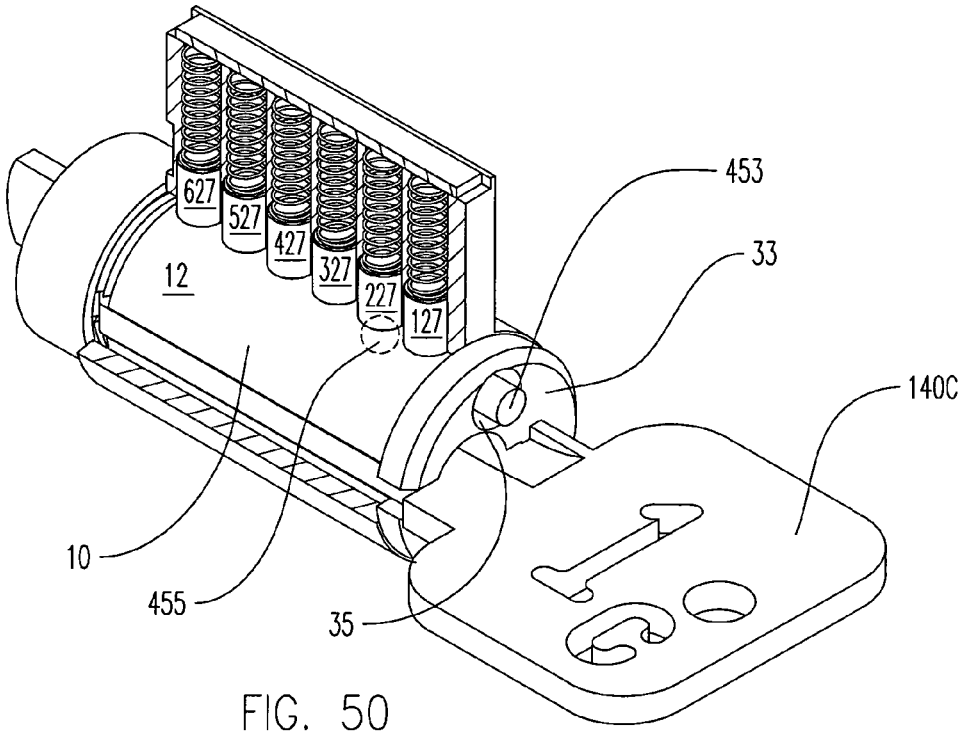
FIG. 50 shows a perspective view of the alternative lock embodiment of FIG. 45, with a canceling user key inserted.
Figure 52:
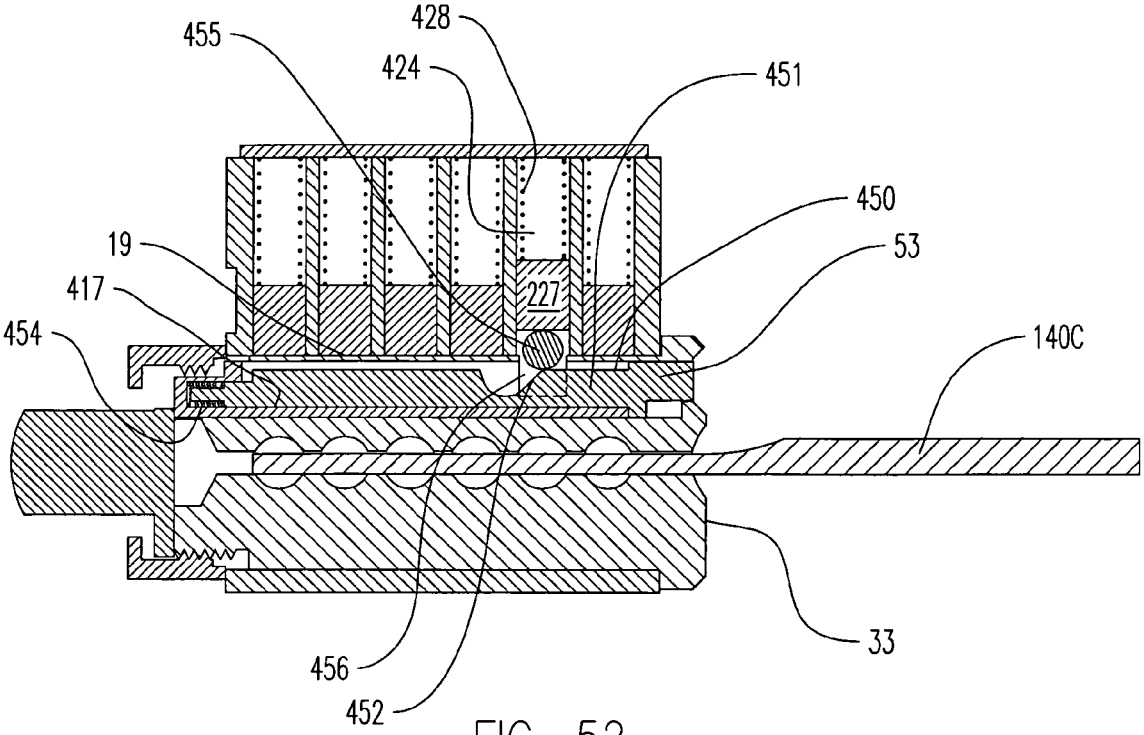
FIG. 52 shows a sectional view of the alternative lock embodiment of FIG. 51, taken through line 52-52.
Figure 53:
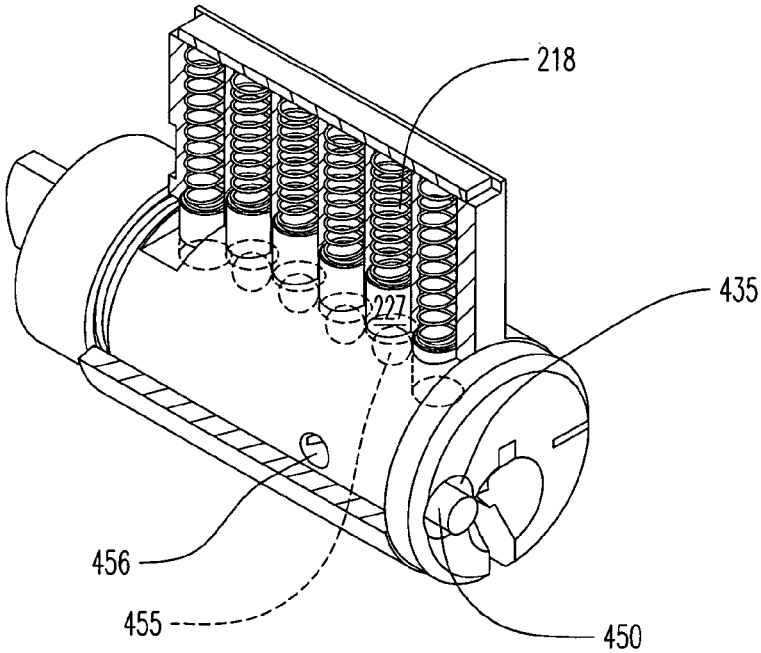
FIG. 53 shows a perspective view of the alternative lock embodiment of FIG. 46, configured for operation with a temporary access key.
Figure 54:
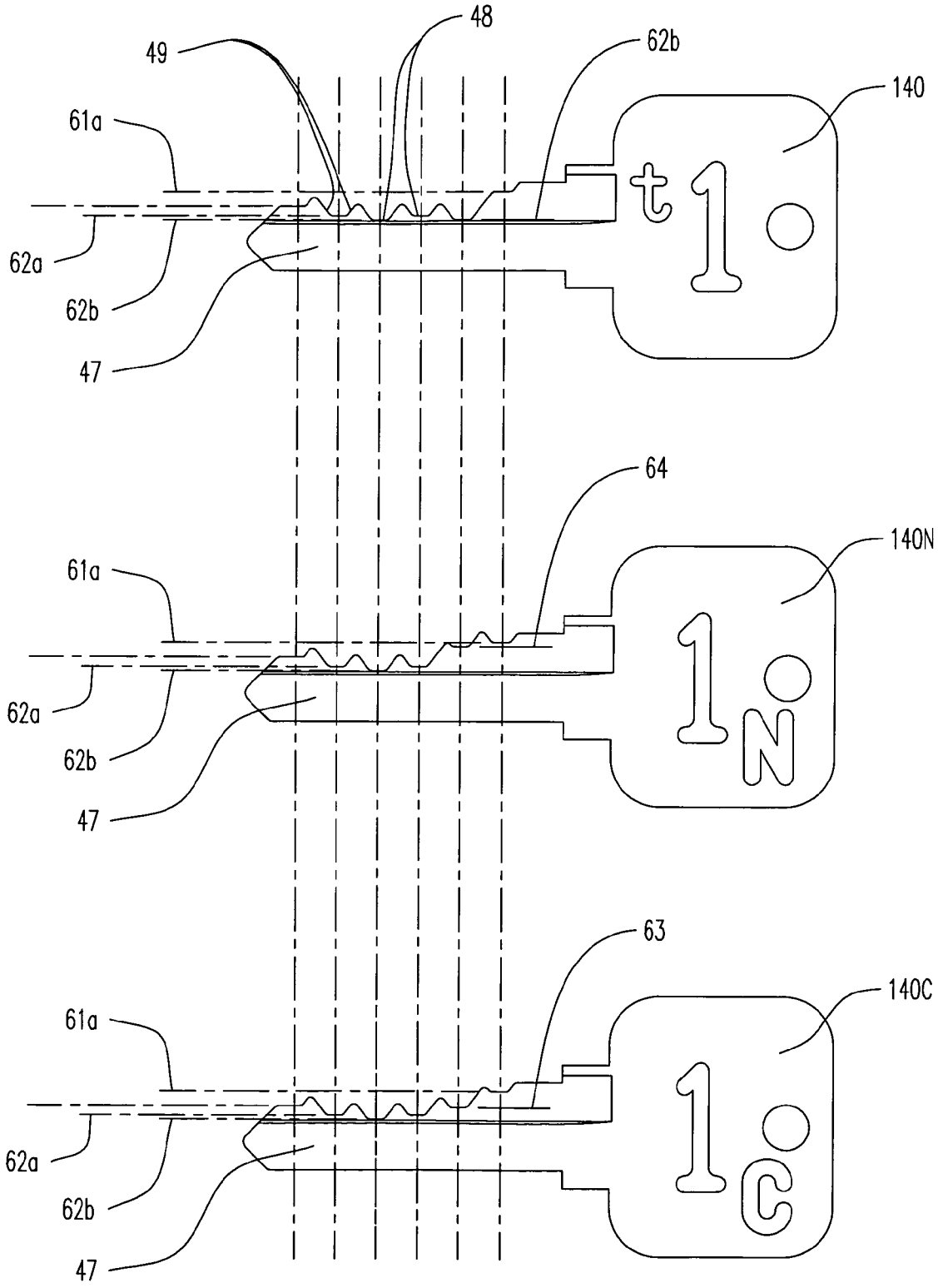
FIG. 54 shows a set of keys associated with the alternative lock embodiment, including a temporary access key, a canceling user key and a non-canceling user key.

FIGS. 50 through 56 show reprogramming of the lock for operation with a temporary user key 140*t* associated with the first main user key 140. FIG. 50 shows the plug 10 after a first main user key 140C has been inserted and the plug rotated to the second or operating position. The first user key 140C, shown in FIG. 54 is a canceling main user key, as explained later. At this position, the temporary retainer cavity is also aligned with the temporary driver chamber, whereby the position of the plug is also termed the temporary programming position. It can be understood that the temporary retainer cavity can be positioned circumferentially closer to the main tumbler chambers, whereby less rotation of the plug within the housing would align the temporary retainer cavity with the temporary driver chamber. The temporary change ball 455 is positioned within the temporary retainer cavity 456 beneath the temporary driver chamber 224, and the temporary change tool 450 is in its first position in the slot 417, disengaged from the temporary change ball 455, with the head 453 protruding through the opening 435 in the face of the plug 10.

Figure 51:
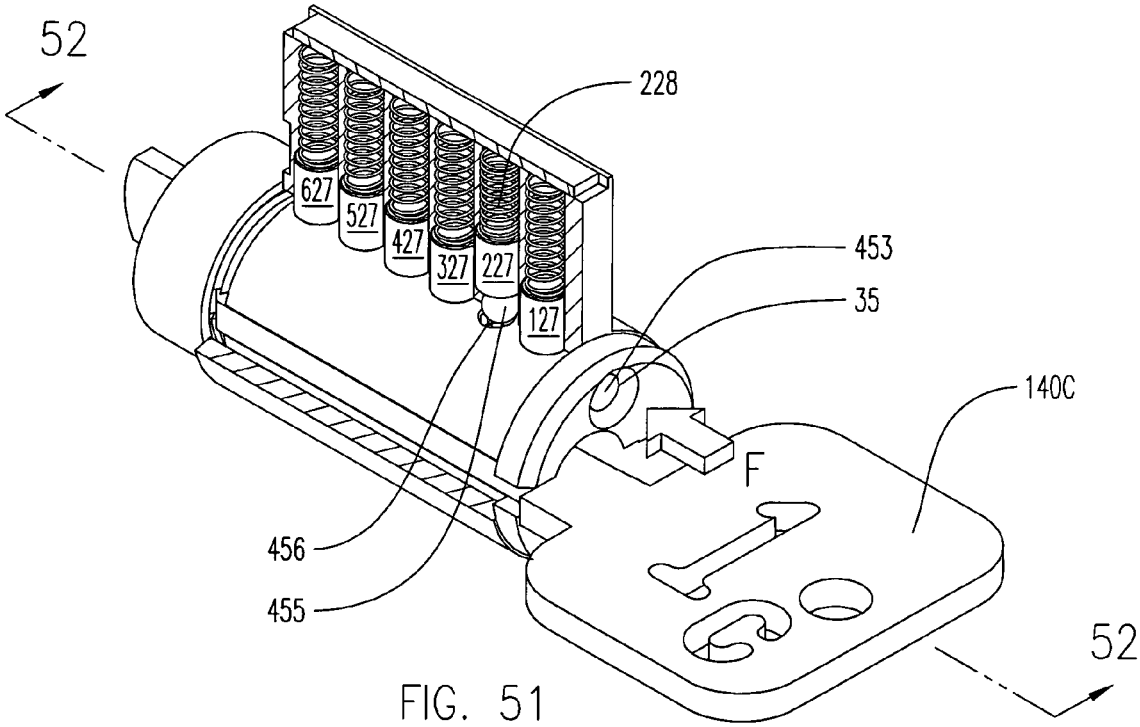
FIG. 51 shows a perspective view of the alternative lock embodiment of FIG. 50, with the change tooling engaged.

FIG. 51 shows that the temporary change tool 450 has been manipulated by pushing inward to its second position, as shown in FIG. 52 where the biasing surface 452 of the integral change tool 450 displaces the temporary change ball 455 out of the temporary retainer cavity 456. With the change tool 50 fully inserted to its second engaged position, the temporary change ball 455 has been moved and isolated into the driver chamber 224 of the second pin chamber between the driver 427 and the periphery 12 of the plug.

When the plug is rotated back to its key insertion position and the user key 140C removed, the temporary change ball 455 is positioned in its first position within the second pin chamber, between the tumbler 225 and the driver 227, and the lock is configured for temporary operation with temporary first user key 140*t* as shown in FIG. 53.

Figure 55:
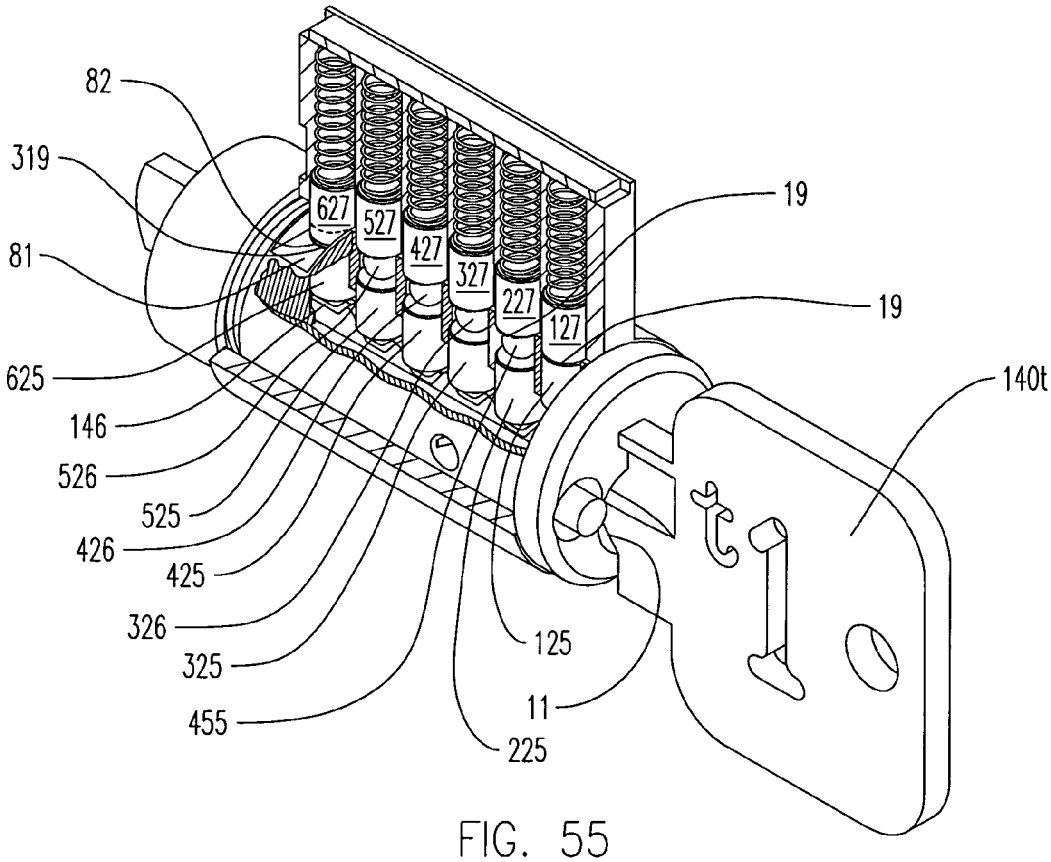
FIG. 55 shows a perspective view of the alternative lock embodiment of FIG. 53, with a temporary access key inserted.

FIG. 55 shows the lock with the temporary first user key 140*t* inserted into the keyway. As shown in FIG. 54, temporary first user key 140*t* has a lowered contour at the second position 42. The lowered contours of contour positions 2 through 5 raise the tumblers 25, main change balls 26, the temporary change ball 455, and drivers 27, so that the bottom end of the drivers 227, 327, 427 and 527 align with the shear line 19. The main change balls 326, 426 and 526 and the temporary change ball 455 remain in the tumbler chambers, below the shear line 19. As the plug 10 is rotated with the inserted temporary first key 140*t* toward the operating position, the main change balls 326, 426 and 526 and the temporary change ball 455 remain in the tumbler chambers of the plug.

When the temporary use of temporary user key 140*t* is deemed finished, the lock in the illustrated embodiment can automatically be reconfigured to cancel or disable operation of the temporary user key 140*t*, and to restore operation to the first main user key 140C, termed a canceling user key. As shown in FIG. 54 the raised contour of the second contour position 42 of key 140C raises the temporary change ball 455 above the shear line 19 and at least halfway into the driver chamber 224. When the plug is rotated to the temporary programming position, the temporary change ball 455 becomes isolated in the driver chamber 224 and deposited into the temporary retainer cavity 456. The lock has thus been restored to a configuration that allows operation with the first main user key 140C but that does not allow further operation with the first temporary user key 140*t*.

Figure 56:
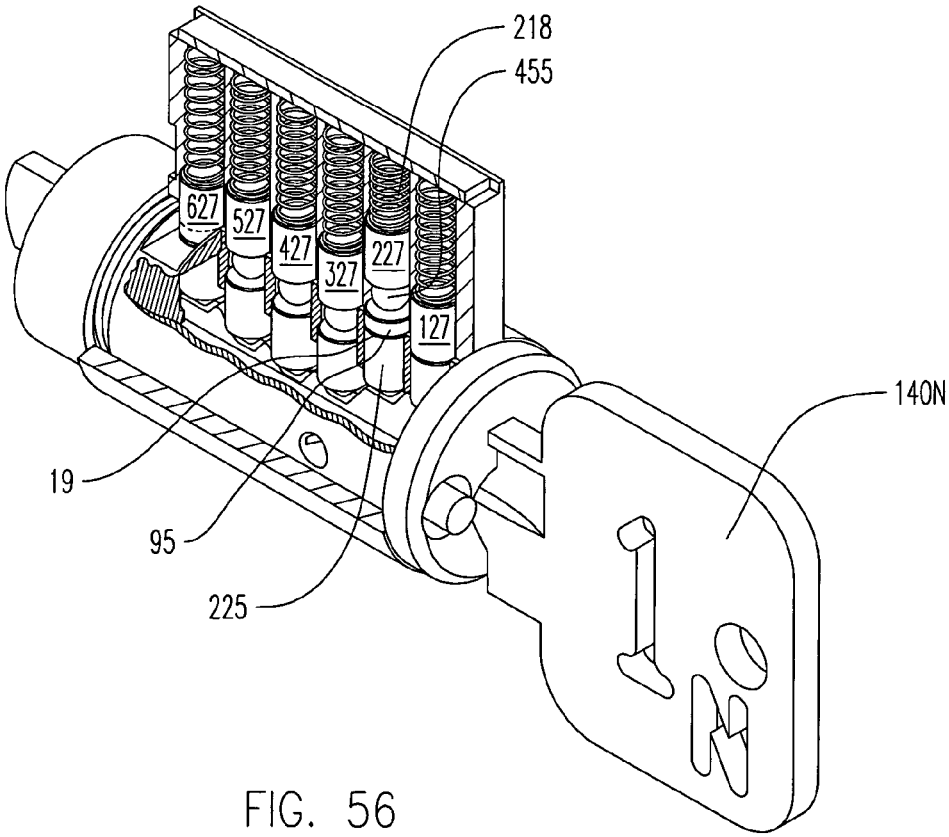
FIG. 56 shows a perspective view of the alternative lock embodiment of FIG. 53, with a non-canceling user key inserted.

In an alternative embodiment, a non-canceling main user key can be used to operate the lock while the lock is in the temporary lock configuration, without moving the temporary change member back to the temporary retainer cavity. FIG. 56 shows an embodiment where a mastering shim 95 is disposed below the temporary change ball 455 in the temporary pin chamber 218. Non-canceling first main user key 140N, shown in FIG. 54, has a second contour position 42 that has an upper contour 64 that is higher (shallower cut, by the depth of the mastering shim 95) than the contour 63 of the ordinary or canceling first main user key 140C. The higher contour 64 enables the non-canceling first main user key 140N to raise the mastering shim 95 above the shear line 19 and into the driver chamber 224, whereas the lower contour 63 of the canceling first user key 140C holds the mastering shim 95 below the shear line. When the plug is rotated with the non-canceling first main user key 140N to the temporary programming position, the mastering shim 95, which is slightly larger in size than the opening to the temporary retainer cavity 456, blocks the temporary change ball 455 from leaving the temporary driver chamber 424. Thus, operation of the lock in the temporary programming configuration with the non-canceling main user key does not cause automatic reprogramming of the lock.

It can be understood that the lock can be reprogrammed for temporary operation with temporary first user key 140*t* as many times as the user desires. Each time, the temporary configuration of the lock can be cancelled by reinserting the operable first main user key 140C and rotating the plug of the lock to the operating position, which moves, solely by rotation of the plug, the temporary change ball from its first position in the temporary pin chamber, back into its second position in the temporary retainer cavity. In a similar manner, a second temporary user key (not shown) can be provided to operate the lock when configured for temporary operation with the operable second main user key 240. The second temporary user key would have a contour similar to that of the second main user key 240, except that the second contour position 42 would be a lower contour 62*a*, 62*b*.

In alternative embodiments of the present invention, the lock can be provided with a means for signaling to the user that the key and plug are in the key insertion position and/or in the programming position. A typical plug positioning means is a detent and pin, which is disclosed in co-pending U.S. patent application Ser. No. 11/178,627, filed Jul. 11, 2005, the relevant disclosures therein being incorporated herein by reference.

The present invention also relates to a method of making the changeable lock. In a first method of making a changeable lock plug, a standard lock plug is provided and machined. This step typically comprises disassembling an existing standard lock, by removing the plug from the lock housing, and removing the hardware, such as springs and pins (the drivers, tumblers and any master shims) from the lock plug, thereby recovering the standard lock plug.

The standard lock plug has a keyway, an axial centerline and a cylindrical, peripheral surface. The standard lock plug further has a plurality of tumbler chambers 13 extending through the peripheral surface along a first line extending parallel to the axial centerline. Each tumbler chamber extends into the keyway and has a centerline that is spaced apart by a first distance from an adjacent tumbler chamber. Typically adjacent tumbler chambers are separated by the same first distance.

In the next step, the standard lock plug is machined to provide a plurality of retainer cavities 16 into the standard lock plug. The retainer cavities are formed through the peripheral surface along a second line extending parallel to the axial centerline, and hence parallel to the line of the tumbler chambers 13. Each retainer cavity extends partially into the plug body. The second line is positioned whereby the retainer cavities are displaced radially from the first line of tumbler chambers by an arc angle along the peripheral surface. Typically, the arc angle is about 30° to about 160°, typically about 45° to about 135°, and conveniently about 90°, offset from the first line in a first rotational direction.

In a typical embodiment, the retainer cavities are machined to a depth into the plug body of at least its diameter, more typically at least 105% of its diameter. Typical retainer cavity diameters are from about 0.050 inches (about 1.3 mm) to 0.090 inches (about 2.3 mm), and are typically of a size, or diameter, less than the diameter of the driver positioned within the driver chambers of the housing. More typically, the diameter of the retainer cavities are drilled to a diameter of about 95% and less than the size (diameter) of the driver. Typically, the retainer cavities are formed with a standard drilling machine.

In a next step, a slot is cut along the axial direction, typically in the outer peripheral surface of the plug, along the same line as the retainer cavities. The slot is illustrated as the change slot 17 in the embodiments. The slot is generally formed as a "U"-shaped or rectangular cross section, penetrating the peripheral surface of the plug and extending radially inward toward the center axis. The slot is typically formed having a depth of approximately the same depth as the retainer cavities, and having a width of about 0.04 inches (1.0 mm) or less, and more typically of about 0.02 inches (0.5 mm) or less. The slot typically extends longitudinally completely from the front face of the plug to the latch end of the plug, passing through the centers of each retainer cavity. The slot can be cut by any well known means, such as a circular saw.

In a final step, a ramp 81 is machined into the plug. The plug is secured with the tumbler chambers arranged vertically. A small-diameter saw having a width of slightly greater than the diameter of a tumbler, is used to machine a flat, horizontal ramp. Referring to FIG. 5, the ramp 81 extends from a descending point 83 at the periphery of the plug toward an intermediate point of the sixth tumbler chamber, and intersects the bore of the tumbler chamber at edge 82. The width of the ramp 81 is typically wider than the diameter of the driver 627.

After forming the retainer cavities, the ramp, and the slot, the lock is then reassembled by reinstalling the drivers, tumblers, springs, and change balls in a programmed arrangement. The change ball is typically a spherical change ball, sized to fit within the depth of the retainer cavity, as described herein above.

In a typical method, the plug body is secured, such as by clamps, for rotational movement about its center axis. The plug is first secured in a first position whereby the tumbler chambers register with a reference point. The reference point is registered with a drilling machine. The drilling machine operates a drilling bit that is rotated at a cutting speed, and can move the drilling bit along the axis of the drill bit from a first position outside the plug surface to a second position that penetrates a depth into the plug. The plug is then rotated about its axis to a second position, which is offset radially from the first position by the arc angle. The drilling machine is then operated to drill the retainer cavity to its depth. The drilling machine is also configured for movement along the longitudinal axis of the plug, whereby successing retainer cavities can be drilled along the second line of the plug to form the plurality of retainer cavities. More typically, the drilling machine comprises a plurality of drilling bits that are configured spaced apart, whereby the plurality of retainer cavities can be machined simultaneously.

In a second method of making a changeable lock plug, a base lock plug is provided and machined. The base plug is typically a cylindrical body configured with a keyway. In this method, both the tumbler chambers, the programming ramp, the retainer cavities, and the change slot, are machined into the peripheral surface of the plug body. The plurality of tumbler chambers are machined, typically by a drilling machine, through the peripheral surface along a first line extending parallel to the axial centerline, wherein each tumbler chamber extends into the keyway. Typically, the tumbler chambers penetrate the plug surface at a position opposite (180°) from the base of the keyway. The plurality of retainer cavities are then machined through the circumferential surface along a second line as described above for the first method.

In a typical method, the base plug body is secured, such as by clamps, for rotational movement about its center axis. The base plug is first secured in a first position whereby a drilling machine registers with a reference point representing the axial centerline of a first retainer cavity. The drilling machine operates a drilling bit that is rotated at a cutting speed, and can move the drilling bit along the axis of the drill bit from a first position outside the plug surface to a second position that penetrates a depth into the plug. The drilling machine is configured for operation to drill the first tumbler chamber through the peripheral surface of the plug and into the keyway. The drilling machine is then moved along the longitudinal axis of the plug to a next position, corresponding to the axial centerline of the second tumbler chamber. The drilling machine is again operated to drill the second tumbler chamber. Successing tumbler chambers can thus be machined. Alternatively, the drilling machine can comprise a plurality of drilling bits that are configured spaced apart, whereby all required retainer cavities can be machined simultaneously along the first line.

While the plug is secured in a first position, the programming ramp is then machined as described above.

The plug is then rotated about its axis to a second position, which is offset radially from the first position by the arc angle. The drilling machine is then operated to drill each retainer cavity to its depth, as described above.

Alternatively, separate drilling machines can machine the set of tumbler chambers and retainer cavities into the base plug, sequentially or simultaneously, without requiring rotational movement of the plug body.

A change slot is also formed along the second line, passing through the plurality of retainer cavities. The change slot is typically secured in place and machined with a rotating saw. The step of forming the change slot can be performed while the plug is in the same position as for the drilling of the retainer cavities.

The embodiments of a programmable lock assembly can be used in a variety of locking devices. These locking devices include both commercial and residential locks, and include by example, knob locks, deadbolt locks, and padlocks. The operation of a typical knob lock can include the use of the operable key both to unlock and lock the door knob by turning a latch that is secured to the latch end of the plug, or to provide only for unlocking of the latch. In the later embodiment, the latch typically unlocks the door knob, which can then turn or rotate by hand, and thereby operate an elongated bolt that engages and disengages the jamb of the door or other object that is being locked. The operation of a typical dead-bolt lock includes the use of the operable key to unlock and rotate a latch that drives an elongated bolt to engage and disengage the jamb of the door or other object that is being locked. These locks are well-known to one skilled in the art.

Figure 57:
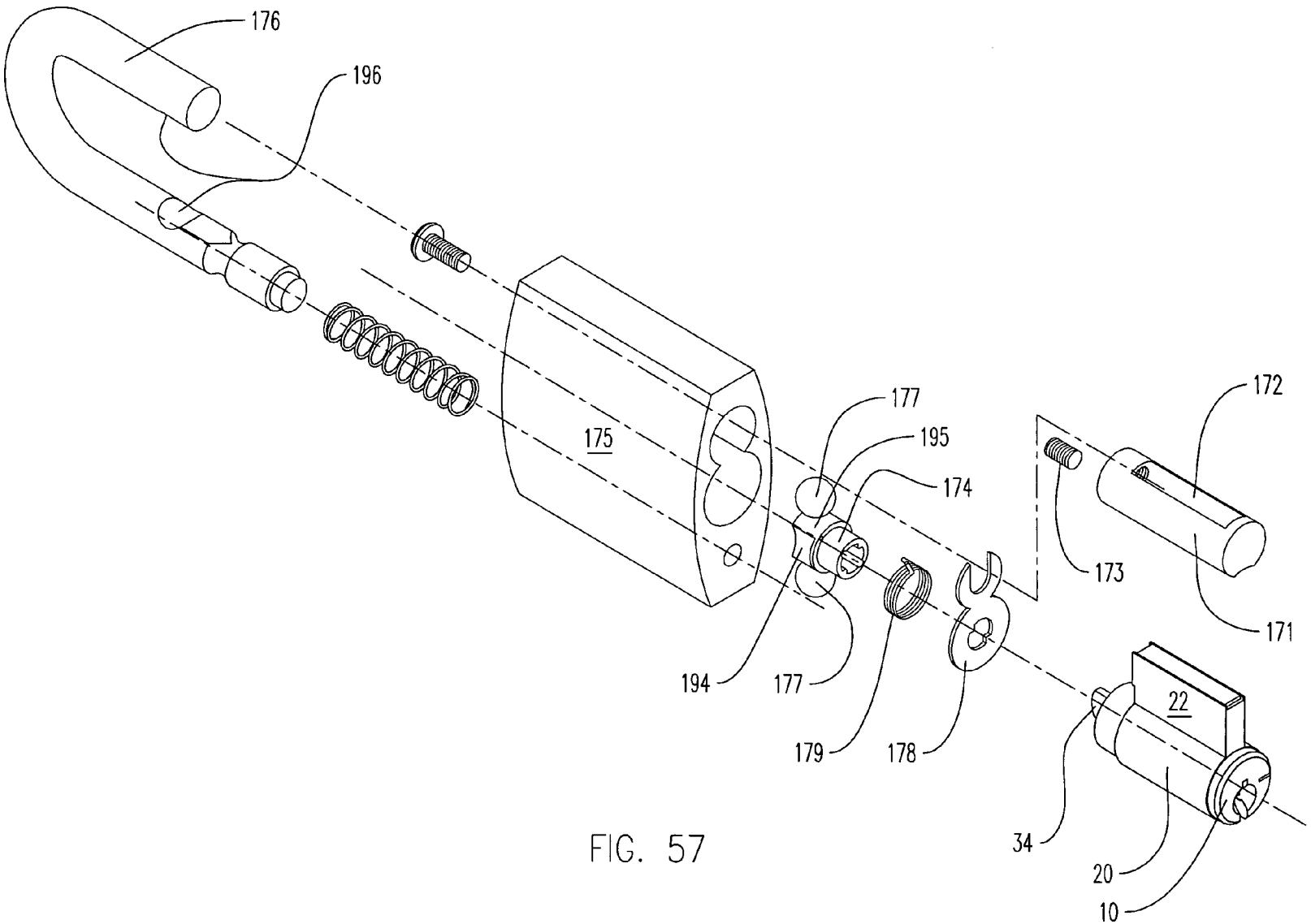
FIG. 57 shows an exploded, perspective view of another embodiment of the programmable lock, used in a padlock.

In another embodiment of the present invention, a unidirectional, programmable lock assembly described herein can be used in a padlock, as shown in FIG. 57. The design and operation of a typical padlock is described in U.S. Pat. No. 3,710,603 (Miller) and U.S. Pat. No. 4,776,187 (Evans et al), both incorporated herein by reference. In FIG. 57, a slotted cap 71 is positioned whereby the stack portion 22 of the housing is inserted through the slot 72. A retaining screw 73 holds the lock 1 in place with the cap 71. The secured assembly of the lock 1 with the slotted cap 71 is then inserted into the body 75 of the padlock along with other conventional components. The operation of padlock includes the use of the operable user key 40 to unlock a J-shaped shackle 76. In a typical padlock configured in a locked position, a pair of locking ball 77 are biased into a position within a cavity 78 in each leg of the shackle 76, to positively restrain the shackle from withdrawing from the body 75. In a closed configuration, an adaptor 74 having opposed raised sides 94 and opposed cavities 96, is positioned with the locking balls 77 urged by the raised sides 95 into engagement with the cavities 78 of the shackles. The padlock is typically configured whereby the rotation of the user key (not shown, but for example, the first user key 140) within the plug 10 causes the latch 34 to rotate the adaptor 74 to an unlock position, whereby the locking balls retreat from engagement with the cavities 78 of the shackles and into the cavities 96 of the adaptor 74, thereby allowing the shackle 76 to withdraw from the body 75 by the biasing force of compressed spring 70. The inserted user key, as described herein above, will only rotate in one direction to unlock the shackle 76. The padlock is typically relocked manually. The padlock is typically provided with a rotation limiting means, such as the clip 78, and a spring 79 or other means for biasing the plug 10 and the user key back toward its initial or "key-insertion" position.

Programming of the lock 1 of the padlock can be made without disassembling the padlock, or the lock 1 itself, and without unlatching the shackle 76. As described herein above, operation of the padlock of the present invention with a programming key 540 allows the plug 10 to be rotated into its third rotated position or programming position shown in FIG. 15 within the housing 20, wherein the retainer cavities and change slot align or register with the driver chambers. The lock configuration of the padlock can be reprogrammed using a change tool or change tooling to operate with a different user key of a subset of user keys, as described herein before.

Figure 58:
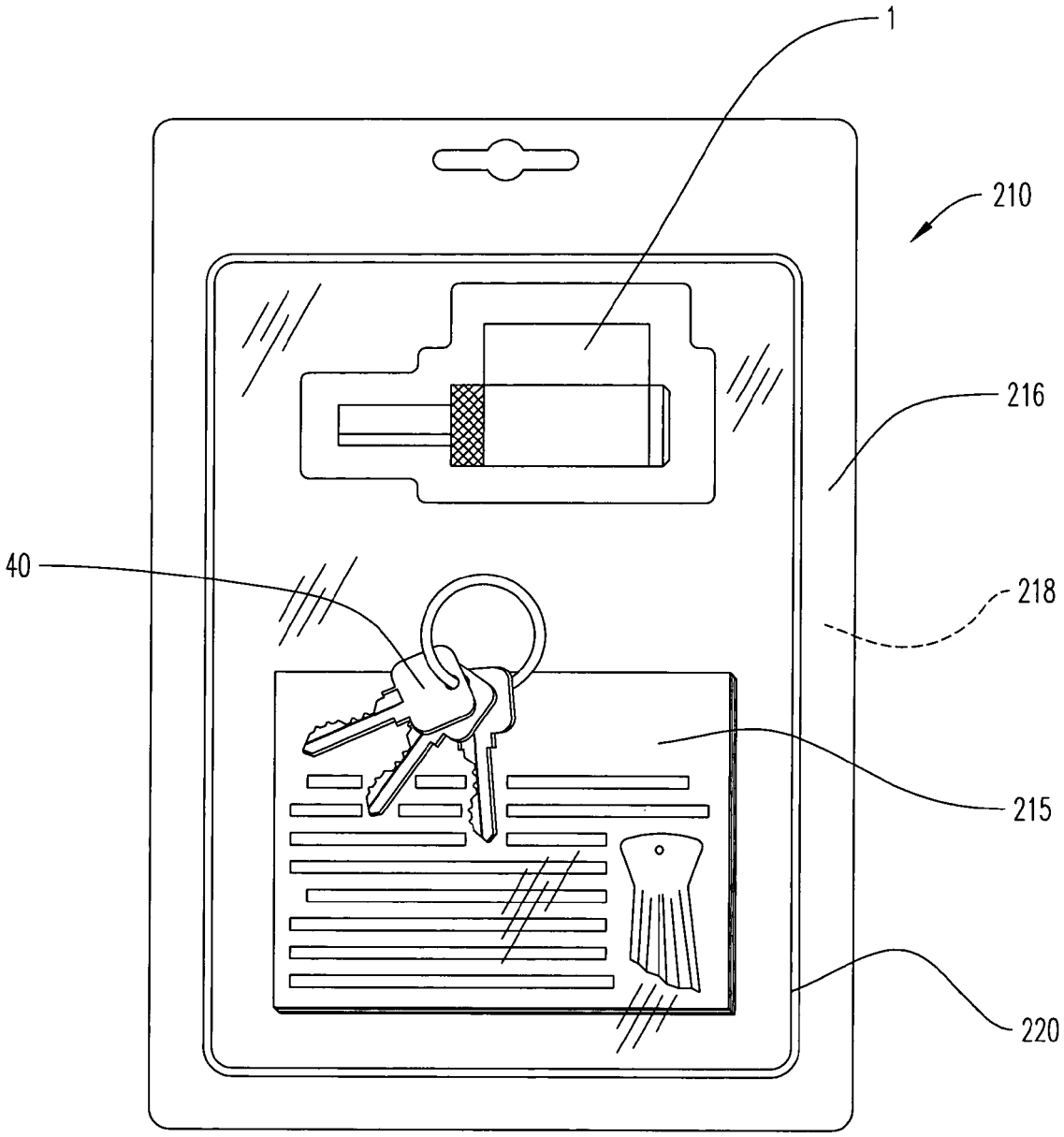
FIG. 58 shows a kit including a set of keys, a programmable lock assembly and instructions for use.

The invention also relates to a convenient lock kit. As shown in FIG. 58, the kit includes a set of keys 40 as described herein, a programmable lock assembly 1 described herein, instructions 215 for use, and a means for securing the keys, lock assembly, an optional change tool (in an embodiment using an separate, external change tool), and the instructions. The means for securing can comprise a crimp 220 formed between confronting front 216 and rear 218 sheets of transparent, resilient thermoplastic film. The securement means that also comprise other forms of shrink-wrap plastic film, a plastic bag, and a lidded plastic container. The kit comprises at least two user keys, and as many as ten user keys, depending upon the lock configurations.

The instructions 215 provide detailed instructions for use of the user keys, the programming key, and any master key that may also be provided. These instructions include illustrations, or written directions, or both for use of the programming key and the change tool to reset the lock for use with a different user key, or to "lockout" all user keys. The instructions are selected from the group consisting of written instructions, pictorial instructions, audio instructions, video instructions, and mixtures thereof. Typically instructions include a combination of written instructions and pictorial instructions, in the form of an instruction sheet or card. The instructions can also include an audio/video tape or DVD, which includes a video demonstration of operation of the lock with the user keys, programming key and change tool, and any master key, in combination with oral instructions. Another example of an instruction includes a digital file that can be provided on permanent or semi-permanent digital recording media, such as a CD-ROM or a floppy disk, or can be downloaded from the Internet, and presented by displaying the digital file on a digital file player such as a computer having a video monitor and audio speakers.

While the invention has been disclosed by reference to the details of preferred embodiments of the invention, it is to be understood that the disclosure is intended in an illustrative rather than in a limiting sense, as it is contemplated that modifications will readily occur to those skilled in the art, within the spirit of the invention and the scope of the appended claims.

I claim:

1. A programmable lock assembly that can be reconfigured to operate with a different user key selected from a set of keys, without disassembling the lock, comprising:

a) the set of keys comprising a plurality of user keys comprising a first user key having a first contour edge and a second user key having a second contour edge, wherein the first contour edge and the second contour edge each have at least a first contour position and a second contour position that are differently configured, and a programming key;

b) a housing having a cylindrical bore with an inner surface and a plurality of driver chambers intersecting the inner surface;

c) a plurality of drivers, each driver being movable within one of the plurality of driver chambers and being urged toward the inner surface; and d) a plug having a cylindrical periphery and rotatably mounted within the bore so as to form a shear surface at the interface of the inner surface and the plug periphery, the plug being rotatable from a key insertion position in a first direction to an operating position, and in a second direction to a programming position, the plug comprising:

1) a keyway configured to receive a key from the set of keys;

2) a plurality of tumbler chambers intersecting with and having a length extending between the plug periphery and the keyway, each tumbler chamber being aligned with a corresponding one of the plurality of driver chambers when the plug is at the key insertion position, so as to form a plurality of pin chambers, and wherein at least one of the plurality of tumbler chambers is a programming tumbler chamber having a first side and an opposed second side;

3) at least one retainer cavity formed into the periphery, the retainer cavity being spaced apart from a corresponding one of the plurality of tumbler chambers, and aligned with a corresponding one of the plurality of driver chambers when the plug is at the programming position, said corresponding tumbler chamber and said corresponding driver chamber forming a change pin chamber when the plug is at the key insertion position;

4) a first means that cooperates with the contour edge of one of the plurality of user keys for enabling rotation of the plug with said one user key when inserted into the keyway and rotated in the first direction to the operating position; and 5) a second means that cooperates with the contour edge of said one user key for preventing rotation of the plug in the second direction to the programming position with said one user key when inserted into the keyway, and that cooperates with the contour edge of the programming key for allowing rotation of the plug with the programming key when inserted into the keyway and rotated in the second direction to the programming position;

e) a plurality of tumblers, each tumbler being movable within a corresponding one of the plurality of tumbler chambers;

f) at least one lock configuration change member, the change member being associated with the change pin chamber, and being movable within the lock between a first position within the change pin chamber, and a second position within the at least one retainer cavity; and g) a third means for moving the at least one change member from the second position disposed within the at least one retainer cavity to the first position within the change pin chamber when the lock is in the programming position.

2. The programmable lock assembly according to claim 1 wherein the third means for moving the at least one change member from the second position to the first position comprises a change slot formed in the plug that intersects a portion of the at least one retainer cavity, and a change tool that engages and moves the at least one change member out of the at least one retainer cavity upon manipulation of the change tool in the change slot.

3. The programmable lock assembly according to claim 1 wherein the first user key operates the lock in a first lock configuration but does not operate the lock in a second lock configuration, wherein the second user key operates the lock in the second lock configuration but does not operate the lock in the first lock configuration.

4. The programmable lock assembly according to claim 1 wherein the first means for enabling rotation of the plug with said one user key to the operating position comprises an operating shear line formed in the plug at an intermediate point along the length and on the first side of the programming tumbler chamber.

5. The programmable lock assembly according to claim 4 wherein the second means for preventing rotation of the plug with said one user key to the programming position comprises a programming shear line disposed along the length of and on the opposite second side of the programming tumbler chamber, and that intersects the driver.

6. The programmable lock assembly according to claim 5 wherein the programming shear line is formed along the shear surface.

7. The programmable lock assembly according to claim 4 wherein the operating shear line comprises the edge of a tapered groove in the periphery of the plug that originates at a descending point in the periphery of the plug that is circumferentially displaced from the programming tumbler chamber, and extends radially inwardly and circumferentially toward the programming tumbler chamber, to intersect the programming tumbler chamber and to form the edge at the intermediate point.

8. The programmable lock assembly according to claim 4 wherein said one user key is configured to raise the tumbler in the programming tumbler chamber whereby an interface selected from either the top of said tumbler or the bottom of the corresponding driver registers with the operating shear line.

9. The programmable lock assembly according to claim 1 being mounted in a padlock.

10. The programmable lock assembly according to claim 2 wherein the change tool comprises an integral change tool.

11. The programmable lock assembly according to claim 1 wherein the at least one change member comprises at least one change ball.

12. The programmable lock assembly according to claim 1 wherein rotation of the plug to the programming position does not operate to unlock a latch.

13. The programmable lock assembly according to claim 2 wherein manipulation of the change tool in the change slot can move the at least one change member out of the at least one retainer cavity.

14. The programmable lock assembly according to claim 1 wherein at least one retainer cavity comprises a plurality of retainer cavities, and the at least one change member comprises a plurality of change members.

15. A programmable lock assembly that can be reconfigured to operate with different keys of a set of user keys, without disassembling the lock, comprising:

a) a housing having a cylindrical bore with an inner surface and a plurality of driver chambers intersecting the inner surface;

b) a plurality of drivers, each driver being movable within one driver chamber and being urged toward the inner surface; and c) a plug having a cylindrical periphery and rotatably mounted within the bore so as to form a shear line at the interface of the inner surface and the plug periphery, the plug being rotatable in a first direction between a key insertion position and an operating position where the lock operates to unlatch, and in a second direction between the key insertion position and a programming position, the plug further having:

1) a keyway configured to receive a key selected from a set of keys;

2) a plurality of tumbler chambers intersecting the plug periphery and the keyway, each tumbler chamber being aligned with one of the plurality of driver chambers when the plug is at the key insertion positions so as to form a plurality of pin chambers, and wherein at least one of the plurality of tumbler chambers is a programming tumbler chamber;

3) at least one retainer cavity formed into the periphery, the retainer cavity being spaced apart from a corresponding one of the plurality of tumbler chambers and aligned with a corresponding one of the plurality of driver chambers when the plug is at the programming position, said corresponding tumbler chamber and said corresponding driver chamber forming a change pin chamber when the plug is at the key insertion position;

4) a tapered groove associated with the programming tumbler chamber, originating at a descending point in the periphery that is circumferentially displaced from the programming tumbler chamber, and extending radially inwardly and circumferentially to an edge that intersects the programming tumbler chamber to form an operating shear line, and 5) a change slot that intersects a portion of the at least one retainer cavity;

d) a plurality of tumblers, each tumbler being movable within one of the plurality of tumbler chambers;

e) at least one lock configuration change member, the change member being associated with the change pin chamber, and begin movable within the lock between a first position within the change pin chamber between the driver and tumbler, and a second position within the at least one retainer cavity, and being movable from the second position within the at least one retainer cavity upon engagement of a change tool in the change slot when the plug is in the programming position; and f) the set of keys comprising a programming key and a plurality of user keys comprising at least a first user key having a first contour edge and a second user key having a second contour edge, wherein the contour edge of any one of the plurality of user keys cooperates with the tapered groove for enabling rotation of the plug with said user key when inserted into the keyway and rotated in the first direction to the operating position, wherein the first contour edge and the second contour edge each have at least a first contour position and a second contour position that are differently configured, wherein the first user key operates the lock in a first lock configuration but does not operate the lock in a second lock configuration, wherein the second user key operates the lock in the second lock configuration but does not operate the lock in the first lock configuration, and wherein the programming key has a contour edge that is configured to cooperate with the tapered groove when the programming key is inserted into the keyway to rotate the plug in the second direction to the programming position.

16. The programmable lock assembly according to claim 15 wherein, when the lock is configured for use with the first user key and the first user key is inserted in the keyway, the driver associated with the programming tumbler chamber spans a programming shear line, whereby the plug can not be rotated to the programming position, and wherein, when the programming key is inserted in the keyway, the bottom of the driver associated with the programming tumbler chamber registers with the programming shear line, whereby the plug can rotate to the programming position.

17. The programmable lock assembly according to claim 15 being mounted in a padlock.

18. The programmable lock assembly according to claim 15 wherein the change tool comprises an integral change tool.

19. The programmable lock assembly according to claim 15 wherein the at least one change member comprises at least one change ball.

20. The programmable lock assembly according to claim 15, wherein the plurality of user keys are main user keys, wherein at least one of the plurality of tumbler chambers is a temporary tumbler chamber and associates with one of the driver chambers to form a temporary pin chamber wherein the plug further comprises:

6) at least one temporary retainer cavity formed into the periphery, spaced apart a second distance from the corresponding temporary tumbler chamber, and being aligned with the corresponding driver chamber when the plug is rotated to a temporary programming position, and 7) a temporary change slot intersecting the temporary retainer cavity; and the lock assembly further comprises:

g) a temporary change tool configured for manipulation within the temporary change slot, h) a temporary lock configuration change member associated with the temporary pin chamber, movable within the lock between a first position within the temporary pin chamber, and a second position within the at least one temporary retainer cavity, and being movable from the second position upon manipulation of the temporary change tool in the temporary change slot, and i) a temporary user key associated with at least one of the main user keys that can rotate the plug to the operating position;

wherein the temporary user key can only rotate the plug from the key insertion position toward the operating position when the temporary change member is disposed in the temporary pin chamber.

* * * * *

UNITED STATES PATENT AND TRADEMARK OFFICE

CERTIFICATE OF CORRECTION

PATENT NO. : 7,290,418 B2
APPLICATION NO. : 11/192755
DATED : November 6, 2007
INVENTOR(S) : Rodrick A. Herdman It is certified that error appears in the above-identified patent and that said Letters Patent is hereby corrected as shown below:

*Claim 15, c) 2), line 18, delete "positions". Insert --position,--.*

*Claim 15, e), line 43, delete "begin". Insert --being--.*

Signed and Sealed this

Twenty-fifth Day of December, 2007

JON W. DUDAS
*Director of the United States Patent and Trademark Office*